US012532941B2

(12) United States Patent
VanDomelen

(10) Patent No.: US 12,532,941 B2
(45) Date of Patent: Jan. 27, 2026

(54) SOLE STRUCTURE FOR ARTICLE OF FOOTWEAR

(71) Applicant: NIKE, Inc., Beaverton, OR (US)

(72) Inventor: Paul VanDomelen, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 18/601,254

(22) Filed: Mar. 11, 2024

(65) Prior Publication Data

US 2024/0206590 A1 Jun. 27, 2024

Related U.S. Application Data

(63) Continuation of application No. 17/987,635, filed on Nov. 15, 2022, now Pat. No. 11,950,653, which is a (Continued)

(51) Int. Cl.

| | |
|---|---|
| ***A43B 13/18*** | (2006.01) |
| ***A43B 13/12*** | (2006.01) |
| ***A43B 13/20*** | (2006.01) |

(52) U.S. Cl.

CPC ..... *A43B 13/186* (2013.01); *A43B 13/125* (2013.01); *A43B 13/188* (2013.01); (Continued)

(58) Field of Classification Search

CPC ... A43B 13/186; A43B 13/188; A43B 13/189; A43B 13/125; A43B 13/20; A43B 13/206

See application file for complete search history.

(56) References Cited

U.S. PATENT DOCUMENTS 4,096,649 A 6/1978 Saurwein
5,083,361 A * 1/1992 Rudy ..... B32B 7/02 29/454

(Continued)

FOREIGN PATENT DOCUMENTS

CN 107072349 A 8/2017
WO WO-2003/056964 A1 7/2003

(Continued)

OTHER PUBLICATIONS

European Patent Office (ISA), International Search Report and Written Opinion for International Application No. PCT/US2019/068938, mailed Apr. 17, 2020.

(Continued)

*Primary Examiner* — Khoa D Huynh
*Assistant Examiner* — Haley A Smith
(74) *Attorney, Agent, or Firm* — Honigman LLP; Matthew H. Szalach; Jonathan P. O'Brien

(57) ABSTRACT

A sole structure includes a foam element extending from a forefoot region to a heel region. A lower surface of the foam element includes a recess formed in the forefoot region. The sole structure also includes a posterior cushioning arrangement extending along a peripheral region of the sole structure from a heel region to a mid-foot region, and an anterior cushioning arrangement disposed in the recess of the foam element. The anterior cushioning arrangement has a proximal end adjacent to the lower surface of the foam element and a distal end formed on an opposite side of the anterior cushioning arrangement than the proximal end. The anterior cushioning arrangement includes at least one medial bladder proximate to a medial side of the sole structure and at least one lateral bladder proximate to a lateral side of the sole structure.

20 Claims, 32 Drawing Sheets

Related U.S. Application Data continuation of application No. 16/729,998, filed on Dec. 30, 2019, now Pat. No. 11,517,074.

(60) Provisional application No. 62/903,246, filed on Sep. 20, 2019, provisional application No. 62/787,628, filed on Jan. 2, 2019.

(52) U.S. Cl.
CPC ..... *A43B 13/189* (2013.01); *A43B 13/20* (2013.01); *A43B 13/206* (2013.01)

(56) References Cited

U.S. PATENT DOCUMENTS

| | | | | |
|---|---|---|---|---|
| 5,543,194 | A | 8/1996 | Rudy | |
| 6,253,466 | B1 * | 7/2001 | Harmon-Weiss | A43B 13/189 36/35 R |
| 6,266,897 | B1 * | 7/2001 | Seydel | A43B 13/16 36/25 R |
| 6,354,020 | B1 * | 3/2002 | Kimball | A43B 13/203 36/35 B |
| 6,658,766 | B2 | 12/2003 | Kraeuter et al. | |
| 6,754,981 | B1 * | 6/2004 | Edwards | A43B 7/1445 36/3 R |
| 7,396,574 | B2 | 7/2008 | Rudy | |
| 8,650,775 | B2 | 2/2014 | Peyton | |
| 9,981,437 | B2 * | 5/2018 | Campos, II | B29D 35/142 |
| 10,149,513 | B1 | 12/2018 | Eldem et al. | |
| 10,172,420 | B2 | 1/2019 | James | |
| 10,524,540 | B1 | 1/2020 | Eldem et al. | |
| 10,750,821 | B2 | 8/2020 | Greene | |
| 2002/0092201 | A1 | 7/2002 | Kraeuter et al. | |
| 2003/0093920 | A1 | 5/2003 | Greene et al. | |
| 2005/0132607 | A1 | 6/2005 | Dojan et al. | |
| 2010/0107444 | A1 | 5/2010 | Aveni | |
| 2010/0325914 | A1 | 12/2010 | Peyton | |
| 2013/0192087 | A1 * | 8/2013 | Litchfield | A43B 13/203 36/43 |
| 2014/0075779 | A1 | 3/2014 | Bruce et al. | |
| 2014/0230276 | A1 | 8/2014 | Campos, II et al. | |
| 2015/0257481 | A1 | 9/2015 | Campos, II | |
| 2016/0073732 | A1 | 3/2016 | Ernst et al. | |
| 2016/0120263 | A1 * | 5/2016 | Cortez | A43B 13/20 36/29 |
| 2017/0035146 | A1 | 2/2017 | Peyton | |
| 2017/0265566 | A1 | 9/2017 | Case et al. | |
| 2018/0125160 | A1 * | 5/2018 | Dojan | A43B 13/122 |
| 2018/0213886 | A1 * | 8/2018 | Connell | A43B 13/184 |
| 2018/0303200 | A1 | 10/2018 | Greene | |
| 2018/0338577 | A1 | 11/2018 | Elder et al. | |
| 2019/0231028 | A1 | 8/2019 | Eldem et al. | |
| 2023/0000208 | A1 * | 1/2023 | Klein | A43B 7/14 |

FOREIGN PATENT DOCUMENTS

| | | | |
|---|---|---|---|
| WO | WO-2016/144649 | A1 | 9/2016 |
| WO | WO-2017079256 | A1 | 5/2017 |

OTHER PUBLICATIONS

USPTO, Final Office Action for U.S. Appl. No. 16/729,998, mailed Mar. 4, 2022.

USPTO, Non-Final Office Action for U.S. Appl. No. 16/729,998, mailed Sep. 2, 2021.

USPTO, Non-Final Office Action for U.S. Appl. No. 17/987,635, mailed Jul. 19, 2023.

China National Intellectual Property Administration (CNIPA), Rejection Decision for CN App. No. 201980093124.X, mailed Sep. 9, 2022.

* cited by examiner

SOLE STRUCTURE FOR ARTICLE OF FOOTWEAR

CROSS REFERENCE TO RELATED APPLICATIONS

This patent application is a continuation of U.S. application Ser. No. 17/987,635, filed on Nov. 15, 2022, which is a continuation of U.S. application Ser. No. 16/729,998, filed on Dec. 30, 2019, which claims the benefit of U.S. Provisional Application No. 62/787,628, filed on Jan. 2, 2019, and of U.S. Provisional Application No. 62/903,246, filed on Sep. 20, 2019, the disclosures of which are considered part of the disclosure of this application and are hereby incorporated by reference in their entirety.

FIELD

The present disclosure relates generally to sole structures for articles of footwear, and more particularly, to sole structures incorporating a fluid-filled bladder.

BACKGROUND

This section provides background information related to the present disclosure which is not necessarily prior art.

Articles of footwear conventionally include an upper and a sole structure. The upper may be formed from any suitable material(s) to receive, secure, and support a foot on the sole structure. The upper may cooperate with laces, straps, or other fasteners to adjust the fit of the upper around the foot. A bottom portion of the upper, proximate to a bottom surface of the foot, attaches to the sole structure.

Sole structures generally include a layered arrangement extending between a ground surface and the upper. One layer of the sole structure includes an outsole that provides abrasion-resistance and traction with the ground surface. The outsole may be formed from rubber or other materials that impart durability and wear-resistance, as well as enhance traction with the ground surface. Another layer of the sole structure includes a midsole disposed between the outsole and the upper. The midsole provides cushioning for the foot and may be partially formed from a polymer foam material that compresses resiliently under an applied load to cushion the foot by attenuating ground-reaction forces. The midsole may additionally or alternatively incorporate a fluid-filled bladder to increase durability of the sole structure, as well as to provide cushioning to the foot by compressing resiliently under an applied load to attenuate ground-reaction forces. Sole structures may also include a comfort-enhancing insole or a sockliner located within a void proximate to the bottom portion of the upper and a strobel attached to the upper and disposed between the midsole and the insole or sockliner.

Midsoles employing fluid-filled bladders typically include a bladder formed from two barrier layers of polymer material that are sealed or bonded together. The fluid-filled bladders are pressurized with a fluid such as air, and may incorporate tensile members within the bladder to retain the shape of the bladder when compressed resiliently under applied loads, such as during athletic movements. Generally, bladders are designed with an emphasis on balancing support for the foot and cushioning characteristics that relate to responsiveness as the bladder resiliently compresses under an applied load

DRAWINGS

The drawings described herein are for illustrative purposes only of selected configurations and are not intended to limit the scope of the present disclosure.

Corresponding reference numerals indicate corresponding parts throughout the drawings.

DETAILED DESCRIPTION

Figure 1:
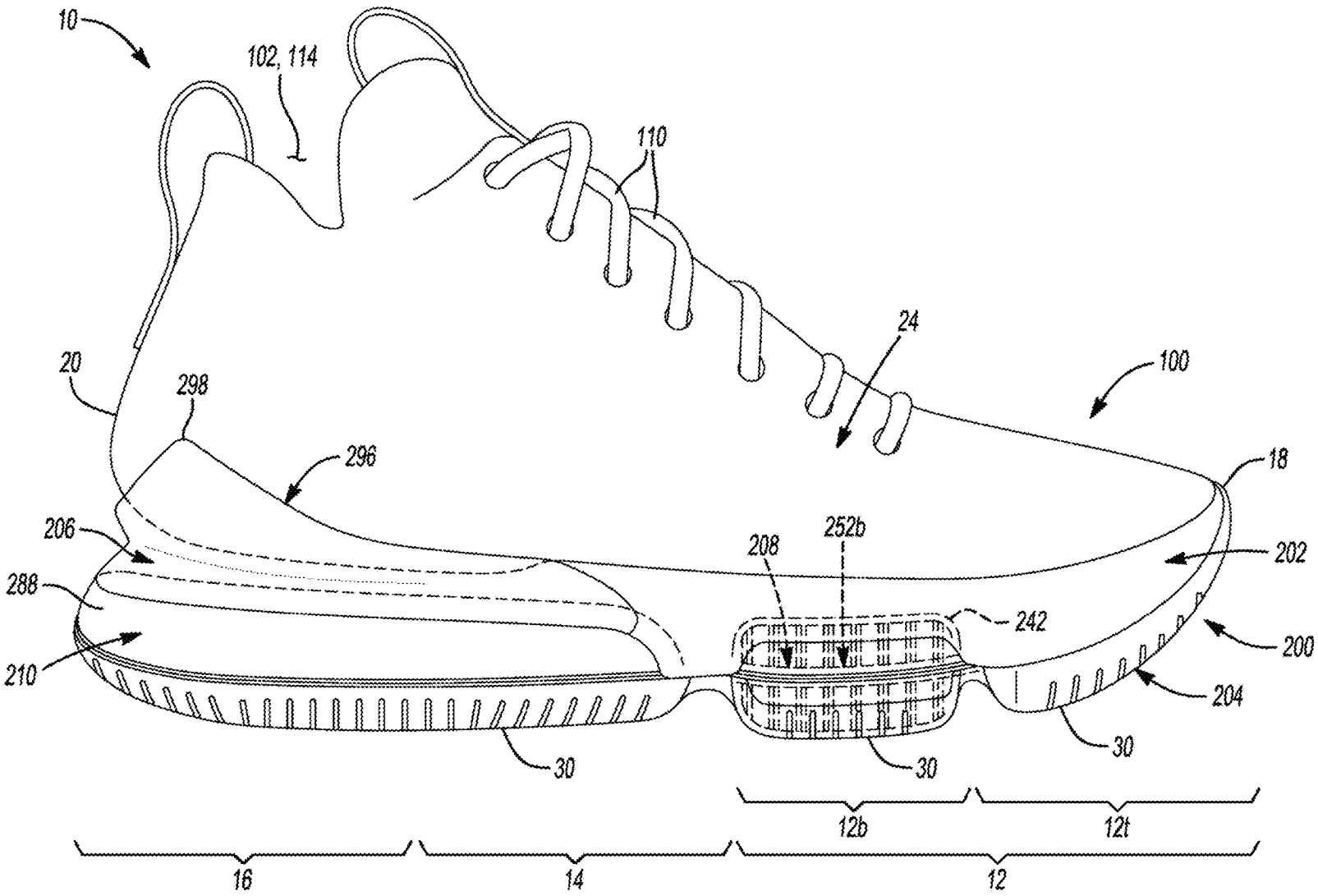
FIG. 1 is a side elevation view of an article of footwear in accordance with principles of the present disclosure.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

One aspect of the disclosure provides sole structure for an article of footwear having a heel region, a mid-foot region, a forefoot region, an interior region, and a peripheral region, the sole structure comprising. The sole structure further includes a foam element extending from the forefoot region to the heel region and having an upper surface and a lower surface formed on an opposite side of the foam element from the upper surface, the foam element including a recess formed in the lower surface in the forefoot region. The sole structure also includes a posterior cushioning arrangement extending along the peripheral region of the sole structure from the heel region to the mid-foot region, an anterior cushioning arrangement disposed in the recess of the foam element and having a proximal end adjacent to the lower surface of the foam element and a distal end formed on an opposite side of the anterior cushioning arrangement than the proximal end, the anterior cushioning arrangement including at least one medial bladder proximate to a medial side of the sole structure and at least one lateral bladder proximate to a lateral side of the sole structure.

Implementations of the disclosure may include one or more of the following optional features. In some implementations, at least one medial bladder includes a first bladder and a second bladder in a stacked arrangement, the first bladder being disposed between the foam element and the second bladder. Here, the at least one lateral bladder may include a third bladder and a fourth bladder in a stacked arrangement, the third bladder being disposed between the foam element and the fourth bladder.

In some examples, the at least one medial bladder is offset from the at least one lateral bladder along a longitudinal direction of the sole structure.

In some implementations, the anterior cushioning arrangement includes at least one chamber having a tensile member disposed therein, and the posterior cushioning arrangement includes a chamber devoid of a tensile member.

In some examples, the posterior cushioning arrangement includes an arcuate segment extending around the heel region, a first segment extending along the peripheral region on the medial side of the sole structure from the arcuate segment to a first terminal end in the mid-foot region, and a second segment extending along the peripheral region on the lateral side of the sole structure from the arcuate segment to a second terminal end in the mid-foot region, the second segment separated from the first segment by a space formed through the interior region of the posterior cushioning arrangement. Optionally, the interior region of the lower surface of the foam element extends into the space formed through the interior region of the posterior cushioning arrangement.

In some implementations, a first portion of the lower surface of the foam element is flush with a lower surface of the posterior cushioning arrangement in the mid-foot region and a second portion of the lower surface of the foam element is offset from the lower surface of the posterior cushioning arrangement.

In some examples, the sole structure further comprises an outsole having an inner surface facing the anterior cushioning arrangement and an outer surface formed on an opposite side of the outsole than the inner surface, the outer surface defining a ground-engaging surface of the sole structure. Optionally, the outsole is overmolded and encompasses each of the foam element, the posterior cushioning arrangement, and the anterior cushioning arrangement.

Another aspect of the disclosure provides a sole structure for an article of footwear having a heel region, a mid-foot region, a forefoot region, an interior region, and a peripheral region, the sole structure comprising. The sole structure includes a foam element extending from the forefoot region to the heel region and including an upper surface and a lower surface formed on an opposite side of the foam element than the upper surface, the lower surface defining a first portion of a ground-engaging surface of the sole structure in the forefoot region. The sole structure further includes an anterior cushioning arrangement extending from the lower surface of the foam element in the forefoot region and including at least one medial-forefoot bladder proximate to a medial side of the sole structure in the forefoot region and at least one lateral-forefoot bladder proximate to a lateral side of the sole structure in the forefoot region, the anterior cushioning arrangement defining a second portion of the ground-engaging surface of the sole structure in the forefoot region, and a posterior cushioning arrangement extending from the lower surface of the foam element in the peripheral region of the heel region and including an arcuate segment extending around the heel region, a first segment extending along the medial side from the arcuate segment, and a second segment extending along the lateral side from the arcuate segment, the posterior cushioning arrangement defining a third portion of the ground-engaging surface in the heel region.

Implementations of the disclosure may include one or more of the following optional features. In some implementations, the at least one medial-forefoot bladder includes a first bladder and a second bladder in a stacked arrangement, the first bladder being disposed between the foam element and the second bladder. Optionally, the at least one lateral-forefoot bladder includes a third bladder and a fourth bladder in a stacked arrangement, the third bladder being disposed between the foam element and the fourth bladder.

In some examples, the at least one medial-forefoot bladder is offset from the at least one lateral-forefoot bladder along a longitudinal direction of the sole structure.

In some implementations, the anterior cushioning arrangement further includes at least one lateral-midfoot bladder proximate to the lateral side of the sole structure in the mid-foot region and adjacent to the at least one lateral-forefoot bladder.

In some examples, the lower surface of the foam element and the posterior cushioning arrangement cooperate to define a fourth portion of the ground-engaging surface in the mid-foot region.

In some implementations, the interior region of the lower surface of the foam element extends into a space formed through the interior region of the posterior cushioning arrangement.

In some examples, a first portion of the lower surface of the foam element is flush with a lower surface of the posterior cushioning arrangement in the mid-foot region and a second portion of the lower surface of the foam element is offset from the lower surface of the posterior cushioning arrangement.

In some implementations, the sole structure further comprises an outsole having an inner surface facing the anterior cushioning arrangement and an outer surface formed on an opposite side of the outsole than the inner surface, the outer surface defining a ground-engaging surface of the sole structure. Here, the outsole may be overmolded and encompass each of the foam element, the posterior cushioning arrangement, and the anterior cushioning arrangement.

Referring to FIG. 1, an article of footwear 10 includes an upper 100 and sole structure 200. The article of footwear 10 may be divided into one or more regions. The regions may include a forefoot region 12, a mid-foot region 14, and a heel region 16. The forefoot region 12 may be subdivided into a toe portion $\mathbf{12}_T$ corresponding with phalanges, and a ball portion $\mathbf{12}_B$ associated with metatarsal bones of a foot. The mid-foot region 14 may correspond with an arch area of the foot, and the heel region 16 may correspond with rear portions of the foot, including a calcaneus bone.

Figure 3:
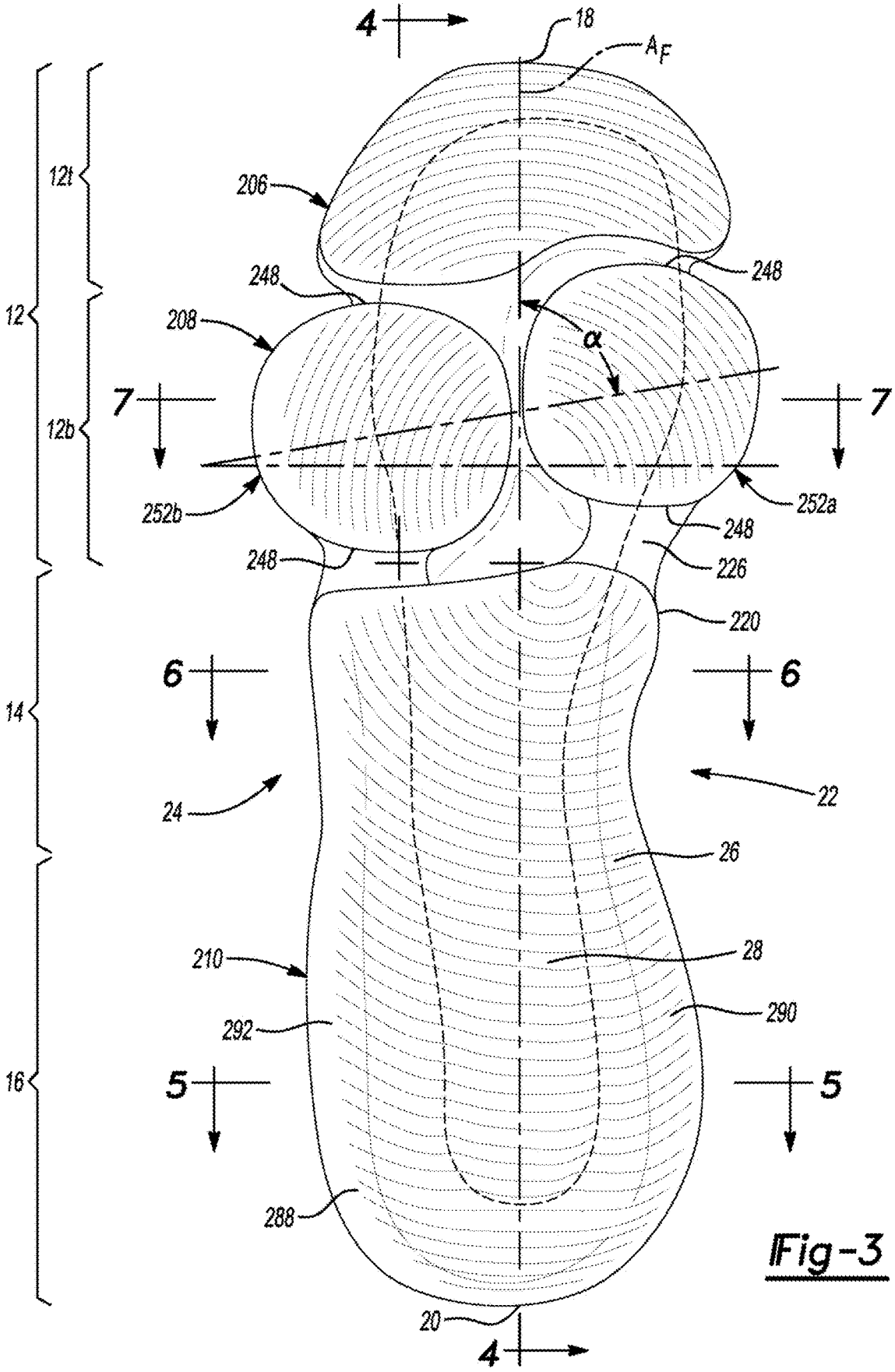
FIG. 3 is bottom perspective view of the article of footwear of FIG. 1.

The footwear 10 may further include an anterior end 18 associated with a forward-most point of the forefoot region 12, and a posterior end 20 corresponding to a rearward-most point of the heel region 16. As shown in FIG. 3, a longitudinal axis $A_F$ of the footwear 10 extends along a length of the footwear 10 from the anterior end 18 to the posterior end 20, parallel to a ground surface. As shown, the longitudinal axis $A_F$ is centrally located along the length of the footwear 10, and generally divides the footwear 10 into a medial side 22 and a lateral side 24. Accordingly, the medial side 22 and the lateral side 24 respectively correspond with opposite sides of the footwear 10 and extend through the regions 12, 14, 16. As used herein, a longitudinal direction refers to the direction extending from the anterior end 18 to the posterior end 20, while a lateral direction refers to the direction transverse to the longitudinal direction and extending from the medial side 22 to the lateral side 24.

The article of footwear 10, and more particularly, the sole structure 200, may be further described as including a peripheral region 26 and an interior region 28, as signified by the phantom line in FIG. 3. The peripheral region 26 is generally described as being a region between the interior region 28 and an outer perimeter of the sole structure 200. Particularly, the peripheral region 26 extends from the forefoot region 12 to the heel region 16 along each of the medial side 22 and the lateral side 24, and wraps around each of the forefoot region 12 and the heel region 16. The interior region 28 is circumscribed by the peripheral region 26, and extends from the forefoot region 12 to the heel region 16 along a central portion of the sole structure 200. Accordingly, each of the forefoot region 12, the mid-foot region 14, and the heel region 16 may be described as including the peripheral region 26 and the interior region 28.

The upper 100 includes interior surfaces that define an interior void 102 configured to receive and secure a foot for support on sole structure 200. The upper 100 may be formed from one or more materials that are stitched or adhesively bonded together to form the interior void 102. Suitable materials of the upper 100 may include, but are not limited to, mesh, textiles, foam, leather, and synthetic leather. The materials may be selected and located to impart properties of durability, air-permeability, wear-resistance, flexibility, and comfort.

With reference to FIG. 3, in some examples the upper 100 includes a strobel 104 having a bottom surface opposing the sole structure 200 and an opposing top surface defining a footbed 106 of the interior void 102. Stitching or adhesives may secure the strobel to the upper 100. The footbed 106 may be contoured to conform to a profile of the bottom surface (e.g., plantar) of the foot. Optionally, the upper 100 may also incorporate additional layers such as an insole 108 or sockliner that may be disposed upon the strobel 104 and reside within the interior void 102 of the upper 100 to receive a plantar surface of the foot to enhance the comfort of the article of footwear 10. Referring again to FIG. 1, an ankle opening 114 in the heel region 16 may provide access to the interior void 102. For example, the ankle opening 114 may receive a foot to secure the foot within the void 102 and to facilitate entry and removal of the foot from and to the interior void 102.

In some examples, one or more fasteners 110 extend along the upper 100 to adjust a fit of the interior void 102 around the foot and to accommodate entry and removal of the foot therefrom. The upper 100 may include apertures, such as eyelets and/or other engagement features such as fabric or mesh loops that receive the fasteners 110. The fasteners 110 may include laces, straps, cords, hook-and-loop, or any other suitable type of fastener. The upper 100 may include a tongue portion 116 that extends between the interior void 102 and the fasteners 110.

Figure 2:
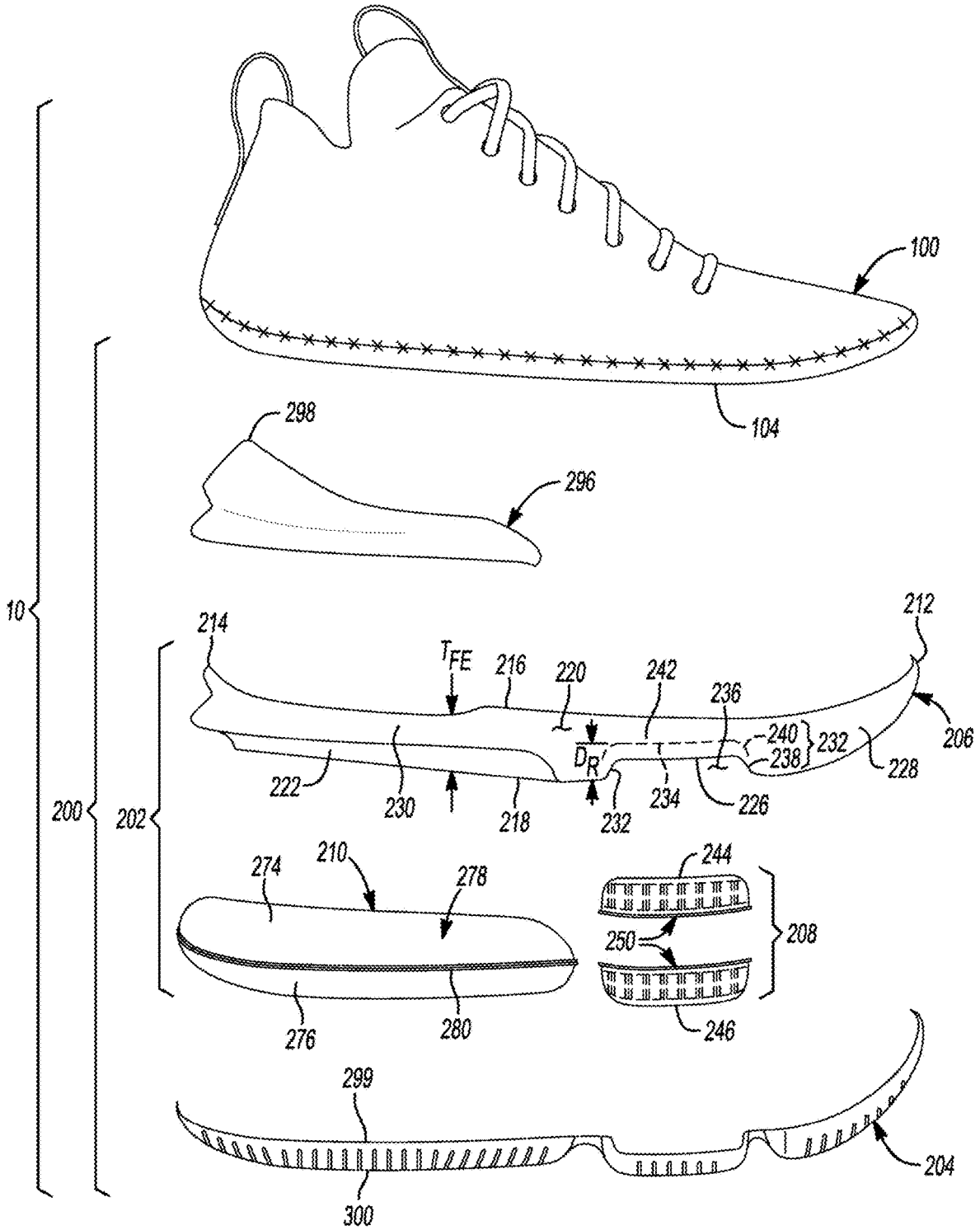
FIG. 2 is an exploded view of the article of footwear of FIG. 1, showing an article of footwear having an upper and a sole structure arranged in a layered configuration.

With reference to FIG. 2, the sole structure 200 includes a midsole 202 configured to provide cushioning characteristics to the sole structure 200, and an outsole 204 configured to provide a ground-engaging surface 30 of the article of footwear 10. Unlike conventional sole structures formed of a unitary midsole having a unitary outsole attached thereto, the midsole 202 is formed compositely and comprises a plurality of subcomponents for providing zonal cushioning and performance characteristics. For example, the midsole 202 includes a foam element 206, an anterior cushioning arrangement 208, and a posterior cushioning arrangement 210. The subcomponents 206, 208, 210 of the midsole 202 are assembled and secured to each other using various methods of bonding, including adhesively bonding and melding, for example. As described in greater detail below, the outsole 204 is overmolded onto the subcomponents 206, 208, 210 of the midsole 202, whereby the midsole 202 defines a profile of the ground-engaging surface 30 of the footwear 10.

With reference to FIG. 2, the foam element 206 extends from a first end 212 at the anterior end 18 of the footwear 10 to a second end 214 at the posterior end 20 of the footwear. Accordingly, the foam element 206 extends along an entire length of the footwear 10. The foam element 206 further includes a top surface 216 and a bottom surface 218 formed on an opposite side of the foam element 206 than the top surface 216. The top surface 216 of the foam element 206 is configured to oppose the strobel 104 of the upper 100, and may be contoured to define a profile of the footbed 106 corresponding to a shape of the foot. As shown in FIG. 2, a distance between the top surface 216 and the bottom surface 218 defines a thickness $T_{FE}$ of the foam element 206, which is variable along the length of the sole structure 200.

The foam element 206 further includes a peripheral side surface 220 extending between the top surface 216 and the bottom surface 218. The peripheral side surface 220 generally defines an outer periphery of the sole structure 200. As shown in FIG. 2, the peripheral side surface 220 of the foam element 206 is configured to cooperate with the posterior cushioning arrangement 210. Particularly, the peripheral side surface 220 includes a peripheral groove 222 extending around the second end 214 of the foam element 206.

Figure 4:
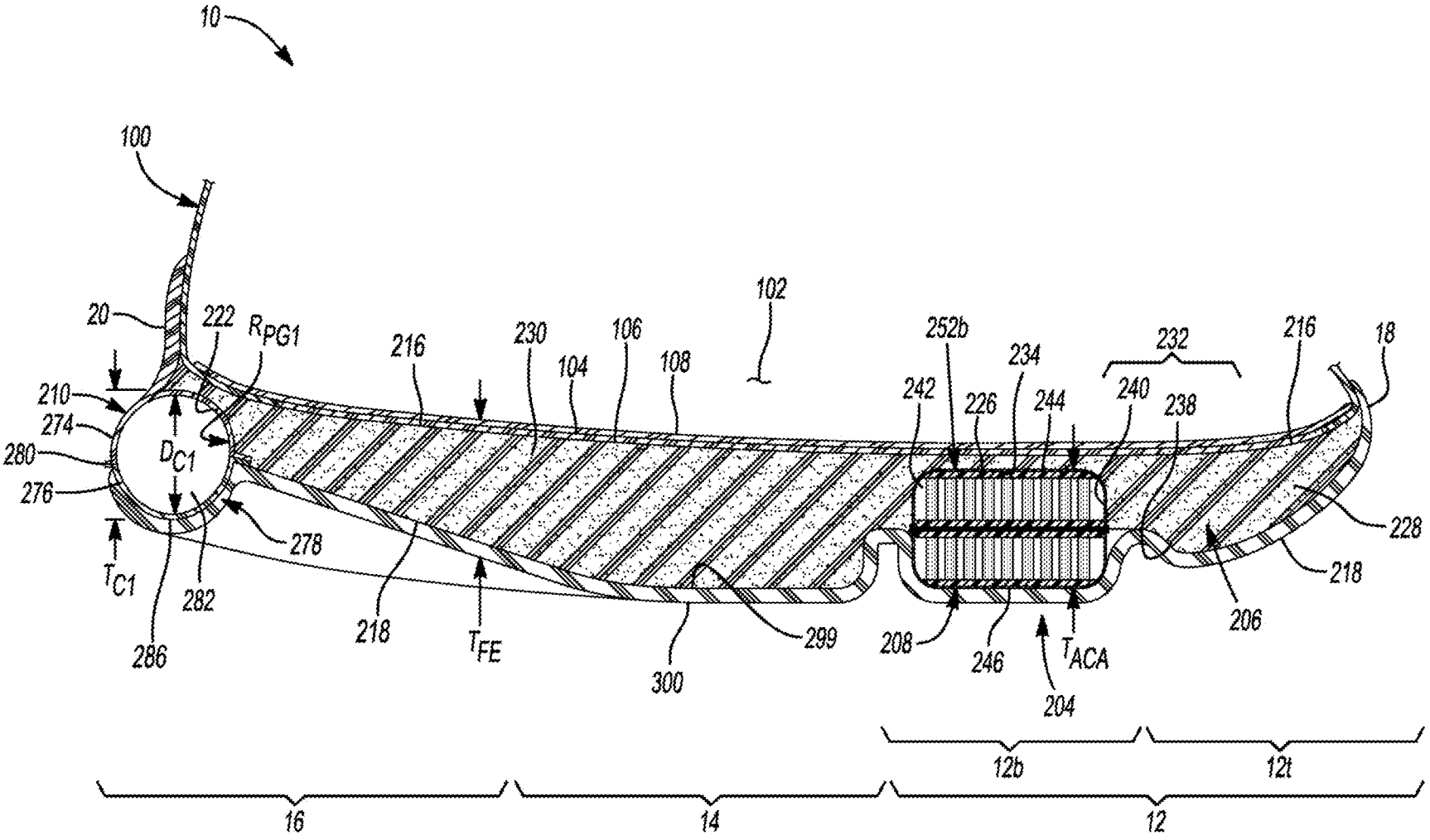
FIG. 4 is a cross-sectional view of the article of footwear of FIG. 1, taken along line 4-4 of FIG. 3 and corresponding to a longitudinal axis of the article of footwear.
Figure 5:
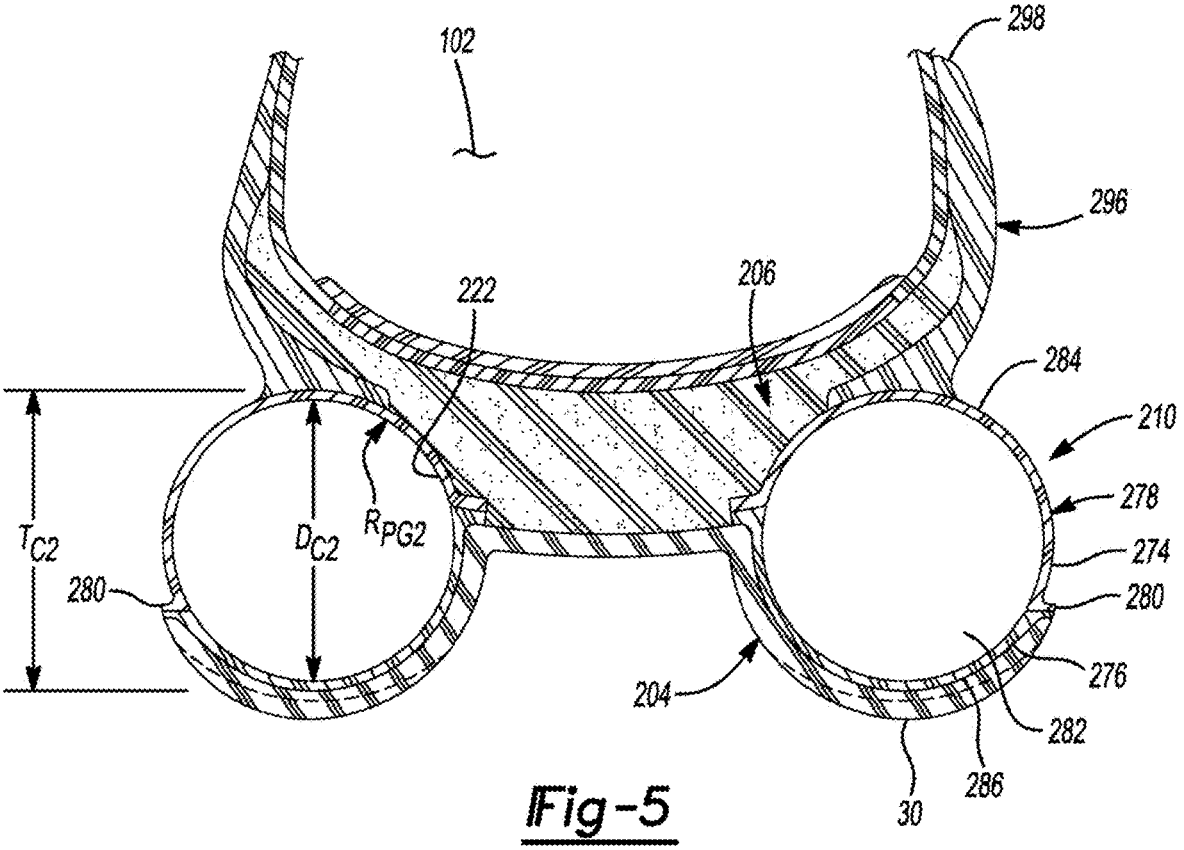
FIG. 5 is a cross-sectional view of the article of footwear of FIG. 1, taken along line 5-5 of FIG. 3.
Figure 6:
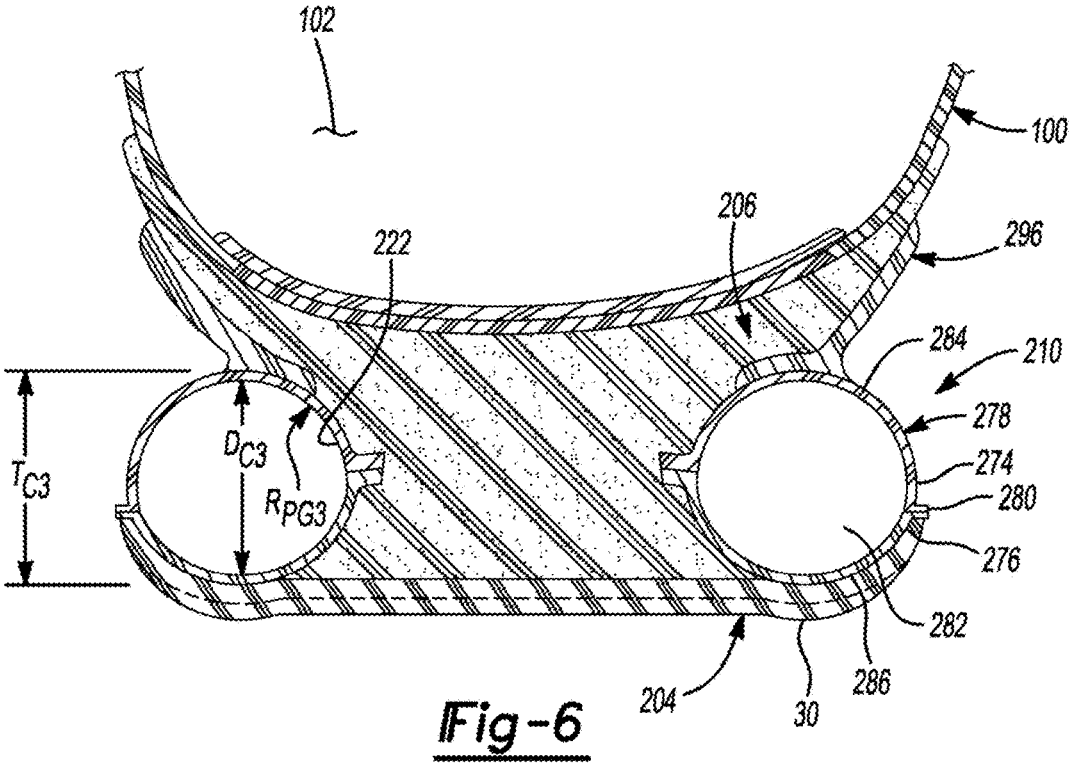
FIG. 6 is a cross-sectional view of the article of footwear of FIG. 1, taken along line 6-6 of FIG. 3.

With continued reference to FIG. 2, the peripheral groove 222 extends from a first end 224 (hidden) in the forefoot region 12 on the medial side 22 and around the heel region 16 to a second end 224 in the mid-foot region 14 on the lateral side 24. As shown in FIGS. 4-6, a cross-sectional shape of the peripheral groove 222 is concave and corresponds to an outer circumference of the posterior cushioning arrangement 210. Although the peripheral groove 222 is continuously concave along its length, a radius of the peripheral groove 222 is variable and is configured to accommodate the tapered thicknesses $T_C$ of the posterior cushioning arrangement 210, as discussed below. For example, as shown in FIG. 4, the peripheral groove 222 has first radius $R_{PG1}$ in the heel region 12 corresponding to a first thickness $T_{C1}$ or diameter of the posterior cushioning arrangement 210 at the posterior end 20. Similarly, as shown in FIGS. 5 and 6, the radius of the peripheral groove 222 progressively decreases from the first radius $R_{PG1}$ at the posterior end 20, though a second radius $R_{PG2}$ in the heel region 16, and to a third radius $R_{PG3}$ in the forefoot region 12 to accommodate a corresponding taper in the thickness $T_C$ of the posterior cushioning arrangement 210. Particularly, the first radius $R_{PG1}$ and a first thickness $T_{C1}$ are greater than the respective second radius $R_{PG2}$ and second thickness $T_{C2}$, while the second radius $R_{PG2}$ and second thickness $T_{C2}$ are greater than the third radius $R_{PG3}$ and a corresponding third thickness $T_{C3}$. When the sole structure 200 is assembled, the peripheral groove 222 receives an inner peripheral portion of the posterior cushioning arrangement 210.

The foam element 206 includes a recess 226 configured to receive the anterior cushioning arrangement 208 therein. As shown in FIG. 2, the recess 226 is formed in the forefoot region 12 of the sole structure 200 and is defined by a peripheral sidewall 232 extending from the bottom surface 218 of the foam element 206 towards the top surface 216. Generally, the recess 226 separates the foam element 206 into an anterior segment 228 and a posterior segment 230. The anterior segment 228 extends between the recess 226 and the anterior end 18 of the sole structure 200, while the posterior segment 230 extends between the recess 226 and the posterior end 20 of the sole structure 200.

In the illustrated example, the peripheral sidewall 232 of the recess 226 extends partially from the bottom surface 218 to the top surface 216 and terminates at an intermediate surface 234 disposed between the bottom surface 218 and the top surface 216. Thus, a depth DR of the recess 226, measured from the bottom surface 218 to the intermediate surface 234, extends only partially through the thickness THE of the foam element 206. Here, the anterior segment 228 and the posterior segment 230 of the foam element 206 are connected to each other by the portion of the foam element 206 formed between the intermediate surface 234 and the top surface 216. Accordingly, the foam element 206 is formed as a unitary structure extending from the forefoot region 12 to the heel region 16.

In some examples, the sidewall 232 of the recess 226 intersects with the peripheral side surface 220 of the foam element 206 to define an opening 236 into the recess 226 through the peripheral side surface 220 of the foam element. As shown in FIG. 1, the peripheral sidewall 232 may only partially intersect the peripheral side surface 220 of the foam element 206, whereby the opening 236 does not fully expose the recess 226 through the peripheral side surface 220. For example, as shown in FIG. 1, a lower portion 238 of the peripheral sidewall 232 may intersect the peripheral side surface 220 to define the opening 236, while an upper portion 240 of the peripheral sidewall 232 is spaced apart from the peripheral side surface 220. Accordingly, the upper portion 240 of the peripheral sidewall 232 completely surrounds the recess 226, while the lower portion 238 of the peripheral sidewall 232 extends only partially around the recess 226.

Figure 7:
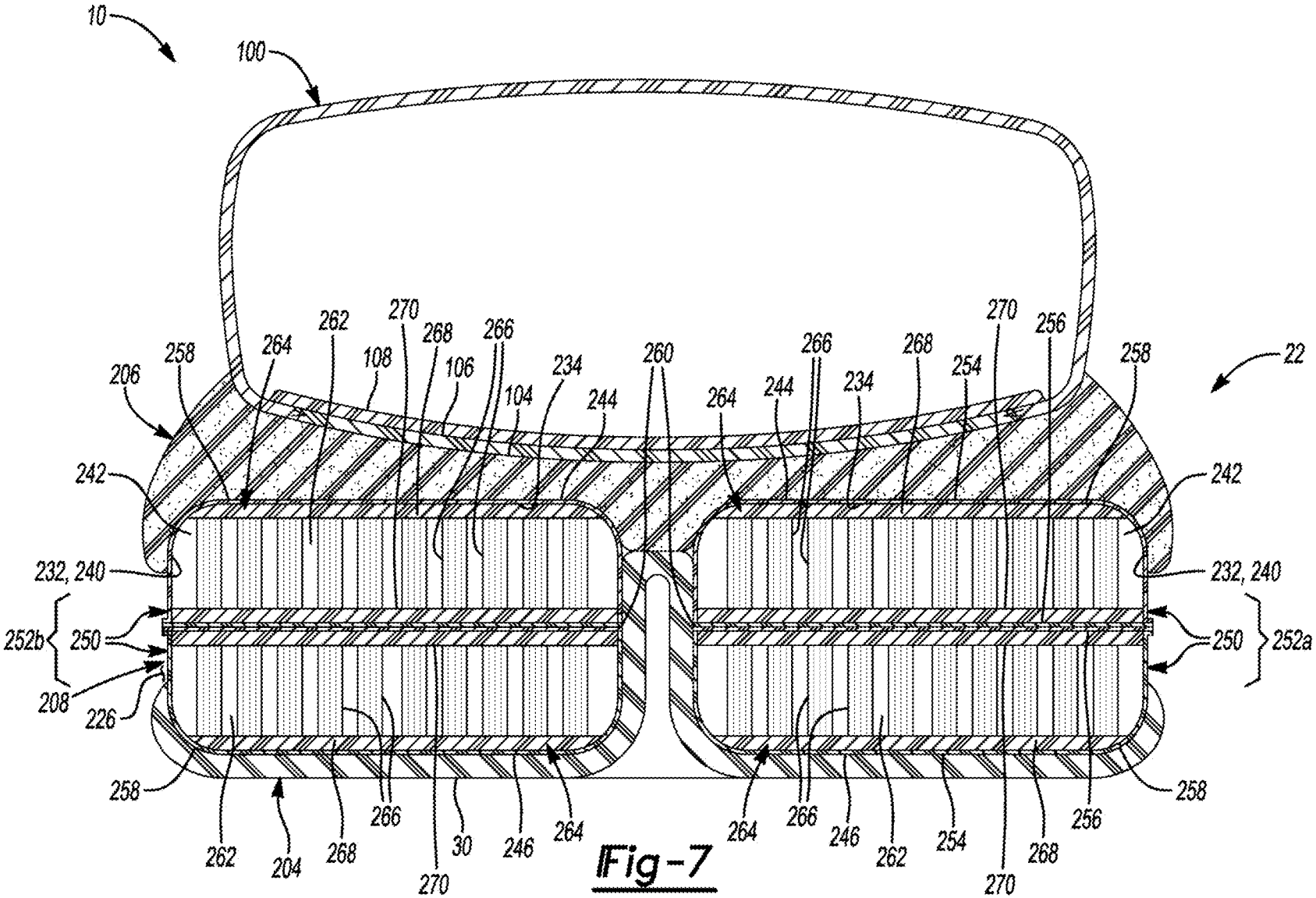
FIG. 7 is a cross-sectional view of the article of footwear of FIG. 1, taken along line 7-7 of FIG. 3.

Referring to FIG. 7, in some examples, the recess 226 may define one or more receptacles 242 configured to receive components of anterior cushioning arrangement 208. For example, where the anterior cushioning arrangement 208 is formed of a fragmentary structure, separate portions of the anterior cushioning arrangement 208 may be received by the receptacles 242. As shown, a profile of each of the receptacles 242 is defined by the peripheral sidewall 232 of the recess 226 and corresponds to an outer peripheral profile of the anterior cushioning arrangement 208. In some examples, the receptacles 242 are defined by the upper portion 240 of the peripheral sidewall 232, whereby the upper portion 240 of the peripheral sidewall 232 contacts the anterior cushioning arrangement 208, such that each receptacle 242 is substantially filled by the anterior cushioning arrangement 208. As shown in FIG. 4, the lower portion 238 of the peripheral sidewall 232 is spaced apart from the anterior cushioning arrangement 208.

Referring again to FIG. 2, the anterior cushioning arrangement 208 is configured to be disposed within the recess 226 of the foam element 206, in the forefoot region 12 of the sole structure 200. The anterior cushioning arrangement 208 includes a top surface 244 and a bottom surface 246 formed on an opposite side of the anterior cushioning arrangement 208 from the top surface 244, whereby a distance between the top surface 244 and the bottom surface 246 defines a thickness $T_{ACA}$ of the anterior cushioning arrangement 208. When assembled within the sole structure 200, the top surface 244 is adjacent and attaches to the intermediate surface 234 of the recess 226 while the bottom surface 246 faces away from the intermediate surface 234 of the recess 226. Accordingly, the top surface 244 may be referred to as a proximal end of the anterior cushioning arrangement 208, while the bottom surface 246 may be referred to as a distal end of the anterior cushioning arrangement 208. An outer peripheral surface 248 extends between the top surface 244 and the bottom surface 246 and defines an outer peripheral profile of the anterior cushioning arrangement 208.

In the illustrated example, the anterior cushioning arrangement 208 is formed as a fragmentary structure and includes a plurality of bladders 250 arranged to provide cushioning in the forefoot region 12 of the sole structure 200. Here, the bladders 250 are arranged in discrete columns 252 to provide localized cushioning characteristics to the sole structure 200. Each of the columns 252 comprises a pair of the bladders 250 stacked vertically, whereby a first bladder 250 is a proximal or upper bladder 250 and extends from the top surface 244 of the anterior cushioning arrangement 208, and a second bladder 250 is a distal or lower bladder 250 and extends between the upper bladder 250 and the bottom surface 246 of the anterior cushioning arrangement 208.

As shown in FIG. 3, the anterior cushioning arrangement 208 includes a medial-forefoot column 252*a* and a lateral-forefoot column 252*b*, which may be collectively referred to as the forefoot columns 252*a*, 252*b*. The medial-forefoot column 252*a* is disposed proximate to the peripheral side surface 220 of the foam element 206 on the medial side 22 of the sole structure 200, while the lateral-forefoot column 252*b* is disposed proximate to the peripheral side surface 220 of the foam element 206 on the lateral side 24 of the sole structure 200.

The medial-forefoot column 252*a* and the lateral-forefoot column 252*b* are generally aligned with each other along a direction from the medial side 22 to the lateral side 24 of the sole structure 200, whereby the forefoot columns 252*a*, 252*b* are adjacent to each other and cooperate to form a portion of the midsole 202 extending from the medial side 22 to the lateral side 24 in the forefoot region 12. As shown in FIG. 3, a longitudinal position of the forefoot columns 252*a*, 252*b* corresponds to the location of the metatarsophalangeal (MTP) joints of the foot at the ball portion $\mathbf{12}_B$ of the forefoot region 12. Accordingly, the forefoot columns 252*a*, 252*b* are not aligned with each other along the lateral direction of the sole structure 200, but are instead aligned at an oblique angle $\alpha$ relative to the longitudinal axis $A_F$ of the sole structure 200, where the medial-forefoot column 252*a* is offset closer to the anterior end 18 of the sole structure than the lateral-forefoot column 252*b*.

As discussed above and best illustrated in FIG. 7, the recess 226 includes a plurality of receptacles 242 configured to receive the components of the anterior cushioning arrangement 208. For example, in the illustrated example, a first one of the receptacles 242 receives the medial-forefoot column 252*a* and a second one of the receptacles 242 receives the lateral-forefoot column 252*b*. In the illustrated example, where the receptacles 242 are formed only by the upper portion 240 of the peripheral sidewall 232, only an upper portion of each of the forefoot columns 252*a*, 252*b* may be received within each receptacle 242. Particularly, where the forefoot columns 252*a*, 252*b* include upper and lower bladders 250, only the upper bladder 250 may be disposed within the receptacle, while the lower bladder 250 of each column 252*a*, 252*b* is substantially exposed within the recess 226.

The bladders 250 of the anterior cushioning arrangement 208 are constructed in a similar manner to each other. For example, each of the bladders 250 includes a first barrier layer 254 and a second barrier layer 256 opposing the first barrier layer 254, which can be joined to each other at discrete locations to define a chamber 258 and a peripheral seam 260

In some implementations, the first barrier layer 254 and the second barrier layer 256 cooperate to define a geometry (e.g., thicknesses, width, and lengths) of the chamber 258. For example, the peripheral seam 260 bounds the chamber 258 to seal the fluid (e.g., air) within the chamber 258. Thus, the chamber 258 is associated with an area of the bladder 250 where interior surfaces of the first barrier layer 254 and the second barrier layer 256 are not joined together and, thus, are separated from one another. In the illustrated example, an outer peripheral profile of the chamber 258 has a cross-sectional shape corresponding to a rounded square, as best shown in FIG. 3.

In the illustrated example, the first barrier layer 254 is cup-shaped and defines a height of the bladder 250, while the second barrier layer 256 is planar and defines a cover of the bladder 250. As shown in FIG. 7, the substantially planar second barrier layer 256 of the upper bladder 250 of each column 252*a*, 252*b* opposes the substantially planar second barrier layer 256 of the lower bladder 250, whereby the bladders 250 are in a face-to-face arrangement and form columns 252*a*, 252*b*, 252*c* having substantially continuous structures.

As shown in the figures, a space formed between opposing interior surfaces of the first barrier layer 254 and the second barrier layer 256 defines an interior void 262 of the chamber 258. The interior void 262 of the chamber 258 may receive a tensile element 264 therein. Each tensile element 264 may include a series of tensile strands 266 extending between a first tensile sheet 268 and a second tensile sheet 270. The first tensile sheet 268 may be attached to the first barrier layer 254 while the second tensile sheet 270 may be attached to the second barrier layer 256. In this manner, when the chamber 258 receives the pressurized fluid, the tensile strands 266 of the tensile element 264 are placed in tension. Because the first tensile sheet 268 is attached to the first barrier layer 254 and the second tensile sheet 270 is attached to the second barrier layer 256, the tensile strands 266 retain a desired shape of the bladder 250 when the pressurized fluid is injected into the interior void 262. For example, in the illustrated implementations, the tensile element 264 maintains substantially planar first and second barrier layers 254, 256, thereby allowing the bladders 250 to be stacked atop one another. Furthermore, by maintaining substantially planar first and second barrier layers 254, 256, the top and bottom surfaces 244, 246 of the anterior cushioning arrangement 208*a*, which are collectively defined by the barrier layers 254, 256, are also substantially planar.

In some examples, the interior void 262 is at a pressure ranging from 15 psi (pounds per square inch) to 25 psi. In other examples, the interior void 262 may have a pressure ranging from 20 psi to 25 psi. In some examples, the interior void 262 has a pressure of 20 psi. In other examples, the interior void 262 has a pressure of 25 psi. As provided above, where a plurality of bladders 250 form the anterior cushioning arrangement 208, the interior voids 262 of each of the bladders 250 may be pressurized differently from each other.

With reference to FIG. 2, the posterior cushioning arrangement 210 of the midsole 202 is a bladder 272 having an opposing pair of barrier layers 274, 276, which can be joined to each other at discrete locations to define an elongate chamber 278 and a peripheral seam 280. In the shown example, the barrier layers 274, 276 include a first, upper barrier layer 274 and a second, lower barrier layer 276. Alternatively, the chamber 278 can be produced from any suitable combination of one or more barrier layers.

In some implementations, the upper barrier layer 274 and the lower barrier layer 276 cooperate to define a geometry (e.g., thicknesses, width, and lengths) of the chamber 278. The peripheral seam 280 may bound and extend around the chamber 278 to seal the fluid (e.g., air) within the chamber 278. Thus, the chamber 278 is associated with an area of the posterior cushioning arrangement 210 where interior surfaces of the upper and lower barrier layers 274, 276 are not joined together and, thus, are separated from one another.

As shown in FIGS. 4-6, a space formed between opposing interior surfaces of the upper and lower barrier layers 274, 276 defines an interior void 282 of the chamber 278. Unlike the interior voids 262 of the bladders 250 of the anterior cushioning arrangement 208, which include tensile elements 264 disposed therein for maintaining a desired shape of the bladders 250, the interior void 282 of the bladders 272 of the posterior cushioning arrangement 210 is devoid of additional structure. Accordingly, a shape of the chamber 278 is entirely dependent on a shape of the upper and lower barrier layers 274, 276. More specifically, the shape of the chamber 278 is dependent on the shape of the upper and lower barrier layers 274, 276 when the interior void 282 is pressurized with a fluid, as discussed below.

In the illustrated example, the interior void 282 has a circular cross-sectional shape and defines an inside diameter DC of the chamber 278. As discussed in greater detail below, the inside diameter DC of the chamber 278 may taper continuously from a first inside diameter $D_{C1}$ at the posterior end, and through a second inside diameter $D_{C2}$ in the heel region 16 to a third inside diameter $D_{C3}$ in the mid-foot region 14, as shown in FIGS. 4-6. Similarly, exterior surfaces of the upper and lower barrier layers 274, 276 define an exterior profile of the chamber 278, which has a circular cross-sectional shape corresponding to the inside diameter De of the interior void 282. Accordingly, the first and second barrier layers 274, 276 define respective upper and lower surfaces 284, 286 of the chamber 278, which converge with each other in a direction from the posterior end 20 to the forefoot region 12 to define a tapering thickness $T_C$ of the chamber 278.

Figure 8A:
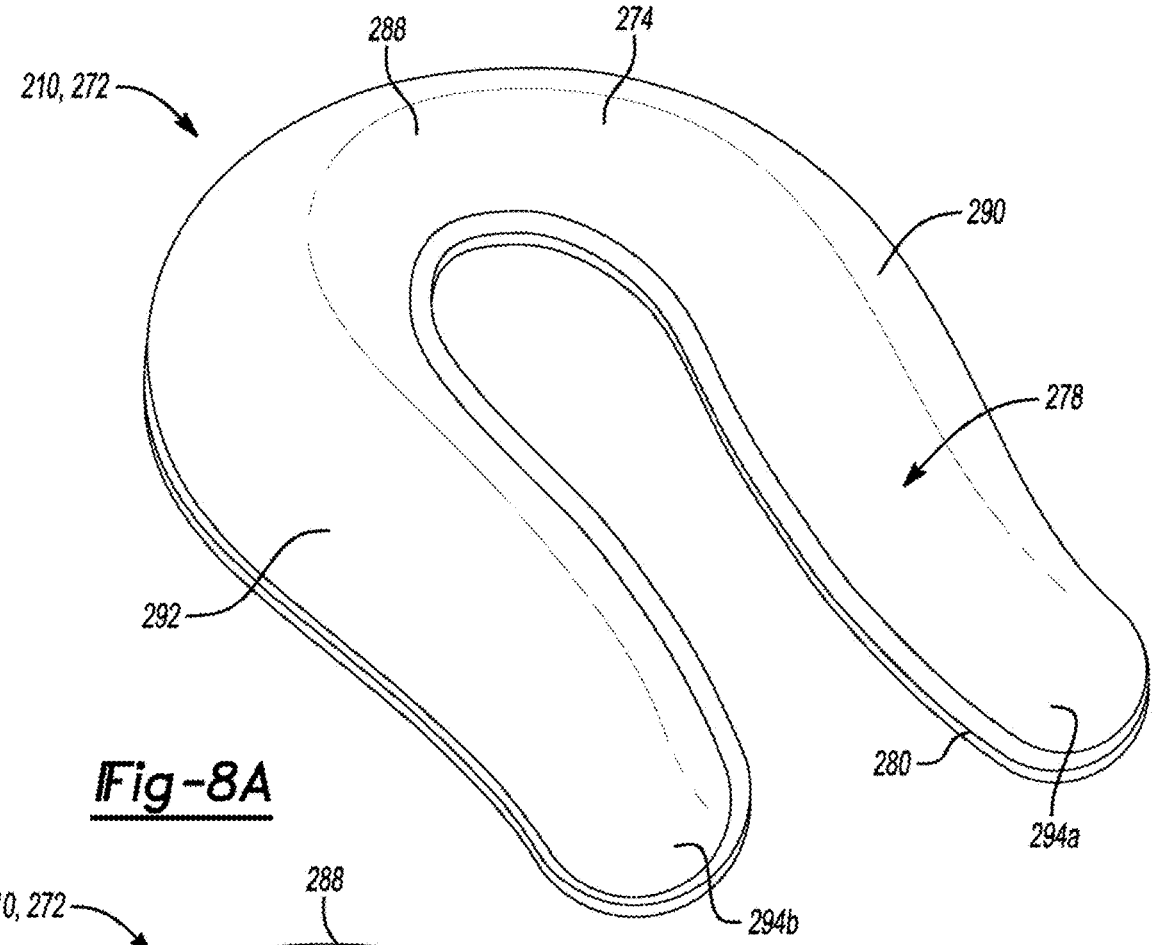
FIGS. 8A and 8B are top and bottom perspective views of a bladder of the article of footwear of FIG. 1.
Figure 8B:
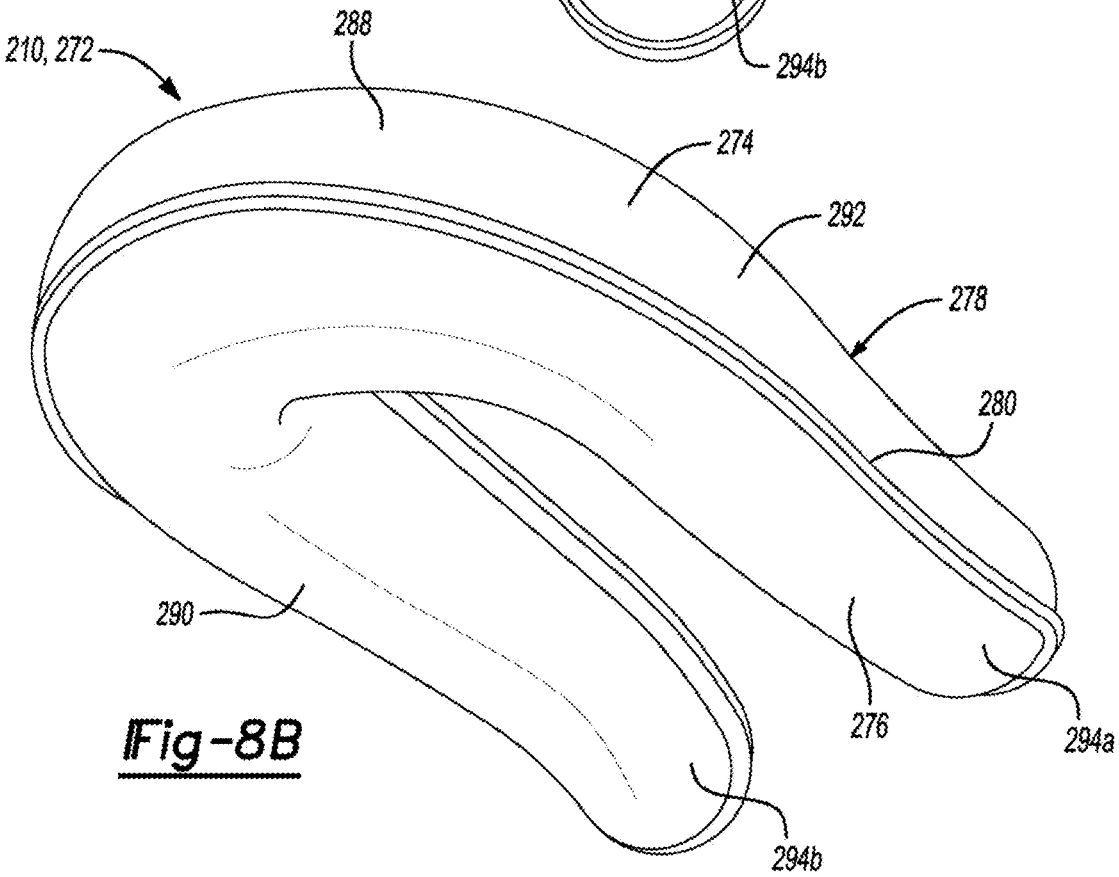
Figure 8C:
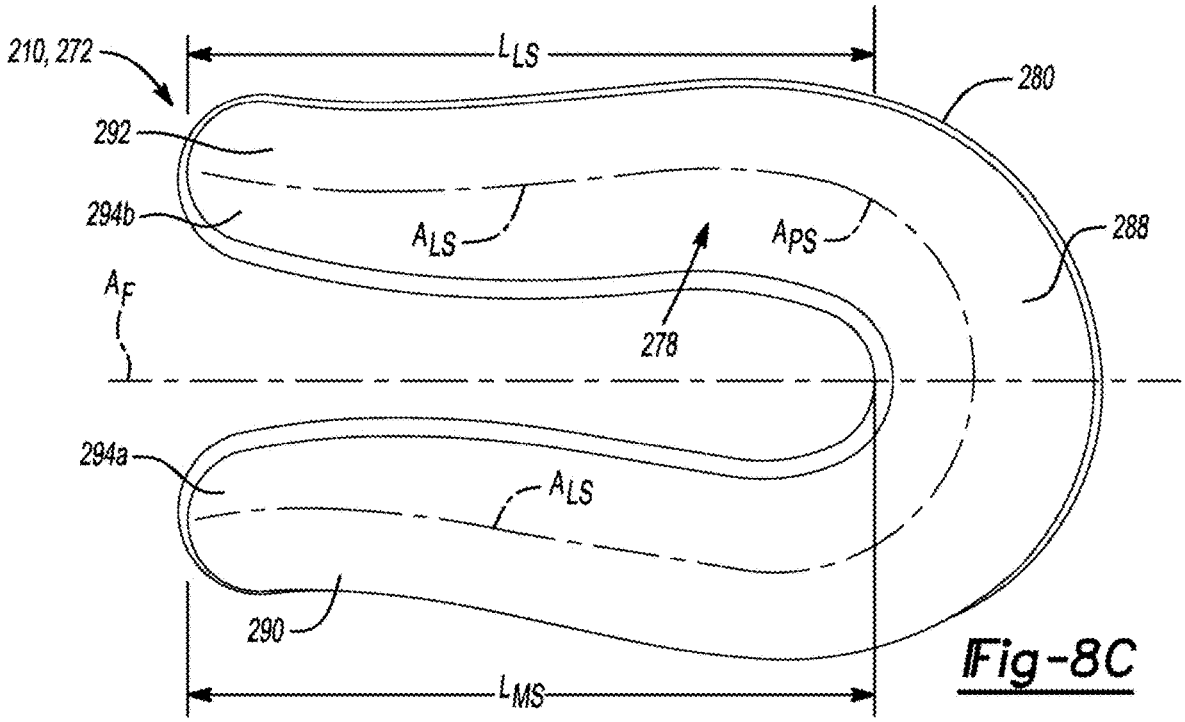
FIG. 8C is a top plan view of the bladder of FIGS. 8A and 8B.
Figure 8D:
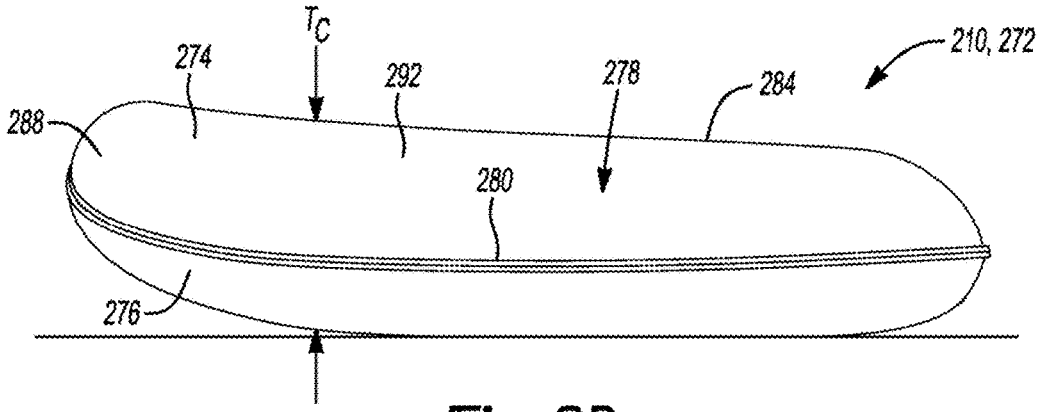
FIGS. 8D and 8E are medial and lateral side elevation views of the bladder of FIGS. 8A and 8B.
Figure 8E:
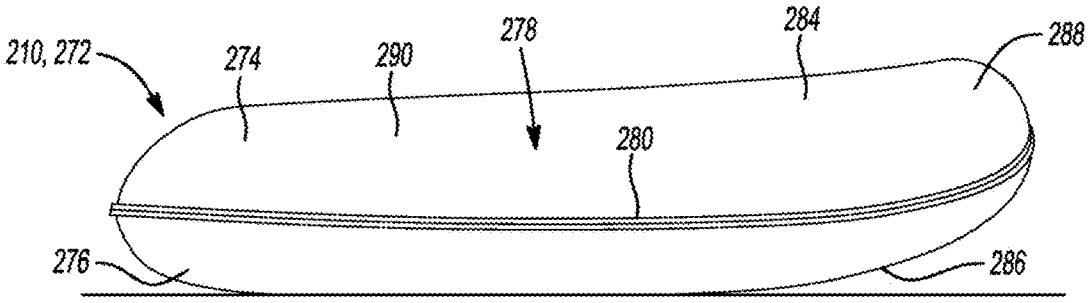

With reference to FIG. 8C, the chamber 278 may be described as including an arcuate posterior segment 288, an elongate medial segment 290, and an elongate lateral segment 292, all fluidly coupled to each other. Generally, the posterior segment 288 is configured to wrap around the posterior end 20 of the sole structure 200, while the medial segment 290 and the lateral segment 292 extend from opposing ends of the posterior segment 288 to respective terminal ends 294*a*, 294*b* of the chamber 278. The terminal ends 294*a*, 294*b* of the chamber 278 are substantially hemispherical in shape, whereby the upper and lower barrier layers 274, 276 have a constant radius of curvature.

Referring to FIG. 8C, the posterior segment 288 is configured to extend around the posterior end 20 of the heel region 16 and fluidly couples to the medial segment 290 and the lateral segment 292. More specifically, the posterior segment 288 extends along a substantially arcuate path or axis $A_{PS}$ to connect a posterior end of the medial segment 290 to a posterior end of the lateral segment 292. Furthermore, the posterior segment 288 is continuously formed with the medial segment 290 and the lateral segment 292. As shown in FIG. 1, the posterior segment 288 protrudes beyond the posterior end 20 of the upper 100, such that the upper 100 is offset towards the anterior end 18 from the rear-most portion of the posterior segment 288.

The medial segment 290 and the lateral segment 292 are continuously formed along each of the medial side 22 and the lateral side 24, and extend from the posterior segment 288 to respective terminal ends 294*a*, 294*b*. The medial segment 290 and the lateral segment 292 may be described as extending along respective arcuate paths or axes $A_{MS}$, $A_{LS}$. For instance, respective arcuate axes $A_{MS}$, $A_{LS}$ of the medial segment 290 and the lateral segment 292 converge with the longitudinal axis $A_F$ of the footwear 10 from posterior segment 288 to the mid-foot region 14, and then diverge from each other through the mid-foot region to the terminal ends 294*a*, 294*b*. Accordingly, the chamber 278 may generally define a hairpin shape.

As shown, when assembled into the sole structure 200, each of the medial segment 290 and the lateral segment 292 extend to the terminal ends 294*a*, 294*b* adjacent to the forefoot region 12, whereby the terminal ends 294*a*, 294*b* are substantially aligned with each other across the lateral direction of the sole structure 200. Accordingly, a length $L_{MS}$ of the medial segment 290 and a length LLS of the lateral segment 292 are substantially similar, as indicated in FIG. 8C. As a result, a distance from the medial-forefoot column

252*a* to the terminal end 294*a* of the medial segment 290 may be greater than a distance from the lateral-forefoot column 252*b* to the terminal end 294*b* of the lateral segment 292 when the sole midsole 202 is assembled, as shown in FIG. 3.

Each of the segments 288, 290, 292 may be filled with a pressurized fluid (i.e., gas, liquid) to provide cushioning and stability for the foot during use of the footwear 10. In some implementations, compressibility of a first portion of the plurality of segments 288, 290, 292 under an applied load provides a responsive-type cushioning, while a second portion of the segments 288, 290, 292 may be configured to provide a soft-type cushioning under an applied load. Accordingly, the segments 288, 290, 292 of the chamber 278 may cooperate to provide gradient cushioning to the article of footwear 10 that changes as the applied load changes (i.e., the greater the load, the more the segments 288, 290, 292 are compressed and, thus, the more responsive the footwear 10 performs). In some implementations, the segments 288, 290, 292 are in fluid communication with one another to form a unitary pressure system for the chamber 278. The unitary pressure system directs fluid through the segments 288, 290, 292 when under an applied load as the segments 288, 290, 292 compress or expand to provide cushioning, stability, and support by attenuating ground-reaction forces especially during forward running movements of the footwear 10.

Referring to the cross-sectional view of FIG. 4, when the sole structure 200 is assembled, each of the foam element 206, the anterior cushioning arrangement 208, and the posterior cushioning arrangement 210 cooperate to define a profile of the ground-engaging surface 30. As used herein, the midsole 202 is referred to as defining the profile of the ground-engaging surface 30, while the outsole 204 actually forms the ground-engaging surface 30. For example, the shape of the ground-engaging surface 30 is determined by the midsole 202 and the outsole 204 is merely overmolded onto the midsole 202 to provide wear resistance and traction properties.

As shown, a first portion of the ground-engaging surface 30 is defined by the anterior segment 228 of the foam element 206 in the toe portion $\mathbf{12}_T$ of the forefoot region 12. Here, the bottom surface 218 of the foam element 206 converges towards the top surface 216 along a direction from the recess 226 to the anterior end 18 of the footwear 10. In the illustrated example, the bottom surface 218 is convex and curves towards the top surface 216 in the direction from the recess 226 to the anterior end 18. Accordingly, the anterior segment 228 of the foam element 206 provides an arcuate toe portion $\mathbf{12}_T$ of the sole structure 200.

Referring still to FIG. 4, a second portion of the ground-engaging surface 30 is defined by the anterior cushioning arrangement 208 in the ball portion $\mathbf{12}_B$ of the forefoot region 12. As discussed above, the anterior cushioning arrangement 208 includes a medial-forefoot column 252*a* and a lateral-forefoot column 252*b* arranged from the medial side 22 to the lateral side 24. The top surface 244 of the anterior cushioning arrangement 208, collectively defined by the first barrier layers 254 of the upper bladders 250, defines a proximal end of the anterior cushioning arrangement 208 that is attached to the foam element 206. Conversely, the bottom surface 246 of the anterior cushioning arrangement 208, collectively defined by the second barrier layers 256 of the lower bladders 250, defines a distal end of the anterior cushioning arrangement 208, and consequently, a profile of the ground-engaging surface 30 in the ball portion $\mathbf{12}_B$ of the forefoot region 12.

The posterior segment 230 of the foam element 206 and the posterior cushioning arrangement 210 cooperate to define the ground-engaging surface 30 in the mid-foot region 14 and the heel region 16. More particularly, the posterior cushioning arrangement 210 defines the profile of the ground-engaging surface 30 in the peripheral region 26 of the mid-foot region 14 and the heel region 16, while the posterior segment 230 of the foam element 206 defines the ground-engaging surface 30 in the interior region 28 of the mid-foot region 14 and the heel region 16.

As shown in FIG. 1, the lower surface 286 of the chamber 278 of the posterior cushioning arrangement 210 defines a substantially planar portion of the ground-engaging surface 30 in the peripheral region 26. As shown in FIG. 4, the bottom surface 218 of the foam element 206 is substantially flush with the lower surface 286 of the posterior cushioning arrangement 210 proximate to the recess 226. Accordingly, foam element 206 and the posterior cushioning arrangement 210 define substantially continuous profile of the ground-engaging surface 30 from the medial side 22 to the lateral side 24 in the mid-foot region 14 of the sole structure 200.

Referring still to FIG. 4, the thickness THE of the foam element 206 in the interior region 28 of the posterior segment 230 tapers along a direction from the recess 226 to the posterior end 20 of the sole structure 200. Particularly, the thickness THE of the foam element 206 is tapered such that the bottom surface 218 of the foam element 206 diverges from the lower surface 286 of the posterior cushioning arrangement 210 in the direction from the recess 226 to the posterior end 20. Thus, while the bottom surface 218 of the foam element 206 and the lower surface 286 of the posterior cushioning arrangement 210 are substantially flush at the recess 226, the bottom surface 218 of the foam element 206 is spaced apart from the lower surface 286 of the posterior cushioning arrangement 210 in the heel region 16. Accordingly, the posterior cushioning arrangement 210 and the foam element 206 cooperate to define a trampoline-like structure in the heel region 16 of the sole structure 200.

This configuration allows the impact forces associated with an initial heel strike to be absorbed by the trampoline structure and distributed through the posterior cushioning arrangement 210, while forces are more evenly distributed among the foam element 206 and the posterior cushioning arrangement 210 as the foot transitions through the mid-foot region 14. Within the forefoot region 12, the cushioning and performance properties of the anterior cushioning arrangement 208 are imparted to the ground-engaging surface 30. Particularly, forces associated with pushing off of the forefoot during running or jumping motions are absorbed by the anterior cushioning arrangement 208.

The sole structure 200 further includes a heel counter 296 formed of the same TPU material as the bladder 272 and extending over the posterior cushioning arrangement 210 and the upper 100. As shown, the heel counter 296 extends from a first end on the lateral side 24, around the posterior end 20, and to the second end on the medial side 22. With reference to FIG. 1, a height of the heel counter 296 increases from the mid-foot region to a vertex 298 formed in the heel region 16, and then decreases to the posterior end 20. Although not illustrated, the heel counter 296 is similarly formed along the medial side 22, such that the height of the heel counter is cupped around the posterior end 20 of the upper 100.

In the illustrated example, the outsole 204 is formed integrally with the midsole 202 of using an overmolding process. Accordingly, the outsole 204 forms the ground-engaging surface 30 having a profile substantially similar to the profile defined by the cooperation of the various components 206, 208, 210 of the midsole 202. The outsole 204 may be described has having an inner surface 299 configured to attach to the bottom surface 218 of the foam element 206, the bottom surface 246 of the anterior cushioning arrangement 208, and the lower surface 286 of the posterior cushioning arrangement 210. An outer surface 300 of the outsole 204 is formed on an opposite side from the inner surface 299 and forms the ground-engaging surface 30 of the sole structure 200. Accordingly, the outsole 204 at least partially encompasses each of the foam element 206, the anterior cushioning arrangement 208, and the posterior cushioning arrangement 210. The outsole 204 is formed of a resilient material configured to impart properties of abrasion resistance and traction to the ground-engaging surface 30 of the sole structure 200. In other examples the outsole 204 may be formed separately from the midsole 202 and adhesively bonded to midsole 202.

Referring now to FIGS. 9-16E, an article of footwear 10*a* is provided and includes an upper 100 and a sole structure 200*a* attached to the upper 100. In view of the substantial similarity in structure and function of the components associated with the article of footwear 10*a* with respect to the article of footwear 10, like reference numerals are used hereinafter and in the drawings to identify like components while like reference numerals containing letter extensions are used to identify those components that have been modified.

Figure 10:
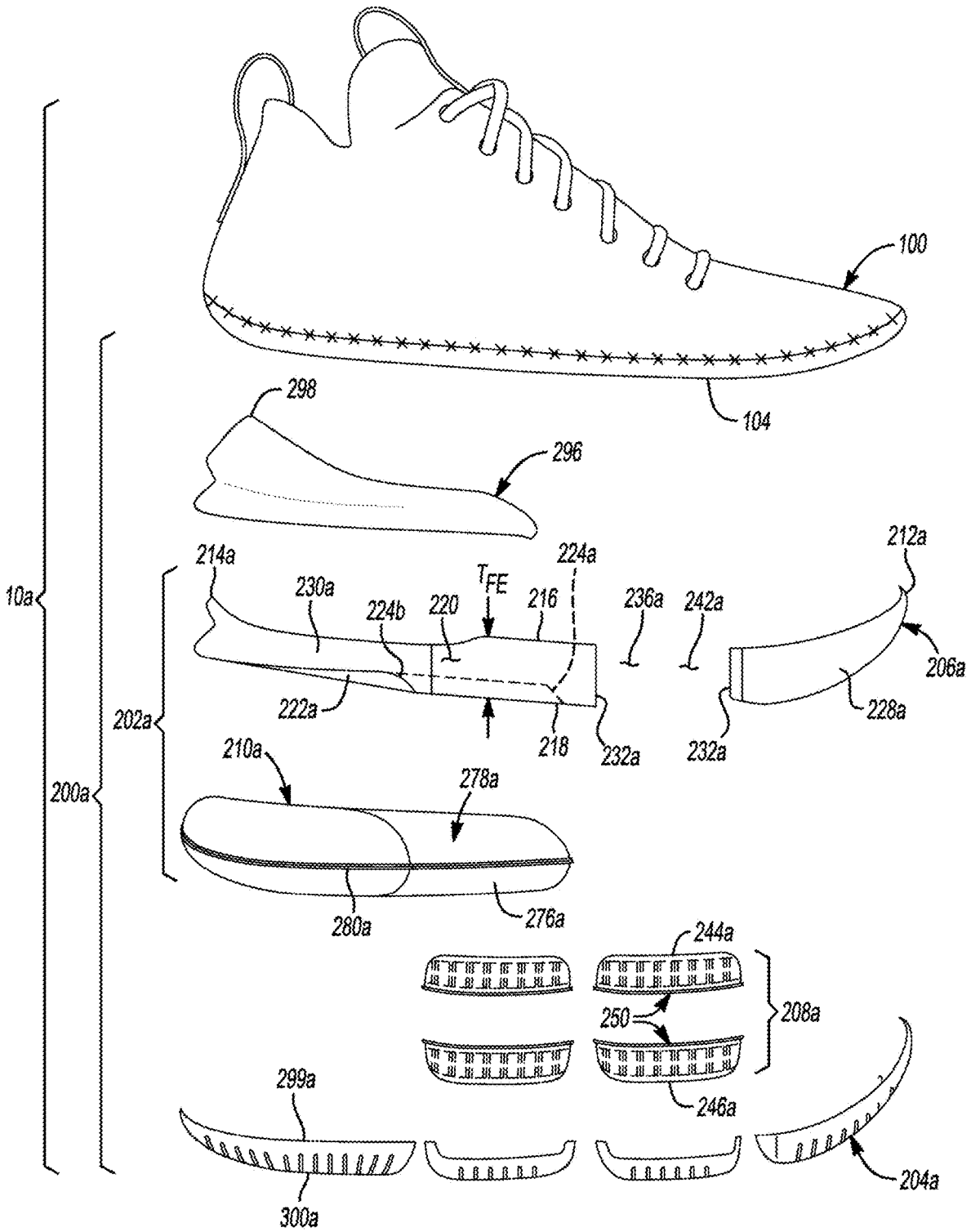
FIG. 10 is an exploded view of the article of footwear of FIG. 9, showing an article of footwear having an upper and a sole structure arranged in a layered configuration.

With reference to FIG. 10, the sole structure 200*a* includes a midsole 202*a* configured to provide cushioning characteristics to the sole structure 200*a*, and an outsole 204*a* configured to provide a ground-engaging surface 30 of the article of footwear 10*a*. Unlike conventional sole structures formed of a unitary midsole having a unitary outsole attached thereto, the midsole 202*a* is formed compositely and comprises a plurality of subcomponents for providing zonal cushioning and performance characteristics. For example, the midsole 202*a* includes a foam element 206*a*, an anterior cushioning arrangement 208*a*, and a posterior cushioning arrangement 210*a*. The subcomponents 206*a*, 208*a*, 210*a* of the midsole 202*a* are assembled and secured to each other using various methods of bonding, including adhesively bonding and melding, for example. As described in greater detail below, the outsole 204*a* is overmolded onto the subcomponents 206*a*, 208*a*, 210*a* of the midsole 202*a*, whereby the midsole 202*a* defines a profile of the ground-engaging surface 30 of the footwear 10*a*.

With reference to FIG. 10, the foam element 206*a* includes a first end 212*a* at the anterior end 18 of the footwear 10*a* and a second end 214*a* at the posterior end 20 of the footwear 10*a*. Accordingly, the foam element 206*a* extends along an entire length of the footwear 10*a*. As discussed in greater detail below, the foam element 206*a* may be fragmentary, whereby the foam element 206*a* extends discontinuously from the first end 212*a* to the second end 214*a*. The foam element 206*a* further includes a top surface 216 and a bottom surface 218 formed on an opposite side of the foam element 206*a* than the top surface 216. The top surface 216 of the foam element 206*a* is configured to oppose the strobel 104 of the upper 100, and may be contoured to define a profile of the footbed 106 corresponding to a shape of the foot. As shown in FIG. 10, a distance between the top surface 216 and the bottom surface 218 defines a thickness THE of the foam element 206*a*, which is variable along the length of the sole structure 200*a*.

The foam element 206*a* further includes a peripheral side surface 220 extending between the top surface 216 and the bottom surface 218. The peripheral side surface 220 generally defines an outer periphery of the sole structure 200*a*. As shown in FIG. 10, the peripheral side surface 220 of the foam element 206*a* is configured to cooperate with the posterior cushioning arrangement 210*a*. Particularly, the peripheral side surface 220 includes a peripheral groove 222*a* extending around the second end 214*a* of the foam element 206*a*.

Figure 12:
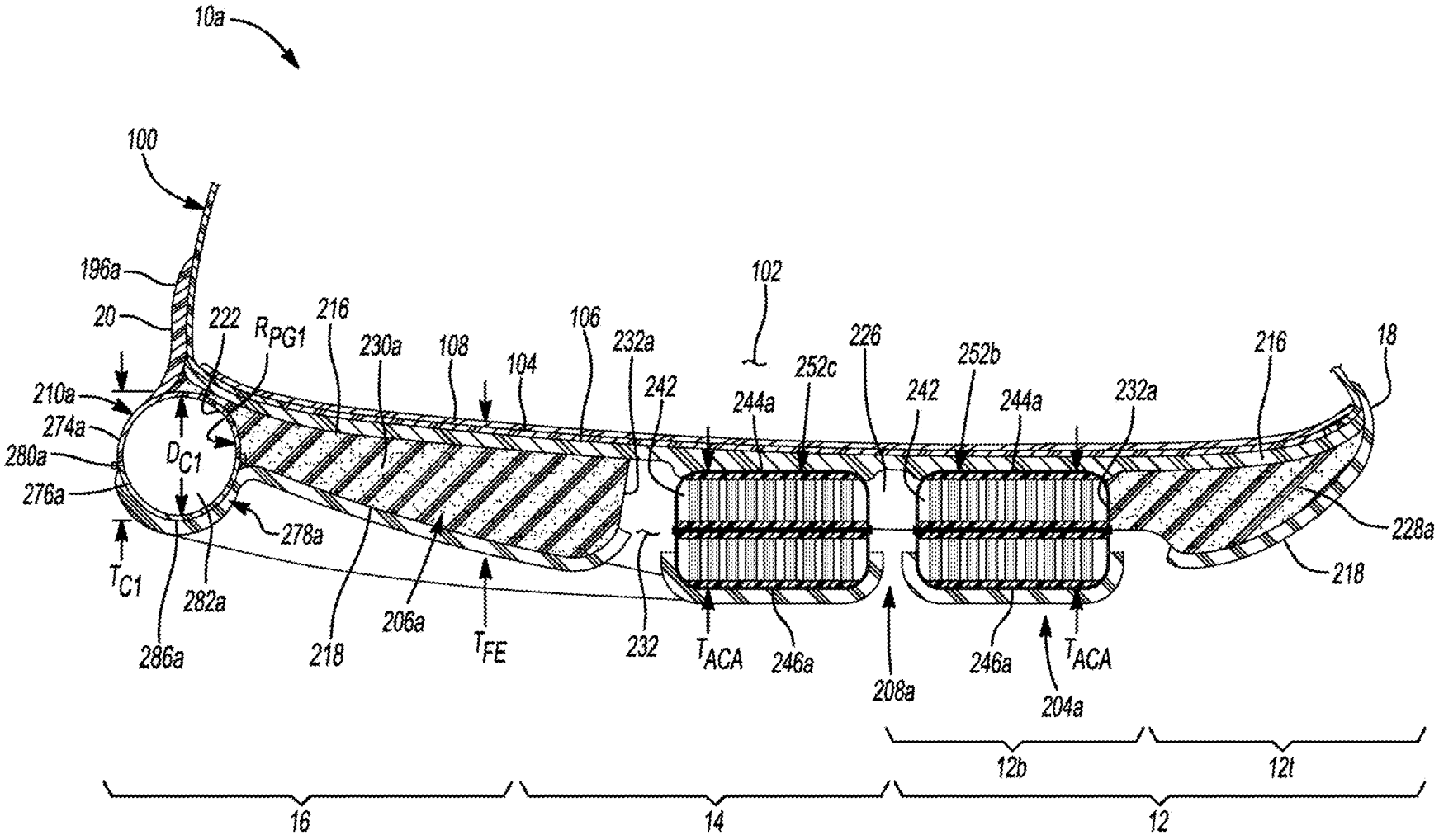
FIG. 12 is a cross-sectional view of the article of footwear of FIG. 9, taken along line 12-12 of FIG. 11 and corresponding to a longitudinal axis of the article of footwear.
Figure 13:
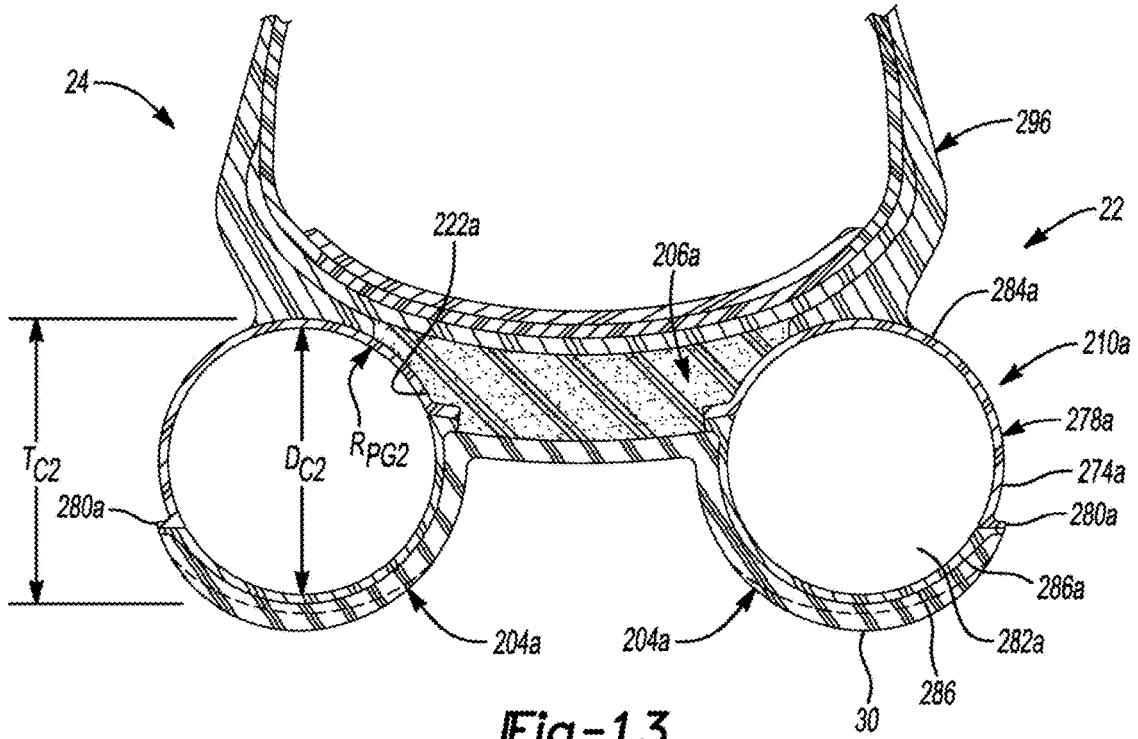
FIG. 13 is a cross-sectional view of the article of footwear of FIG. 9, taken along line 13-13 of FIG. 11.
Figure 14:
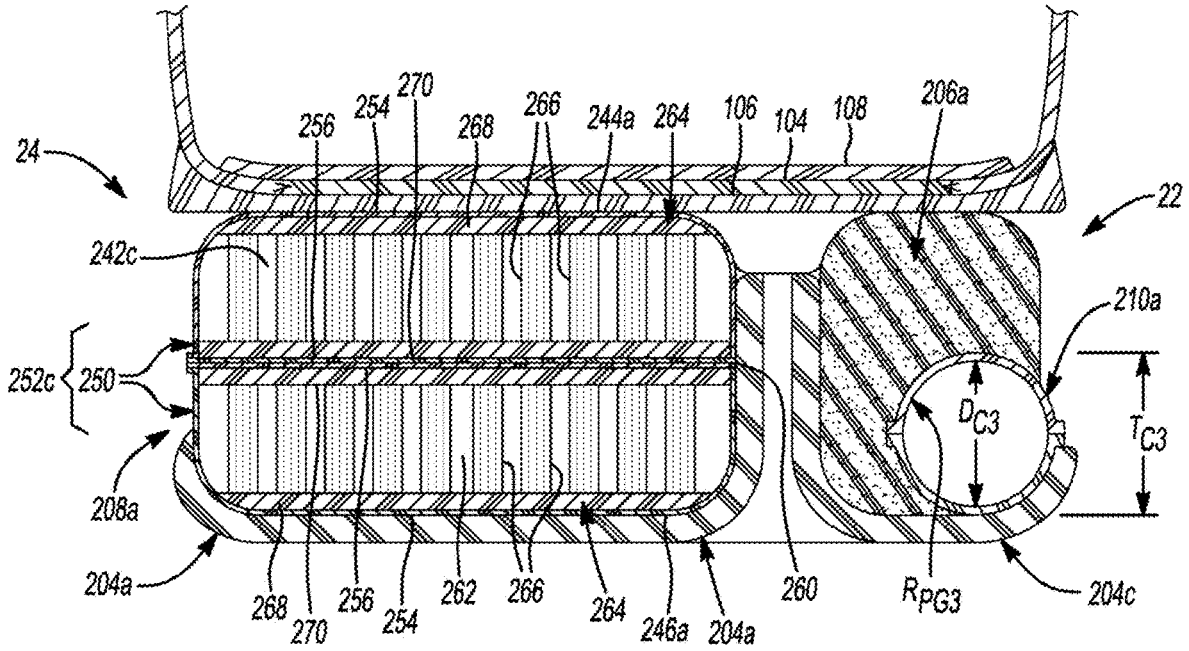
FIG. 14 is a cross-sectional view of the article of footwear of FIG. 9, taken along line 14-14 of FIG. 11.

With continued reference to FIG. 10, the peripheral groove 222*a* extends from a first end 224*a* in the forefoot region 12 on the medial side 22 and around the heel region 16 to a second end 224*b* in the mid-foot region 14 on the lateral side 24. As shown in FIGS. 12-14, a cross-sectional shape of the peripheral groove 222*a* is concave and corresponds to an outer circumference of the posterior cushioning arrangement 210*a*. Although the peripheral groove 222*a* is continuously concave along its length, a radius RPG of the peripheral groove 222*a* is variable and is configured to accommodate the tapered thicknesses $T_C$ of the posterior cushioning arrangement 210*a*, as discussed below. For example, as shown in FIG. 12, the peripheral groove 222*a* has first radius $R_{PG1}$ in the heel region 12 corresponding to a first thickness $T_{C1}$ or diameter of the posterior cushioning arrangement 210*a* at the posterior end 20. Similarly, as shown in FIGS. 13 and 14, the radius of the peripheral groove 222*a* progressively decreases from the first radius $R_{PG1}$ at the posterior end 20, though a second radius $R_{PG2}$ in the heel region 16, and to a third radius $R_{PG3}$ in the forefoot region 12 to accommodate a corresponding taper in the thickness $T_C$ of the posterior cushioning arrangement 210*a*. Particularly, the first radius $R_{PG1}$ and a first thickness $T_{C1}$ are greater than the respective second radius $R_{PG2}$ and second thickness $T_{C2}$, while the second radius $R_{PG2}$ and second thickness $T_{C2}$ are greater than the third radius $R_{PG3}$ and a corresponding third thickness $T_{C3}$. When the sole structure 200*a* is assembled, the peripheral groove 222*a* receives an inner peripheral portion of the posterior cushioning arrangement 210*a*.

The foam element 206*a* includes a recess 226*a* configured to receive the anterior cushioning arrangement 208*a* therein. As shown in FIG. 10, the recess 226*a* is formed in the forefoot region 12 and the mid-foot region 14 of the sole structure 200*a* and is defined by a peripheral sidewall 232*a* extending from the bottom surface 218 of the foam element 206*a* towards the top surface 216. Generally, the recess 226*a* separates the foam element 206*a* into an anterior segment 228*a* and a posterior segment 230*a*. The anterior segment 228*a* extends between the recess 226*a* and the anterior end 18 of the sole structure 200*a*, while the posterior segment 230*a* extends between the recess 226*a* and the posterior end 20 of the sole structure 200*a*.

In the illustrated example, the sidewall 232*a* extends continuously from the bottom surface 218 to the top surface 216. Accordingly, the recess 226*a* extends entirely through the thickness THE of the foam element 206*a*. Here, the anterior segment 228*a* and the posterior segment 230*a* of the foam element 206*a* are separated from each other by the recess 226*a*. Accordingly, the foam element 206*a* may be formed as a fragmentary structure having the anterior segment 228*a* disposed between the recess 226*a* and the anterior end 18 of the sole structure 200*a*, and the posterior segment 230*a* disposed between the recess 226*a* and the posterior end 20.

Figure 9:
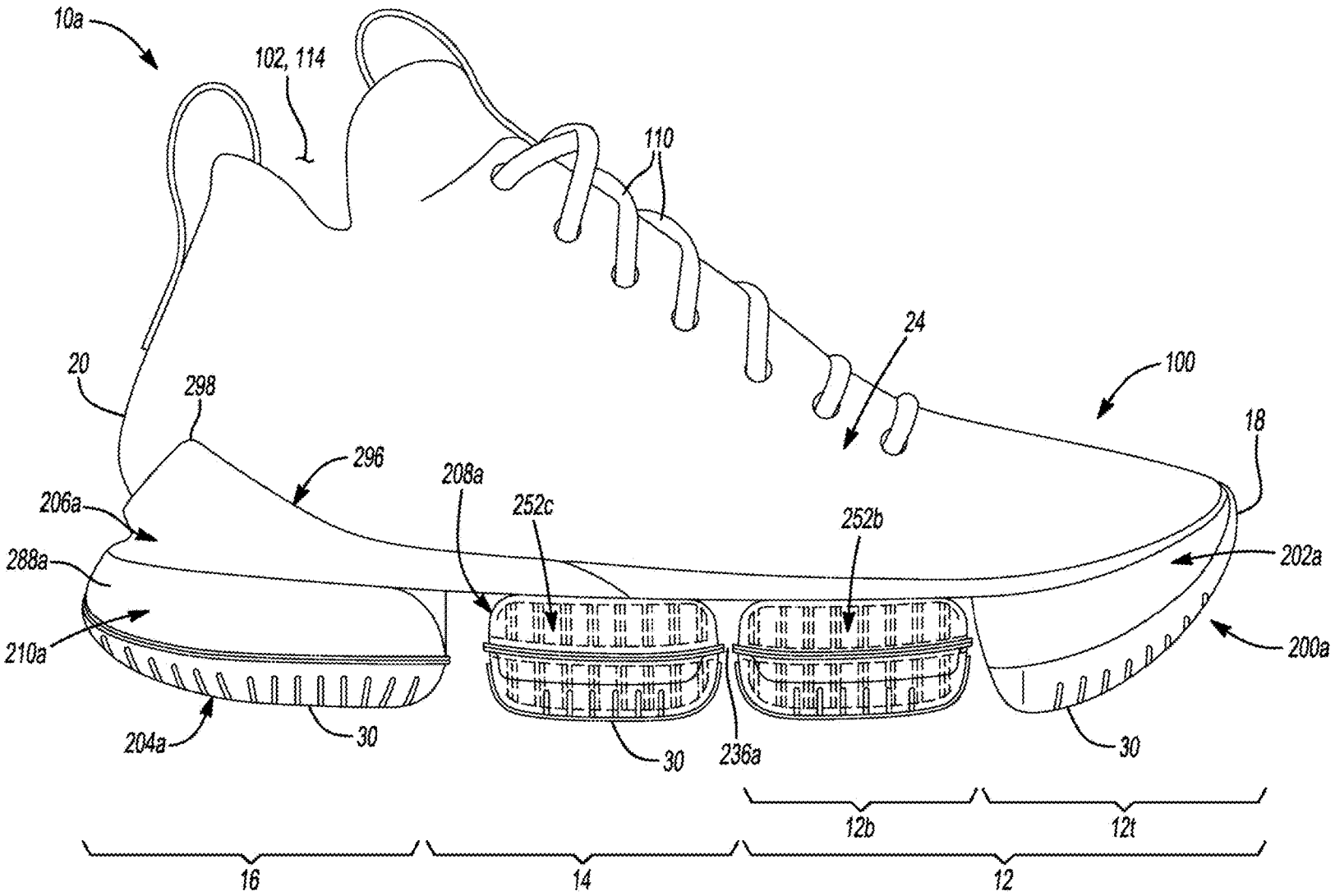
FIG. 9 is a side elevation view of an article of footwear in accordance with principles of the present disclosure.

In some examples, the sidewall 232*a* of the recess 226*a* intersects with the peripheral side surface 220 of the foam element 206*a* to define an opening 236*a* through the peripheral side surface 220 into the recess 226*a*. As shown in FIG. 9, the peripheral sidewall 232*a* may fully intersect the peripheral side surface 220 of the foam element 206*a*, whereby the opening 236*a* extends from the bottom surface 218 to the top surface 216 to fully expose the recess 226*a* through the peripheral side surface 220. Accordingly, the peripheral sidewall 232*a* may only partially surround the recess 226*a*.

In some examples, the recess 226*a* may include one or more receptacles 242*a* configured to receive the anterior cushioning arrangement 208*a*. For example, where the anterior cushioning arrangement 208*a* is formed of a fragmentary structure, separate portions of the anterior cushioning arrangement 208*a* may be received by the receptacles 242*a*-242*c*. In the illustrated example, a profile of each of the receptacles 242*a*-242*c* is defined by the peripheral sidewall 232*a* of the recess 226*a* and corresponds to an outer peripheral profile of the anterior cushioning arrangement 208*a*. Here, the peripheral sidewall 232*a* is spaced apart from the anterior cushioning arrangement 208*a* and defines three receptacles 242*a*-242*c*, including a medial-forefoot receptacle 242*a*, a lateral-forefoot receptacle 242*b*, and a lateral-midfoot receptacle 242*c*, each configured to receive a respective portion of the anterior cushioning arrangement 208*a*.

Referring to FIG. 10, the anterior cushioning arrangement 208*a* is configured to be disposed within the recess 226*a* of the foam element 206*a*, in the forefoot region 12 and the mid-foot region 14 of the sole structure 200*a*. The anterior cushioning arrangement 208*a* includes a top surface 244*a* and a bottom surface 246*a* formed on an opposite side of the anterior cushioning arrangement 208*a* from the top surface 244*a*, whereby a distance between the top surface 244*a* and the bottom surface 246*a* defines a thickness $T_{ACA}$ of the anterior cushioning arrangement 208*a*, as shown in FIG. 12. When assembled within the sole structure 200*a*, the top surface 244*a* faces the upper 100 while the bottom surface 246*a* faces away from the upper 100. Accordingly, the top surface 244*a* may be referred to as a proximal end of the anterior cushioning arrangement 208*a*, while the bottom surface 246*a* may be referred to as a distal end of the anterior cushioning arrangement 208*a*. An outer peripheral surface 248*a* extends between the top surface 244*a* and the bottom surface 246*a* and defines an outer peripheral profile of the anterior cushioning arrangement 208*a*.

In the illustrated example, the anterior cushioning arrangement 208*a* is formed as a fragmentary structure and includes a plurality of bladders 250 arranged to provide cushioning in the forefoot region 12 of the sole structure 200*a*. Here, the bladders 250 are arranged in discrete columns 252*a*, 252*b*, 252*c* to provide localized cushioning characteristics to the sole structure 200*a*. Each of the columns 252*a*, 252*b*, 252*c* comprises a pair of the bladders 250 stacked vertically, whereby a first bladder 250 is a proximal or upper bladder 250 and extends from the top surface 244*a* of the anterior cushioning arrangement 208*a*, and a second bladder 250 is a distal or lower bladder 250 and extends between the upper bladder 250 and the bottom surface 246*a* of the anterior cushioning arrangement 208*a*.

Figure 11:
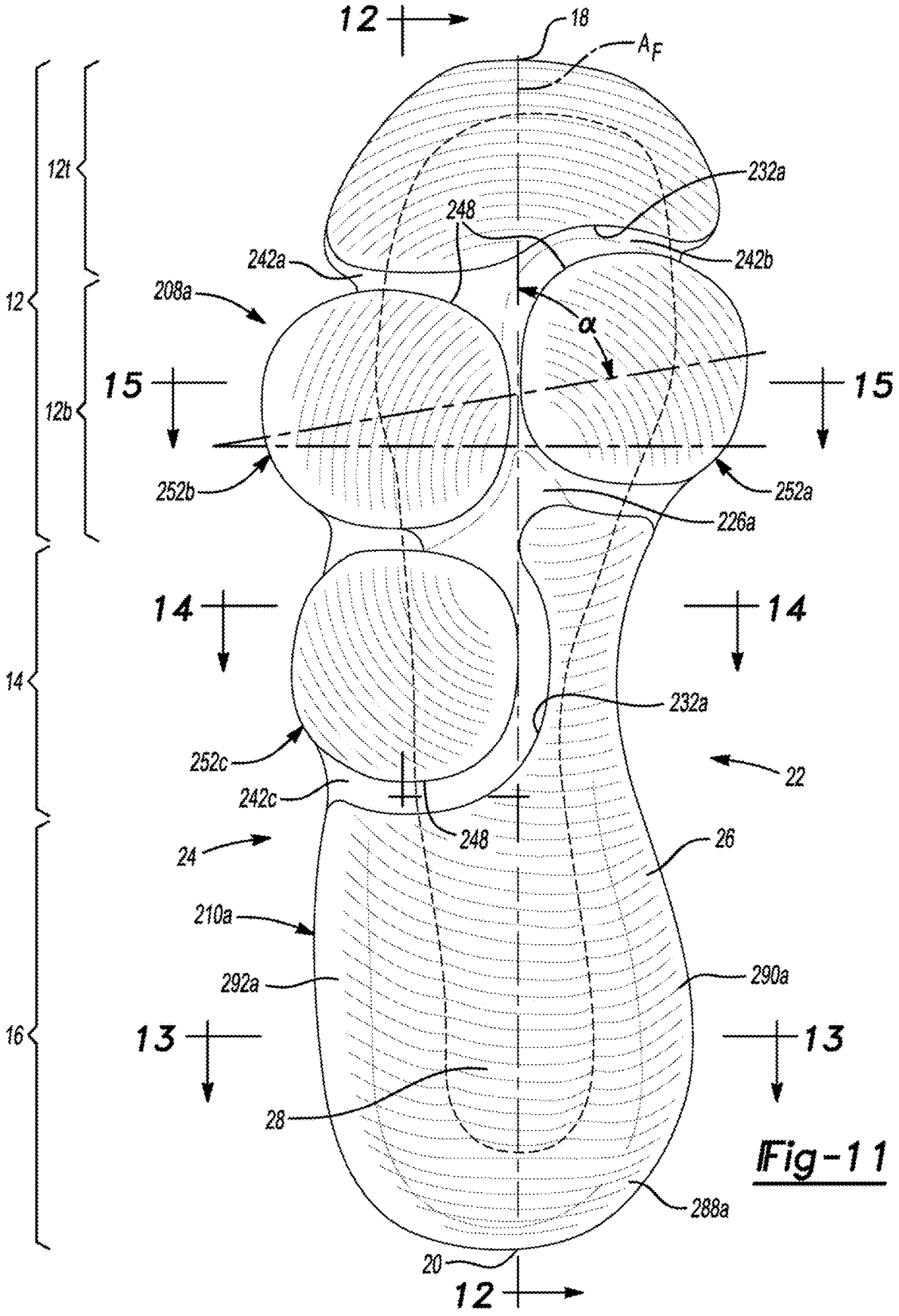
FIG. 11 is bottom perspective view of the article of footwear of FIG. 9.

As shown in FIG. 11, the anterior cushioning arrangement 208*a* includes the medial-forefoot column 252*a* and the lateral-forefoot column 252*b*, which may be collectively referred to as the forefoot columns 252*a*, 252*b*. The medial-forefoot column 252*a* is disposed within the medial-forefoot receptacle 242*a*, proximate to the peripheral side surface 220 of the foam element 206*a* on the medial side 22 of the sole structure 200*a* in the forefoot region 12. The lateral-forefoot column 252*b* is disposed within the lateral-forefoot receptacle 242*b* proximate to the peripheral side surface 220 of the foam element 206*a* on the lateral side 24 of the sole structure 200*a* in the forefoot region 12.

The medial-forefoot column 252*a* and the lateral-forefoot column 252*b* are generally aligned with each other along a direction from the medial side 22 to the lateral side 24 of the sole structure 200*a*, whereby the forefoot columns 252*a*, 252*b* are adjacent to each other and cooperate to form a portion of the midsole 202*a* extending from the medial side 22 to the lateral side 24 in the ball portion $\mathbf{12}_B$ of the of the forefoot region 12. As shown in FIG. 11, a longitudinal position of the forefoot columns 252*a*, 252*b* corresponds to the location of the metatarsophalangeal (MTP) joints of the foot. Accordingly, the forefoot columns 252*a*, 252*b* may not be aligned with each other along the lateral direction of the sole structure 200*a*, but are instead aligned at an oblique angle relative to the longitudinal axis $A_F$ of the sole structure 200*a*, where the medial-forefoot column 252*a* is offset closer to the anterior end 18 of the sole structure than the lateral-forefoot column 252*b*.

The anterior cushioning arrangement 208*a* may further include a lateral-midfoot column 252*c* disposed proximate to the peripheral side surface 220 of the foam element 206*a* on the lateral side of the sole structure 200*a* in the mid-foot region 12. Particularly, the lateral-midfoot column 252*c* is disposed within the lateral-midfoot receptacle 242*c* adjacent to the lateral-forefoot column 252*b* along the peripheral side surface 220 of the sole structure 200*a*. As shown in FIG. 11, the lateral-forefoot column 252*b* and the lateral-midfoot column 252*c* are substantially aligned with each other along the peripheral region 26 and cooperate to define a portion of the sole structure 200*a* along the lateral side 24 in the forefoot region 12 and the mid-foot region 14.

As discussed above, the recess 226*a* includes a plurality of receptacles 242*a*, 242*c*, 242*b* configured to receive the components of the anterior cushioning arrangement 208*a*. For example, in the illustrated example, the medial-forefoot receptacle 242*a* receives the medial-forefoot column 252*a* and the lateral-forefoot receptacle 242*b* receives the lateral-forefoot column 252*b*. Likewise, the recess 226*a* includes the lateral-midfoot receptacle 242*c* for receiving the lateral-midfoot column 252*c*. In the illustrated example, the receptacles 242*a* are formed by portions of the peripheral sidewall 232*a* that are spaced apart from and complement the outer peripheral surface 248*a* of the anterior cushioning arrangement 208*a*. As shown, the receptacles 242*a*-242*c* are generally in communication with each other to define a substantially continuous recess 226*a*. In some examples, the receptacles 242*a*-242*c*

The bladders 250 of the anterior cushioning arrangement 208*a* are constructed in a similar manner. For example, each of the bladders 250 includes a first barrier layer 254 and a second, barrier layer 256, which can be joined to each other at discrete locations to define a chamber 258 and a peripheral seam 260.

In some implementations, the first barrier layer 254 and the second barrier layer 256 cooperate to define a geometry (e.g., thicknesses, width, and lengths) of the chamber 258. For example, the peripheral seam 260 bounds the chamber 258 to seal the fluid (e.g., air) within the chamber 258. Thus, the chamber 258 is associated with an area of the bladder 250 where interior surfaces of the first barrier layer 254 and the second barrier layer 256 are not joined together and, thus, are separated from one another. In the illustrated example, an outer peripheral profile of the chamber 258 has a cross-sectional shape corresponding to a rounded square.

Figure 15:
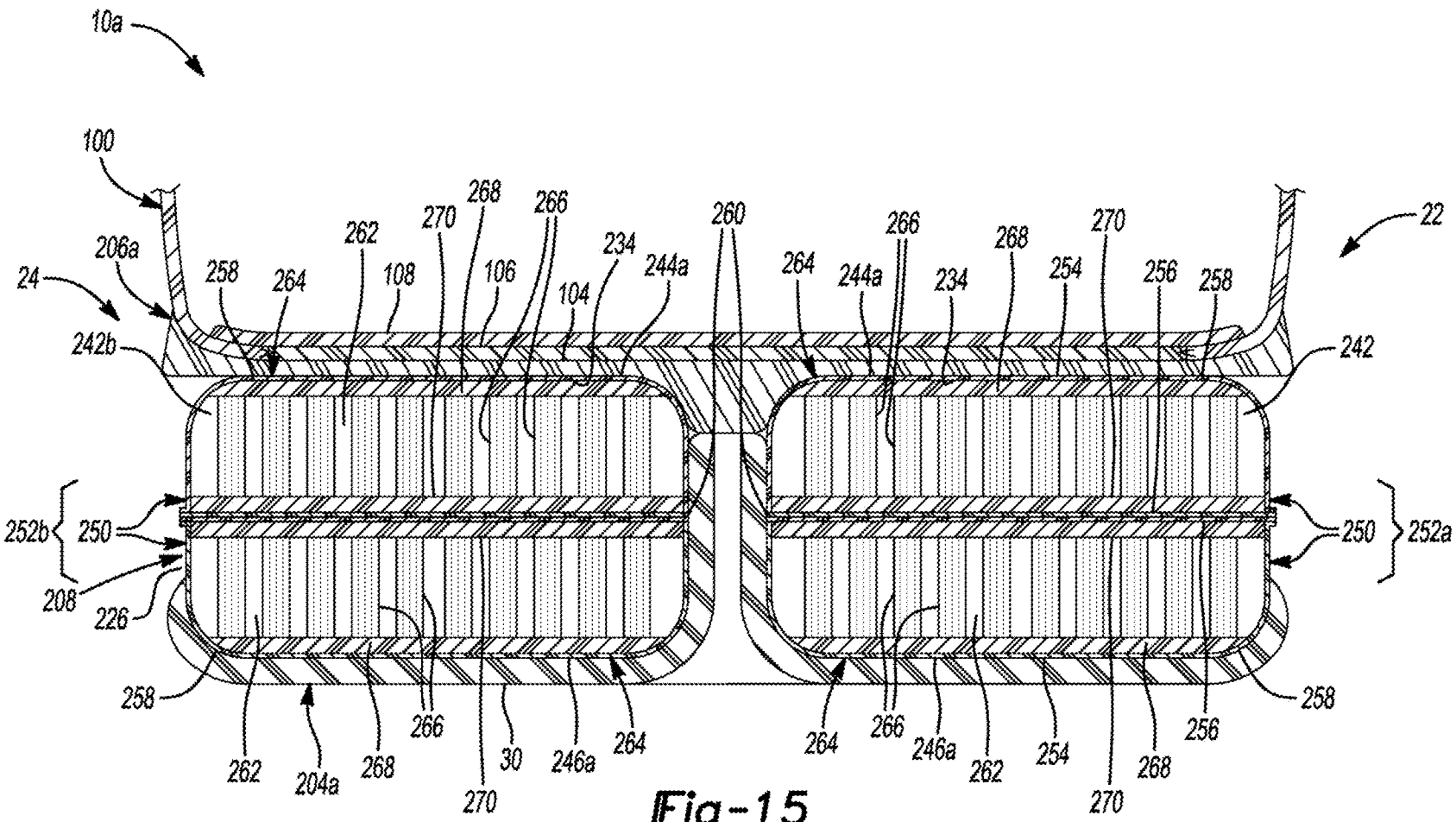
FIG. 15 is a cross-sectional view of the article of footwear of FIG. 9, taken along line 15-15 of FIG. 11.

In the illustrated example, the first barrier layer 254 is cup-shaped and defines a height of the bladder 250, while the second barrier layer 256 is planar and defines a cover of the bladder 250. As best shown in FIGS. 14 and 15, the substantially planar second barrier layer 256 of the upper bladder 250 of each column 252*a*-252*c* opposes the substantially planar second barrier layer 256 of the lower bladder 250, whereby the bladders 250 are in a face-to-face arrangement and form columns 252*a*-252*c* having substantially continuous structures.

As shown in the figures, a space formed between opposing interior surfaces of the first barrier layer 254 and the second barrier layer 256 defines an interior void 262 of the chamber 258. The interior void 262 of the chamber 258 may receive a tensile element 264 therein. Each tensile element 264 may include a series of tensile strands 266 extending between a first tensile sheet 268 and a second tensile sheet 270. The first tensile sheet 268 may be attached to the first barrier layer 254 while the second tensile sheet 270 may be attached to the second barrier layer 256. In this manner, when the chamber 258 receives the pressurized fluid, the tensile strands 266 of the tensile element 264 are placed in tension. Because the first tensile sheet 268 is attached to the first barrier layer 254 and the second tensile sheet 270 is attached to the second barrier layer 256, the tensile strands 266 retain a desired shape of the bladder 250 when the pressurized fluid is injected into the interior void 262. For example, in the illustrated implementations, the tensile element 264 maintains substantially planar upper and lower barrier layers 254, 256, thereby allowing the bladders 250 to be stacked atop one another. Furthermore, by maintaining substantially planar upper and lower barrier layers 254, 256, the top and bottom surfaces 244*a*, 246*a* of the anterior cushioning arrangement 208*a*, which are collectively defined by the barrier layers 254, 256, are also substantially planar.

In some examples, the interior void 262 is at a pressure ranging from 15 psi (pounds per square inch) to 25 psi. In other examples, the interior void 262 may have a pressure ranging from 20 psi to 25 psi. In some examples, the interior void 262 has a pressure of 20 psi. In other examples, the interior void 262 has a pressure of 25 psi. As provided above, where a plurality of bladders 250 form the anterior cushioning arrangement 208*a*, the interior voids 262 of each of the bladders 250 may be pressurized differently from each other.

With reference to FIG. 10, the posterior cushioning arrangement 210*a* of the midsole 202*a* is a bladder 272*a* having an opposing pair of barrier layers 274*a*, 276*a*, which can be joined to each other at discrete locations to define an elongate chamber 278*a* and a peripheral seam 280*a*. In the shown example, the barrier layers 274*a*, 276*a* include a first, upper barrier layer 274*a* and a second, lower barrier layer 276*a*. Alternatively, chamber 278*a* can be produced from any suitable combination of one or more barrier layers.

In some implementations, the upper barrier layer 274*a* and the lower barrier layer 276*a* cooperate to define a geometry (e.g., thicknesses, width, and lengths) of the chamber 278*a*. The peripheral seam 280*a* may bound and extend around the chamber 278*a* to seal the fluid (e.g., air) within the chamber 278*a*. Thus, the chamber 278*a* is associated with an area of the posterior cushioning arrangement 210*a* where interior surfaces of the upper and lower barrier layers 274*a*, 276*a* are not joined together and, thus, are separated from one another.

As best shown in FIG. 13, a space formed between opposing interior surfaces of the upper and lower barrier layers 274*a*, 276*a* defines an interior void 282*a* of the chamber 278*a*. Unlike the interior voids 262 of the bladders 250 of the anterior cushioning arrangement 208*a*, which include tensile elements 264 disposed therein for maintaining a desire shape of the bladders 250, the interior void 282*a* of the bladders 272*a* of the posterior cushioning arrangement 210*a* is devoid of additional structure. Accordingly, a shape of the chamber 278*a* is entirely dependent on a shape of the upper and lower barrier layers 274*a*, 276*a*. More specifically, the shape of the chamber 278*a* is dependent on the shape of the upper and lower barrier layers 274*a*, 276*a* when the interior void 282*a* is pressurized with a fluid, as discussed below.

In the illustrated example, the interior void 282*a* has a circular cross-sectional shape and defines an inside diameter De of the chamber 278*a*. As discussed in greater detail below, the inside diameter De of the chamber 278*a* may taper continuously from a first inside diameter $D_{C1}$ at the posterior end, and through a second inside diameter $D_{C2}$ in the heel region 16 to a third inside diameter $D_{C3}$ in the mid-foot region 14, as shown in FIGS. 13 and 14. Similarly, exterior surfaces of the upper and lower barrier layers 274*a*, 276*a* define an exterior profile of the chamber 278*a*, which has a circular cross-sectional shape corresponding to the inside diameter DC of the interior void 282*a*. Accordingly, the upper and lower barrier layers 274*a*, 276*a* define respective upper and lower surfaces 284*a*, 286*a* of the chamber 278*a*, which converge with each other in a direction from the posterior end 20 to the forefoot region 12 to define a tapering thickness $T_C$ of the chamber 278*a*.

Figure 16A:
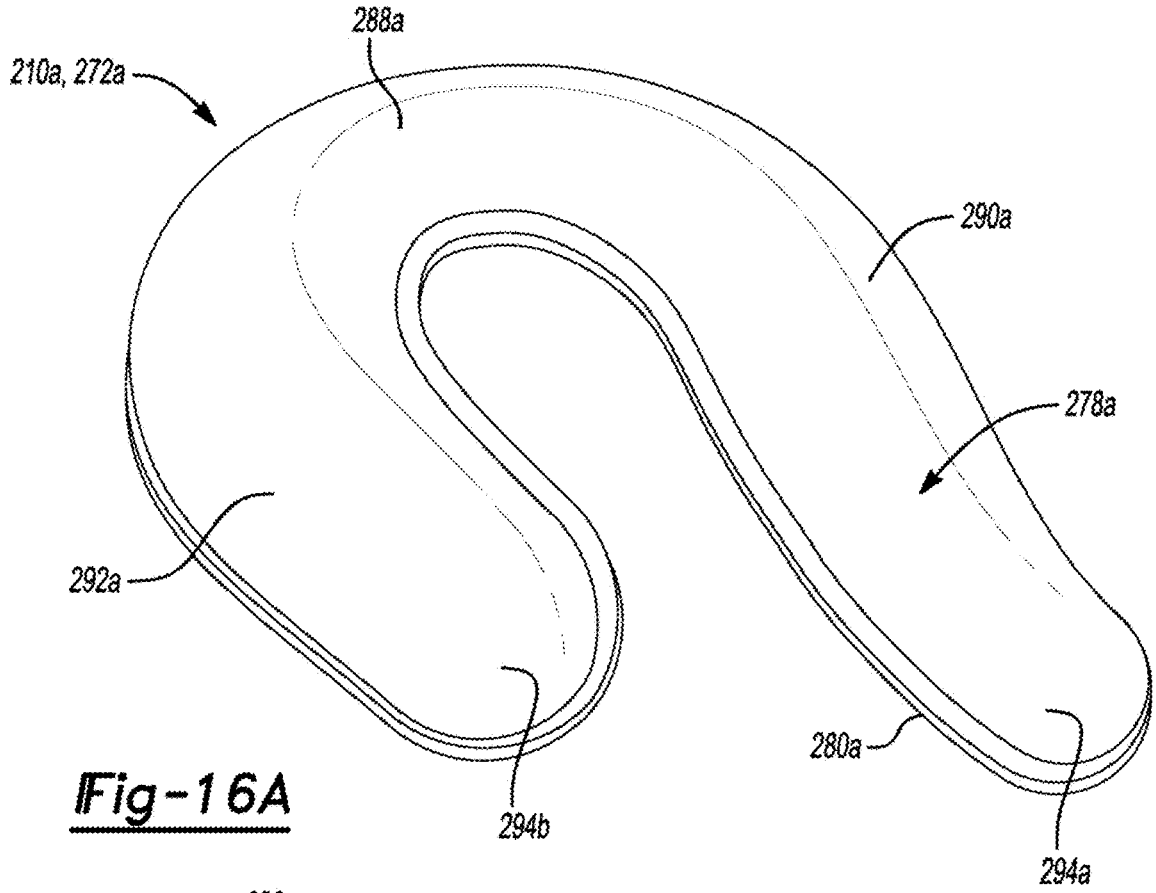
FIGS. 16A and 16B are top and bottom perspective views of a bladder of the article of footwear of FIG. 9.
Figure 16B:
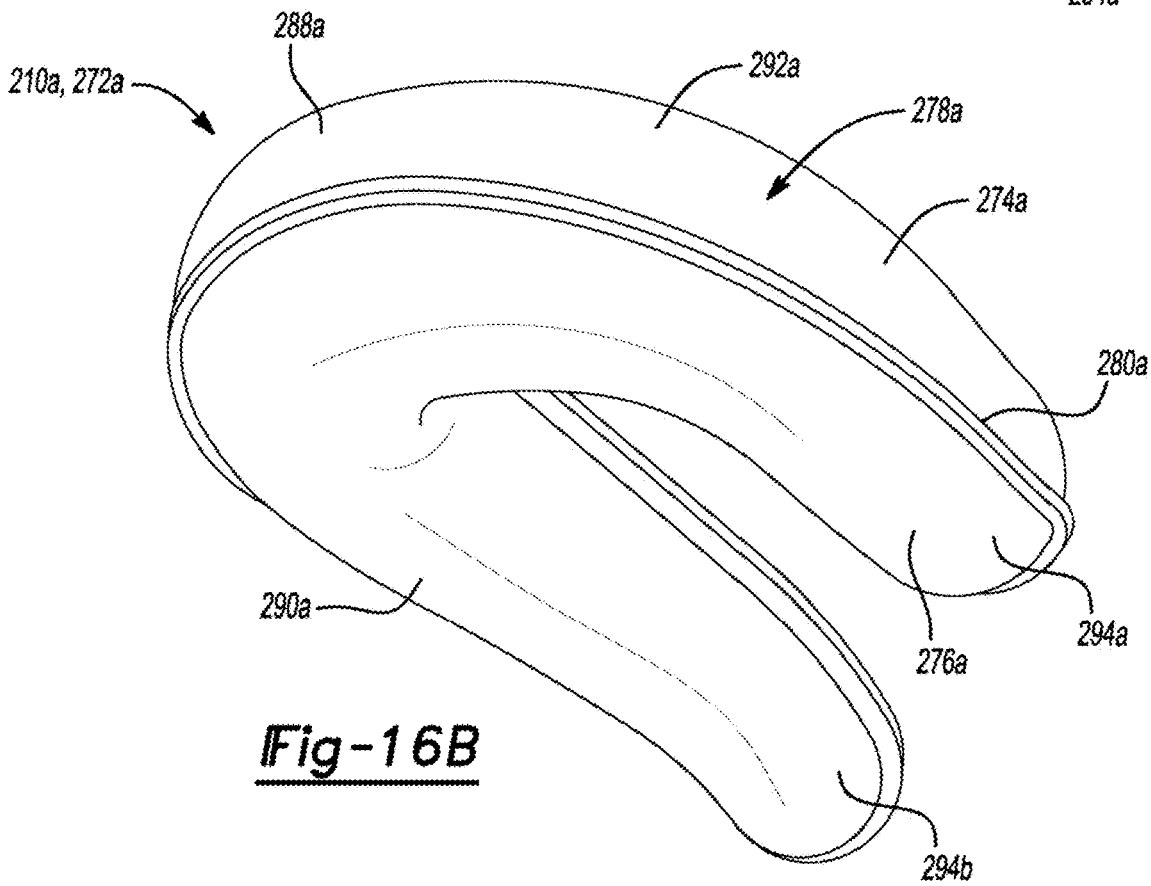
Figure 16C:
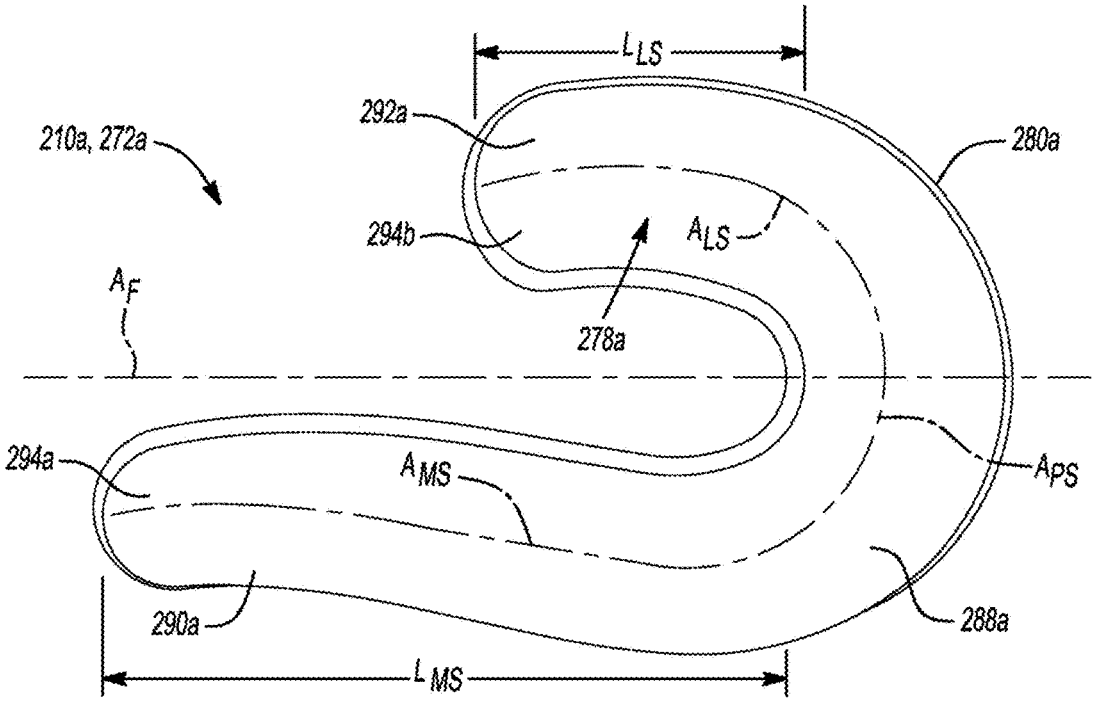
FIG. 16C is a top plan view of the bladder of FIGS. 16A and 16B.
Figure 16D:
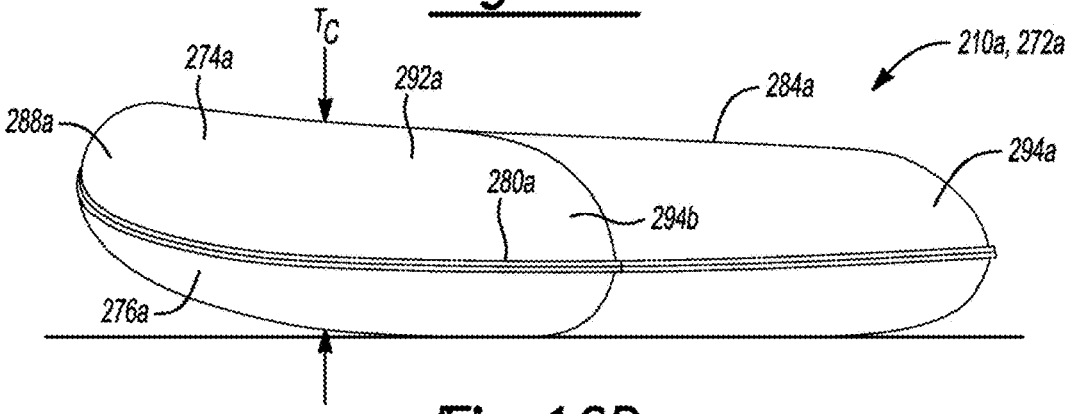
FIGS. 16D and 16E are medial and lateral side elevation views of the bladder of FIGS. 16A and 16B.
Figure 16E:
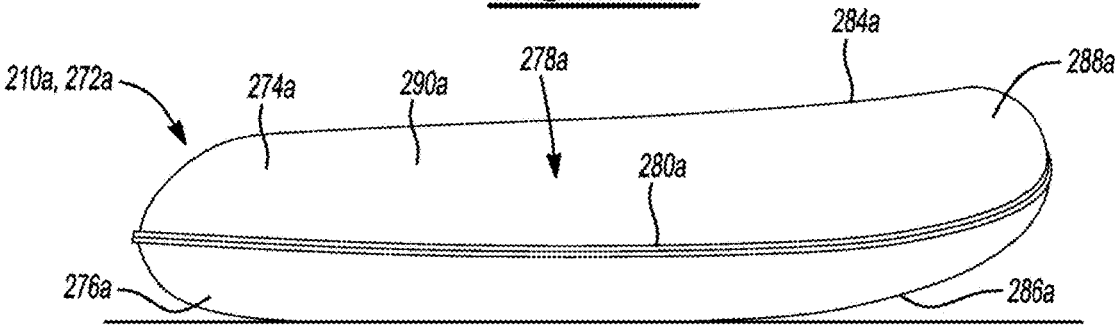
Figure 17:
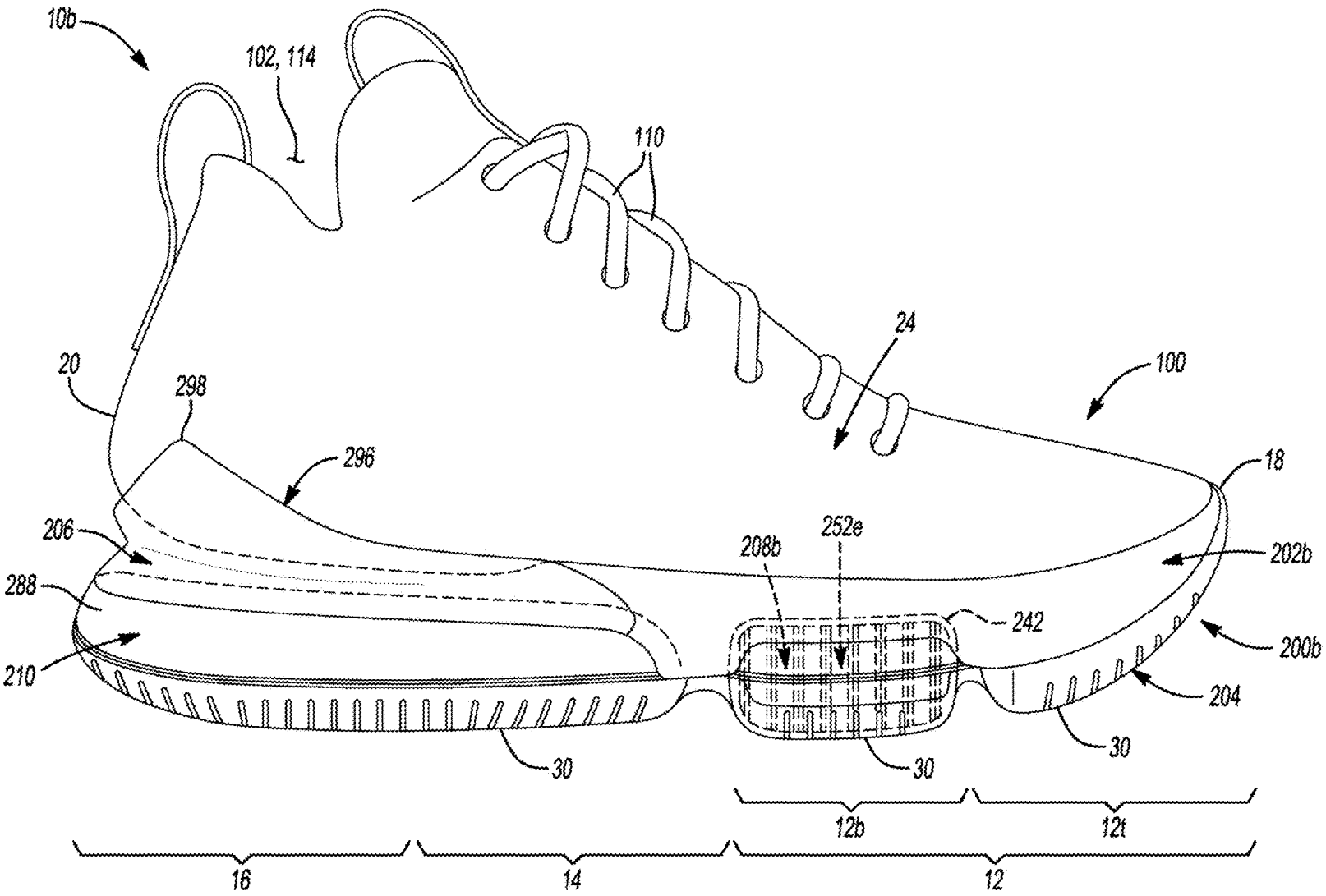
FIG. 17 is a side elevation view of an article of footwear in accordance with principles of the present disclosure.

With reference to FIG. 16C, the chamber 278*a* may be described as including an arcuate posterior segment 288*a*, an elongate medial segment 290*a*, and an elongate lateral segment 292*a*, all fluidly coupled to each other. Generally, the posterior segment 288*a* is configured to wrap around the posterior end 20 of the sole structure 200*a*, while the medial segment 290*a* and the lateral segment 292*a* extend from opposing ends of the posterior segment 288*a* to respective terminal ends 294*a*, 294*b* of the chamber 278*a*. The terminal ends 294*a*, 294*b* of the chamber 278*a* are substantially hemispherical in shape, whereby the upper and lower barrier layers 274*a*, 276*a* have a constant radius of curvature.

Referring to FIG. 16C, the posterior segment 288*a* is configured to extend around the posterior end 20 of the heel region 16 and fluidly couples to the medial segment 290*a* and the lateral segment 292*a*. More specifically, the posterior segment 288*a* extends along a substantially arcuate path or axis $A_{PS}$ to connect a posterior end of the medial segment 290*a* to a posterior end of the lateral segment 292*a*. Furthermore, the posterior segment 288*a* is continuously formed with the medial segment 290*a* and the lateral segment 292*a*. As shown in FIG. 9, the posterior segment 288*a* protrudes beyond the posterior end 20 of the upper 100, such that the upper 100 is offset towards the anterior end 18 from the rear-most portion of the posterior segment 288*a*.

The medial segment 290*a* and the lateral segment 292*a* are continuously formed along each of the medial side 22 and the lateral side 24, and extend from the posterior segment 288*a* to respective terminal ends 294*a*. The medial segment 290*a* and the lateral segment 292*a* may be described as extending along respective arcuate paths or axes $A_{MS}$, $A_{LS}$. For instance, respective arcuate axes $A_{MS}$, $A_{LS}$ of the medial segment 290*a* and the lateral segment 292*a* converge with the longitudinal axis $A_F$ of the footwear 10*a* from posterior segment 288*a* to the mid-foot region 14, and then diverge from each other through the mid-foot region to the terminal ends 294*a*, 294*b*. Accordingly, the chamber 278*a* may generally define a hairpin shape.

As shown, when assembled into the sole structure 200*a*, each of the medial segment 290*a* and the lateral segment 292*a* extend to the terminal ends 294*a*, 294*b* adjacent to the recess 226*a* along the respective medial and lateral sides 22, 24. Accordingly, the medial segment 290*a* extends along the medial side 22 from the posterior segment 288*a* to the terminal end 294*a* in the forefoot region 12, while the lateral segment 292*a* extends along the lateral side 24 from the posterior segment 288*a* to the terminal end 294*a* in the heel region 16. Accordingly, a length Lys of the medial segment 290*a* is greater than the length LLS of the lateral segment 292*a*, as indicated in FIG. 16C.

Each of the segments 288*a*, 290*a*, 292*a* may be filled with a pressurized fluid (i.e., gas, liquid) to provide cushioning and stability for the foot during use of the footwear 10*a*. In some implementations, compressibility of a first portion of the plurality of segments 288*a*, 290*a*, 292*a* under an applied load provides a responsive-type cushioning, while a second portion of the segments 288*a*, 290*a*, 292*a* may be configured to provide a soft-type cushioning under an applied load. Accordingly, the segments 288*a*, 290*a*, 292*a* of the chamber 278*a* may cooperate to provide gradient cushioning to the article of footwear 10*a* that changes as the applied load changes (i.e., the greater the load, the more the segments 288*a*, 290*a*, 292*a* are compressed and, thus, the more responsive the footwear 10*a* performs). In some implementations, the segments 288*a*, 290*a*, 292*a* are in fluid communication with one another to form a unitary pressure system for the chamber 278*a*. The unitary pressure system directs fluid through the segments 288*a*, 290*a*, 292*a* when under an applied load as the segments 288*a*, 290*a*, 292*a* compress or expand to provide cushioning, stability, and support by attenuating ground-reaction forces especially during forward running movements of the footwear 10*a*.

Referring to the cross-sectional view of FIG. 12, when the sole structure 200*a* is assembled, each of the foam element 206*a*, the anterior cushioning arrangement 208*a*, and the posterior cushioning arrangement 210*a* cooperate to define a profile of the ground-engaging surface 30. As used herein, the midsole is referred to as defining the profile of the ground-engaging surface 30, while the outsole 204*a* actually forms the ground-engaging surface 30. For example, the shape of the ground-engaging surface 30 is determined by the midsole 202*a* and the outsole 204*a* is merely overmolded onto the midsole 202*a* to provide wear resistance and traction properties.

As shown, a first portion of the ground-engaging surface 30 is defined by the anterior segment 228*a* of the foam element 206*a* in the toe portion $\mathbf{12}_T$ of the forefoot region 12. Here, the bottom surface 218 of the foam element 206*a* converges towards the top surface 216 along a direction from the recess 226*a* to the anterior end 18 of the footwear 10*a*. In the illustrated example, the bottom surface 218 is convex and curves towards the top surface 216 in the direction from the recess 226*a* to the anterior end 18. Accordingly, the anterior segment 228*a* of the foam element 206*a* provides an arcuate toe portion $\mathbf{12}_T$ of the sole structure 200*a*.

Referring still to FIG. 12, a second portion of the ground-engaging surface 30 is defined by the anterior cushioning arrangement 208*a* across the ball portion $\mathbf{12}_B$ of the forefoot region 12 and along the lateral side 24 of the mid-foot region 14. As discussed above, the anterior cushioning arrangement 208*a* includes a medial-forefoot column 252*a* and a lateral-forefoot column 252*b* arranged from the medial side 22 to the lateral side 24. The anterior cushioning arrangement 208*a* further includes the lateral-midfoot column 252*c* arranged adjacent to the lateral side 24 of the sole structure 200*a* in the mid-foot region 14. The top surface 244*a* of the anterior cushioning arrangement 208*a*, collectively defined by the first barrier layers 254 of the upper bladders 250, defines a proximal end of the anterior cushioning arrangement 208*a* that is attached to the strobel 104 or an intermediate attachment member (e.g. a plate or secondary cushioning element) (not shown). Conversely, the bottom surface 246*a* of the anterior cushioning arrangement 208*a*, collectively defined by the second barrier layers 256 of the lower bladders 250, defines a distal end of the anterior cushioning arrangement 208*a*, and consequently, a profile of the ground-engaging surface 30 in the ball portion $\mathbf{12}_B$ of the forefoot region 12 and along the lateral side 24 in the mid-foot region 14.

The posterior segment 230*a* of the foam element 206*a* and the posterior cushioning arrangement 210*a* cooperate to define the ground-engaging surface 30 in the mid-foot region 14 and the heel region 16. Particularly, the posterior cushioning arrangement 210*a* defines the profile of the ground-engaging surface 30 in the peripheral region 26 of the heel region 16, as well as the peripheral region 26 of the mid-foot region 14 along the medial side 22. The posterior segment 230*a* of the foam element 206*a* defines the ground-engaging surface 30 in interior region 28 of the heel region 16, as well as the interior region 28 on the medial side 22 of the mid-foot region (see e.g., FIG. 14).

As shown in FIG. 9, the lower surface 286*a* of the chamber 278*a* of the posterior cushioning arrangement 210*a* defines a substantially planar portion of the ground-engaging surface 30 in the peripheral region 26. As shown in FIG. 12, the bottom surface 218 of the foam element 206*a* is substantially flush with the lower surface 286*a* of the posterior cushioning arrangement 210*a* and the bottom surface 246*a* of the anterior cushioning arrangement 208*a* in the mid-foot region 14 of the sole structure. Accordingly, each of the foam element 206*a*, the anterior cushioning arrangement 208*a*, and the posterior cushioning arrangement 210*a* cooperate to define a substantially continuous portion of the ground-engaging surface 30 from the medial side 22 to the lateral side 24 in the mid-foot region 14.

Referring still to FIG. 12, the thickness THE of the foam element 206*a* in the interior region 28 of the posterior segment 230*a* tapers along a direction from the recess 226*a* to the posterior end 20 of the sole structure 200*a*. Particularly, the thickness THE of the foam element 206*a* is tapered such that the bottom surface 218 of the foam element 206*a* diverges from the lower surface 286*a* of the posterior cushioning arrangement 210*a* along the direction from the recess 226*a* to the posterior end 20. Thus, while the bottom surface 218 of the foam element 206*a*, the bottom surface 246*a* of the anterior cushioning arrangement 208*a*, and the lower surface 286*a* of the posterior cushioning arrangement 210*a* are substantially flush at the recess 226*a*, the bottom surface 218 of the foam element 206*a* is spaced apart from the lower surface 286*a* of the posterior cushioning arrangement 210*a* in the heel region 16. Accordingly, the posterior cushioning arrangement 210*a* and the foam element 206*a* cooperate to define a trampoline-like structure in the heel region 16 of the sole structure 200*a*.

This configuration allows the impact forces associated with an initial heel strike to be absorbed by the trampoline structure and distributed through the posterior cushioning arrangement 210*a*, while forces are more evenly distributed among the foam element 206*a* and the posterior cushioning arrangement 210*a* as the foot transitions through the mid-foot region 14. Within the forefoot region, the cushioning and performance properties of the anterior cushioning arrangement 208*a* are imparted to the ground-engaging surface 30. Particularly, forces associated with pushing off of the forefoot during running or jumping motions are absorbed by the anterior cushioning arrangement 208*a*. Furthermore, by placing a column 252*c* of the bladders 250 along the lateral side 24 of the mid-foot region 14, ground contacting forces associated with rolling the foot through the mid-foot region 14 along the lateral side 24 may be absorbed by the anterior cushioning arrangement 208*a*.

The sole structure 200*a* further includes a heel counter 296 formed of the same TPU material as the bladder 272*a* and extending over the posterior cushioning arrangement 210*a* and the upper 100. As shown, the heel counter 296 extends from a first end on the lateral side 24, around the posterior end 20, and to the second end on the medial side 22. With reference to FIG. 9, a height of the heel counter 296 increases from the mid-foot region to a vertex 298 formed in the heel region 16, and then decreases to the posterior end 20. Although not illustrated, the heel counter 296 is similarly formed along the medial side 22, such that the height of the heel counter is cupped around the posterior end 20 of the upper 100.

In the illustrated example, the outsole 204*a* is formed integrally with the midsole 202*a* of using an overmolding process. Accordingly, the outsole 204*a* forms the ground-engaging surface 30 having a profile substantially similar to the profile defined by the cooperation of the various components 206*a*, 208*a*, 210*a* of the midsole 202*a*. The outsole 204*a* may be described has having an inner surface 299*a* configured to attach to the bottom surface 218 of the foam element 206*a*, the bottom surface 246*a* of the anterior cushioning arrangement 208*a*, and the lower surface 286*a* of the posterior cushioning arrangement 210*a*. An outer surface 300*a* of the outsole 204*a* is formed on an opposite side from the inner surface 299*a* and forms the ground-engaging surface 30 of the sole structure 200*a*. Accordingly, the outsole 204*a* at least partially encompasses each of the foam element 206*a*, the anterior cushioning arrangement 208*a*, and the posterior cushioning arrangement 210*a*. The outsole 204*a* is formed of a resilient material configured to impart properties of abrasion resistance and traction to the ground-engaging surface 30 of the sole structure 200*a*. In other examples the outsole 204*a* may be formed separately from the midsole 202*a* and adhesively bonded to the midsole 202*a*.

Referring now to FIGS. 17-24E, an article of footwear 10*b* is provided and includes an upper 100 and a sole structure 200*b* attached to the upper 100. In view of the substantial similarity in structure and function of the components associated with the article of footwear 10*b* with respect to the article of footwear 10, like reference numerals are used hereinafter and in the drawings to identify like components while like reference numerals containing letter extensions are used to identify those components that have been modified.

Figure 18:
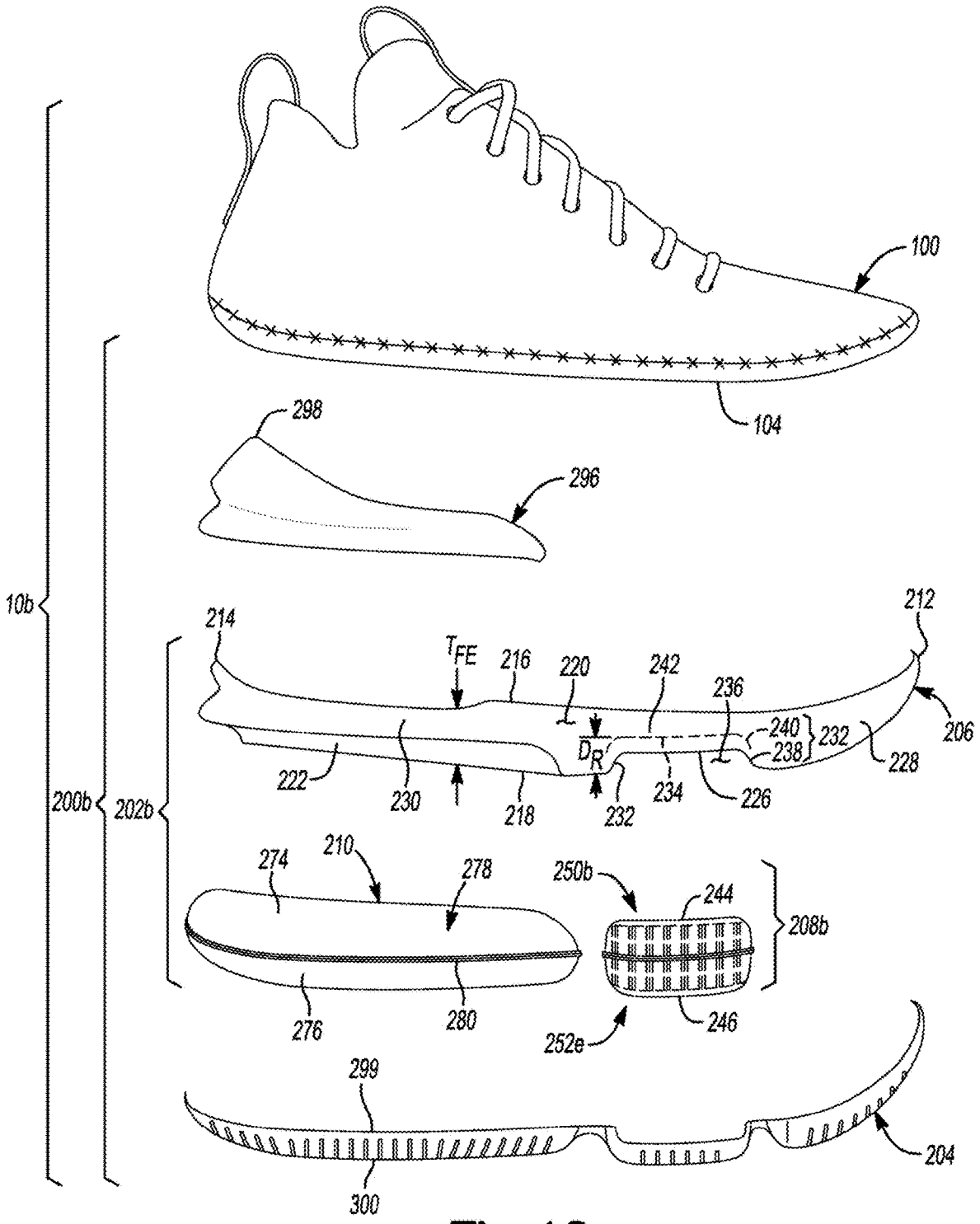
FIG. 18 is an exploded view of the article of footwear of FIG. 17, showing an article of footwear having an upper and a sole structure arranged in a layered configuration.

With reference to FIG. 18, the sole structure 200*b* includes the midsole 202*b* configured to provide cushioning characteristics to the sole structure 200*b*, and the outsole 204 configured to provide a ground-engaging surface 30 of the article of footwear 10. The midsole 202*b* includes a foam element 206, an anterior cushioning arrangement 208*b*, and the posterior cushioning arrangement 210. The subcomponents 206, 208*b*, 210 of the midsole 202*b* are assembled and secured to each other using various methods of bonding, including adhesively bonding and melding, for example.

Referring again to FIG. 18, the anterior cushioning arrangement 208*b* is configured to be disposed within the recess 226 of the foam element 206, in the forefoot region 12 of the sole structure 200*b*. The anterior cushioning arrangement 208*b* includes the top surface 244 and the bottom surface 246 formed on an opposite side of the anterior cushioning arrangement 208*b* from the top surface 244, whereby a distance between the top surface 244 and the bottom surface 246 defines a thickness $T_{ACA}$ of the anterior cushioning arrangement 208*b*. When assembled within the sole structure 200*b*, the top surface 244 is adjacent and attaches to the intermediate surface 234 of the recess 226 while the bottom surface 246 faces away from the intermediate surface 234 of the recess 226. Accordingly, the top surface 244 may be referred to as a proximal end of the anterior cushioning arrangement 208*b*, while the bottom surface 246 may be referred to as a distal end of the anterior cushioning arrangement 208*b*. The outer peripheral surface 248 extends between the top surface 244 and the bottom surface 246 and defines an outer peripheral profile of the anterior cushioning arrangement 208*b*.

In the illustrated example, the anterior cushioning arrangement 208*b* is formed as a fragmentary structure and includes a plurality of bladders 250*b* arranged to provide cushioning in the forefoot region 12 of the sole structure 200*b*. However, unlike the examples above where the cushioning arrangements 208, 208*a* include columns 252*d*, 252*c* of vertically-stacked pairs of the bladders 250, the columns 252*d*, 252*e* of the cushioning arrangement 208*b* each include a single bladder 250*b* that extends continuously from the top surface 244 to the bottom surface 246 of the cushioning arrangement.

Figure 19:
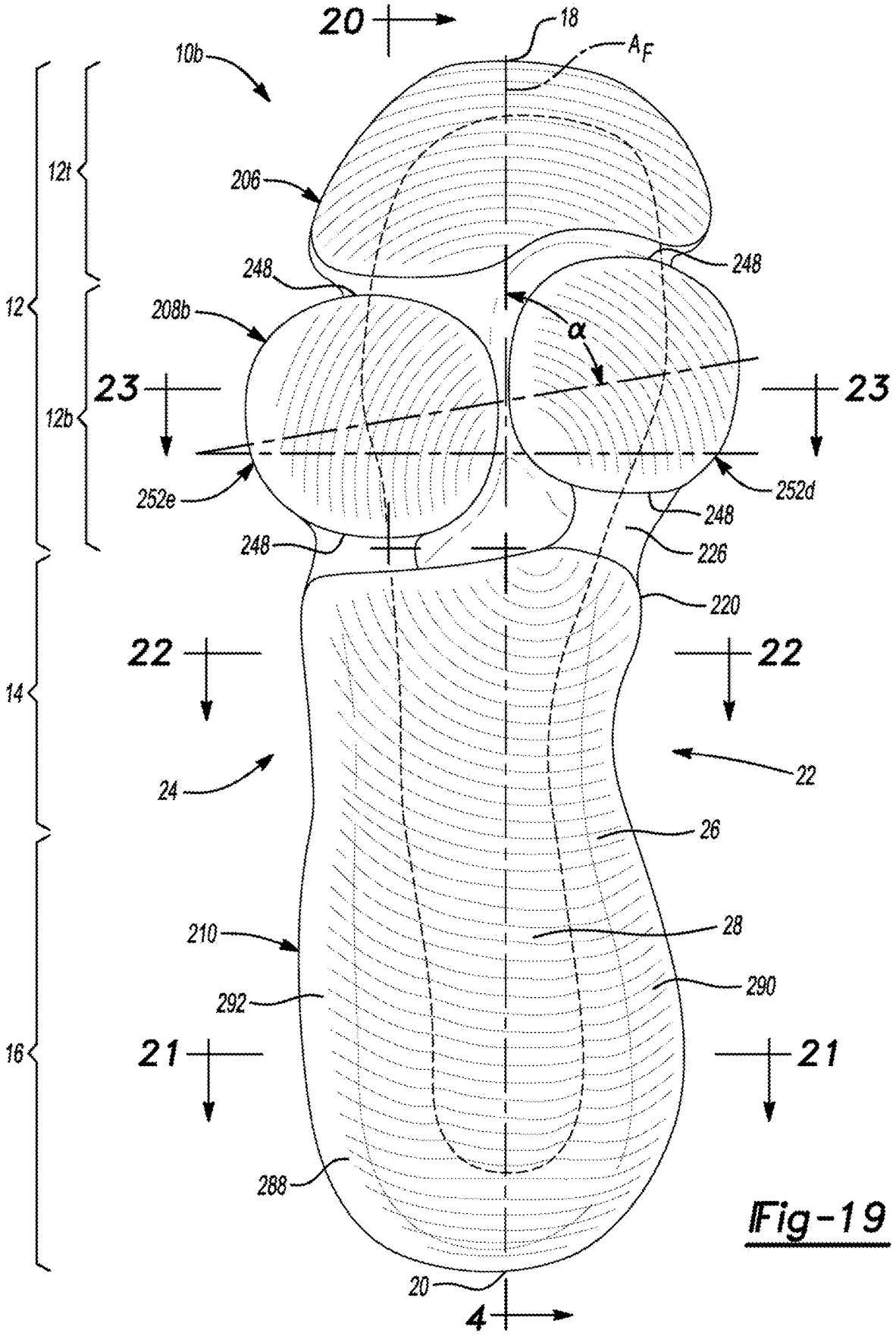
FIG. 19 is bottom perspective view of the article of footwear of FIG. 17.

As shown in FIG. 19, the anterior cushioning arrangement 208*b* includes a medial-forefoot column 252*d* and a lateral-forefoot column 252*e*, which may be collectively referred to as the forefoot columns 252*d*, 252*e*. The medial-forefoot column 252*d* is disposed proximate to the peripheral side surface 220 of the foam element 206 on the medial side 22 of the sole structure 200*b*, while the lateral-forefoot column 252*e* is disposed proximate to the peripheral side surface 220 of the foam element 206 on the lateral side 24 of the sole structure 200*b*.

The medial-forefoot column 252*d* and the lateral-forefoot column 252*e* are generally aligned with each other along a direction from the medial side 22 to the lateral side 24 of the sole structure 200. Further, the forefoot columns 252*d*, 252*e* are adjacent to each other and cooperate to form a portion of the midsole 202 extending from the medial side 22 to the lateral side 24 in the forefoot region 12. As shown in FIG. 3, a longitudinal position of the forefoot columns 252*d*, 252*e* corresponds to the location of the metatarsophalangeal (MTP) joints of the foot at the ball portion $\mathbf{12}_B$ of the forefoot region 12. Accordingly, the forefoot columns 252*d*, 252*e* are not aligned with each other along the lateral direction of the sole structure 200, but are instead aligned at an oblique angle $\alpha$ relative to the longitudinal axis $A_F$ of the sole structure 200, where the medial-forefoot column 252*d* is offset closer to the anterior end 18 of the sole structure than the lateral-forefoot column 252*e*.

The bladders 250*b* of the anterior cushioning arrangement 208*b* are constructed in a similar manner to each other. For example, each of the bladders 250*b* includes a first barrier layer 254*b* and a second barrier layer 256*b* opposing the first barrier layer 254*b*, which can be joined to each other at discrete locations to define a chamber 258*b* and a peripheral seam 260*b*

In some implementations, the first barrier layer 254*b* and the second barrier layer 256*b* cooperate to define a geometry (e.g., thickness, width, and length) of the chamber 258*b*. For example, the peripheral seam 260*b* bounds the chamber 258*b* to seal the fluid (e.g., air) within the chamber 258*b*. Thus, the chamber 258*b* is associated with an area of the bladder 250*b* where interior surfaces of the first barrier layer 254*b* and the second barrier layer 256*b* are not joined together and, thus, are separated from one another. In the illustrated example, an outer peripheral profile of the chamber 258*b* has a cross-sectional shape corresponding to a rounded square, as best shown in FIG. 19.

In the illustrated example, each of the first barrier layer 254*b* and the second barrier layer 256*b* is cup-shaped, such that the barrier layers 254*b*, 256*b* cooperate to define a height of the bladder 250*b*. However, in other examples, one of the barrier layers 254*b*, 256*b* may be cup-shaped to define an overall height of the bladder 250*b*, while the other one of the barrier layers 254*b*, 256*b* is planar and defines a cover of the bladder 250*b*.

As shown in the figures, a space formed between opposing interior surfaces of the first barrier layer 254*b* and the second barrier layer 256*b* defines an interior void 262*b* of the chamber 258*b*. The interior void 262*b* of the chamber 258*b* may receive a tensile element 264*b* therein. Each tensile element 264*b* may include a series of tensile strands 266*b* extending between a first tensile sheet 268*b* and a second tensile sheet 270*b*. The first tensile sheet 268*b* may be attached to the first barrier layer 254*b* while the second tensile sheet 270*b* may be attached to the second barrier layer 256*b*. In this manner, when the chamber 258*b* receives the pressurized fluid, the tensile strands 266*b* of the tensile element 264*b* are placed in tension. Because the first tensile sheet 268*b* is attached to the first barrier layer 254*b* and the second tensile sheet 270*b* is attached to the second barrier layer 256*b*, the tensile strands 266*b* retain a desired shape of the bladder 250*b* when fluid is injected into the interior void 262*b* to pressurize the bladder 250*b*.

In some examples, the interior void 262*b* is at a pressure ranging from 15 psi (pounds per square inch) to 25 psi. In other examples, the interior void 262*b* may have a pressure ranging from 20 psi to 25 psi. In some examples, the interior void 262*b* has a pressure of 20 psi. In other examples, the interior void 262*b* has a pressure of 25 psi. As provided above, where a plurality of bladders 250*b* form the anterior cushioning arrangement 208*b*, the interior voids 262*b* of each of the bladders 250*b* may be pressurized differently from each other.

Figure 20:
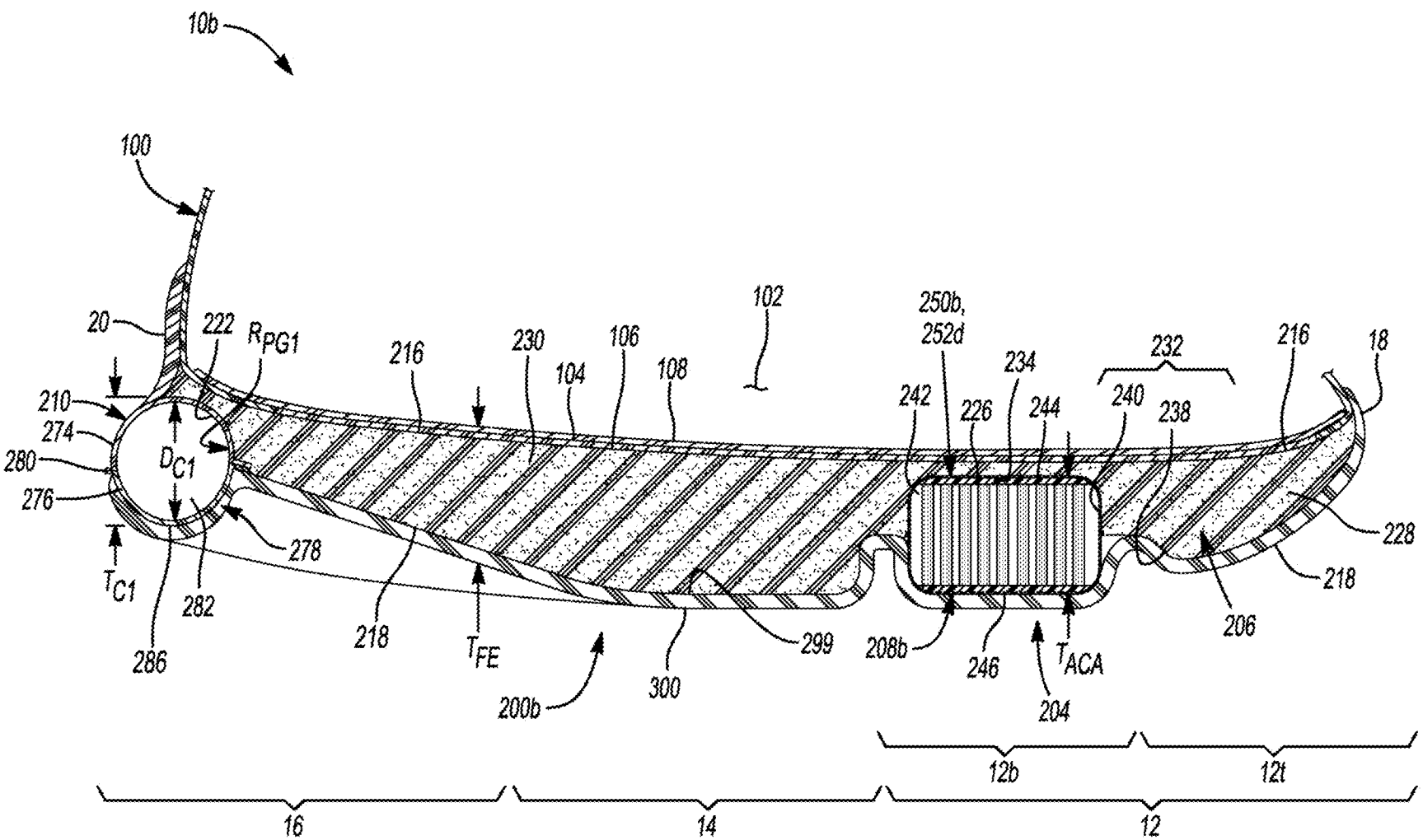
FIG. 20 is a cross-sectional view of the article of footwear of FIG. 17, taken along line 20-20 of FIG. 19 and corresponding to a longitudinal axis of the article of footwear.
Figure 21:
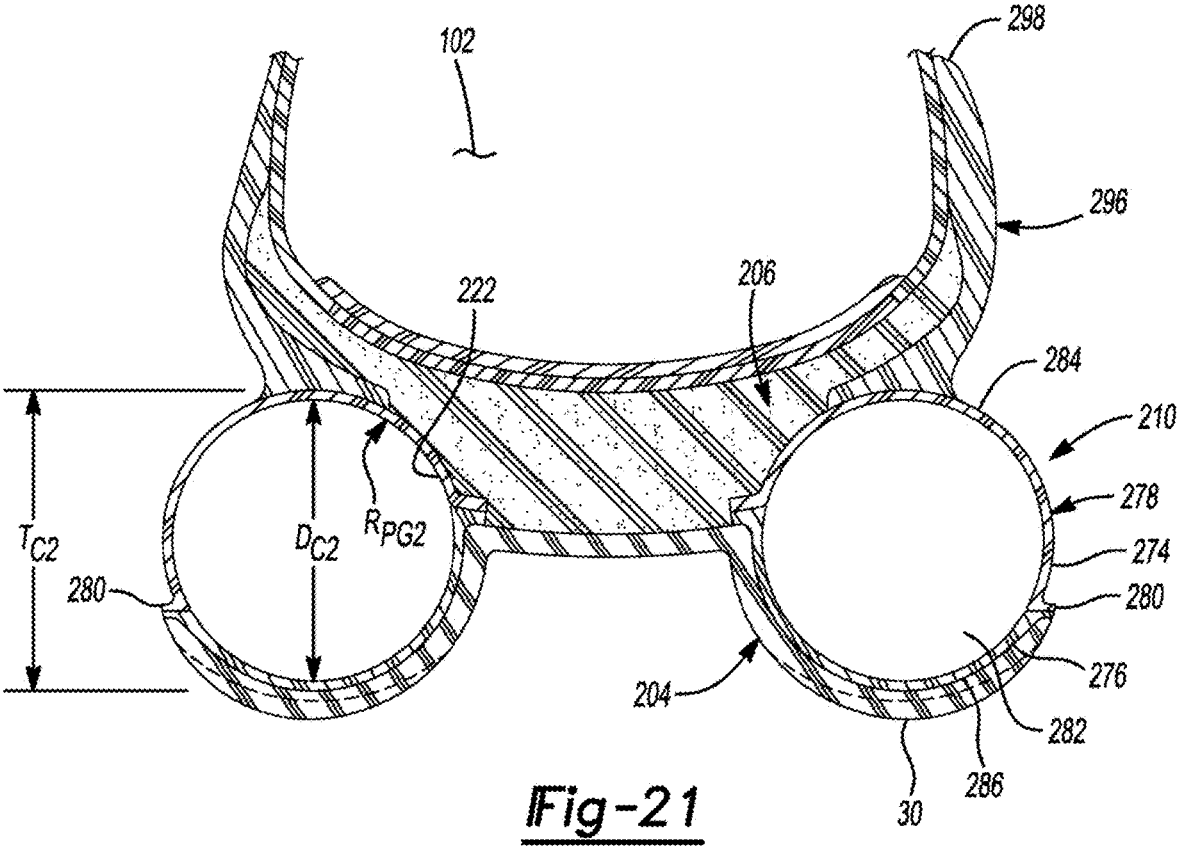
FIG. 21 is a cross-sectional view of the article of footwear of FIG. 17, taken along line 21-21 of FIG. 19.
Figure 22:
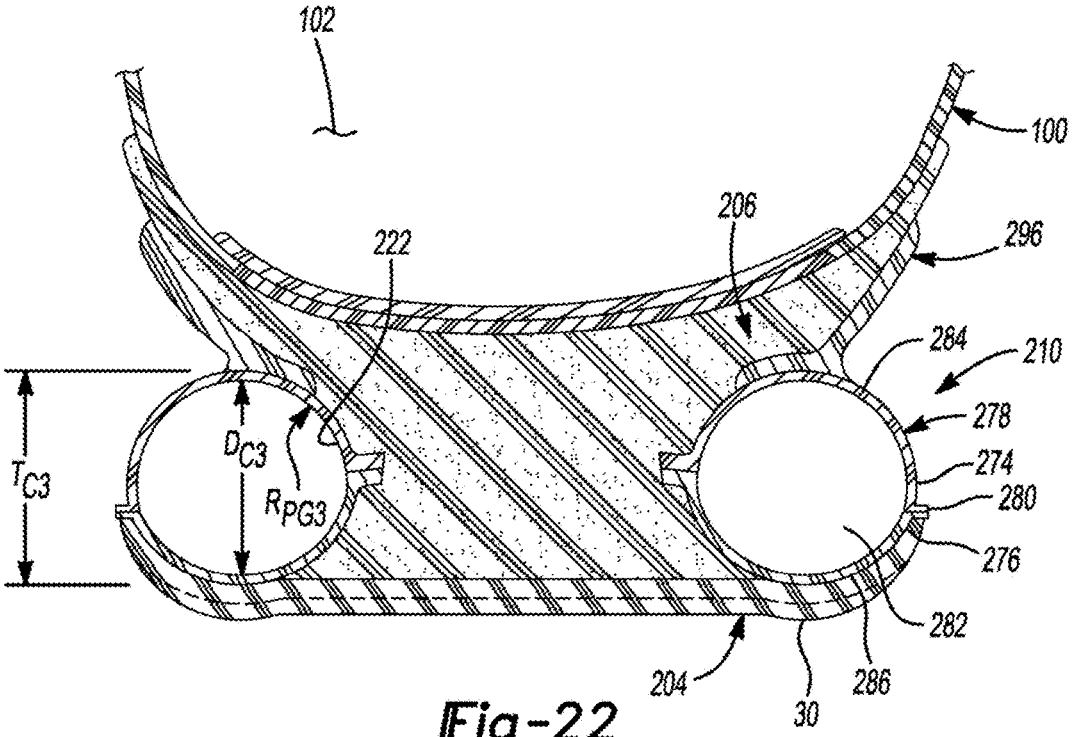
FIG. 22 is a cross-sectional view of the article of footwear of FIG. 17, taken along line 22-22 of FIG. 19.
Figure 23:
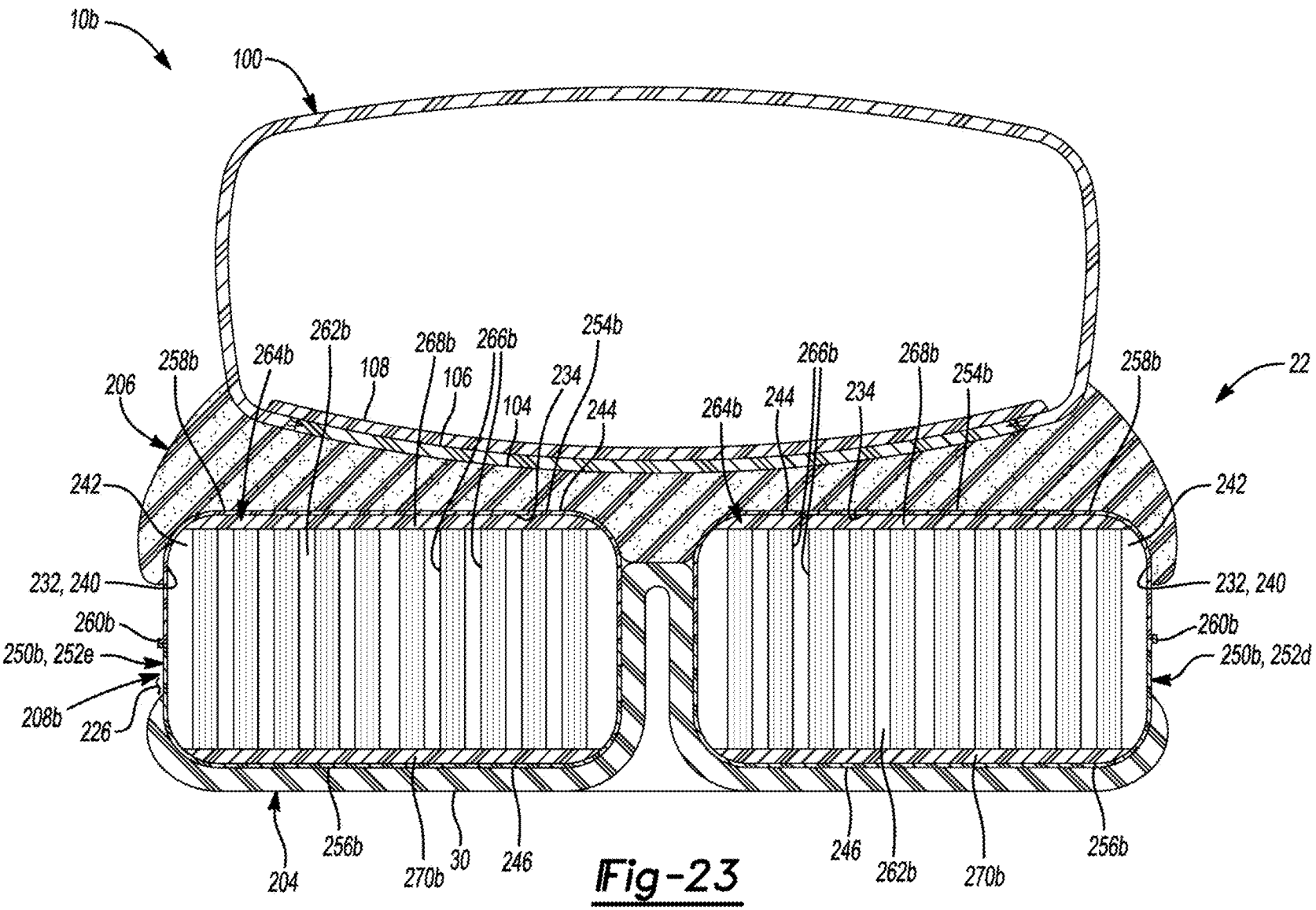
FIG. 23 is a cross-sectional view of the article of footwear of FIG. 17, taken along line 23-23 of FIG. 19.
Figure 24A:
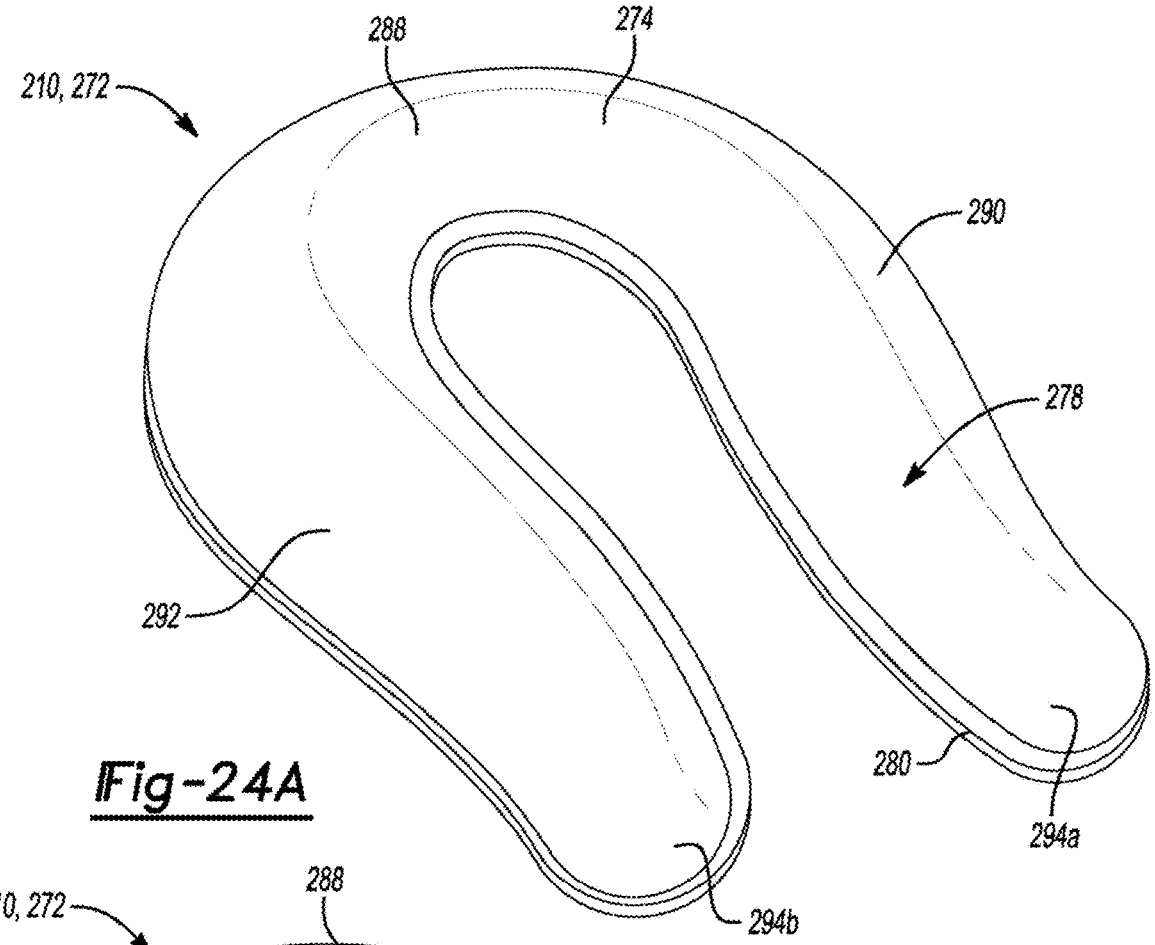
FIGS. 24A and 24B are top and bottom perspective views of a bladder of the article of footwear of FIG. 17.
Figure 24B:
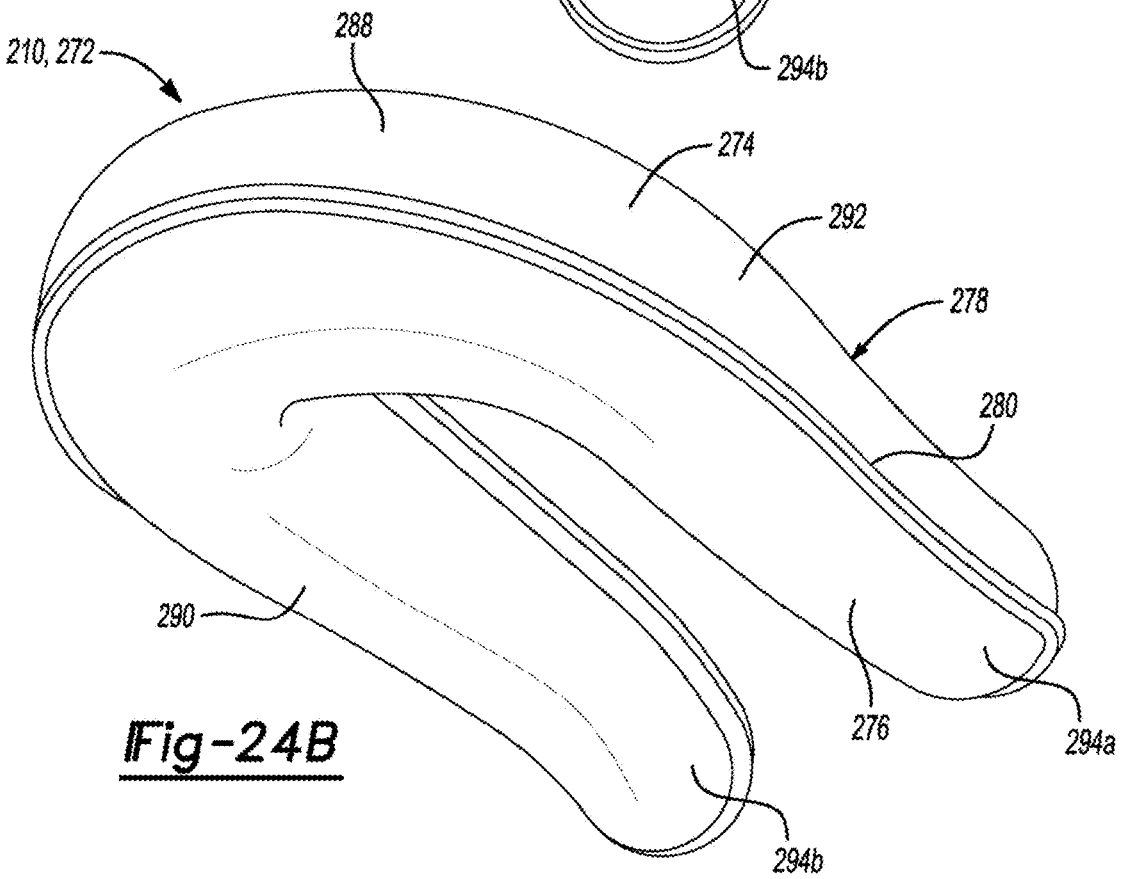
Figure 24C:
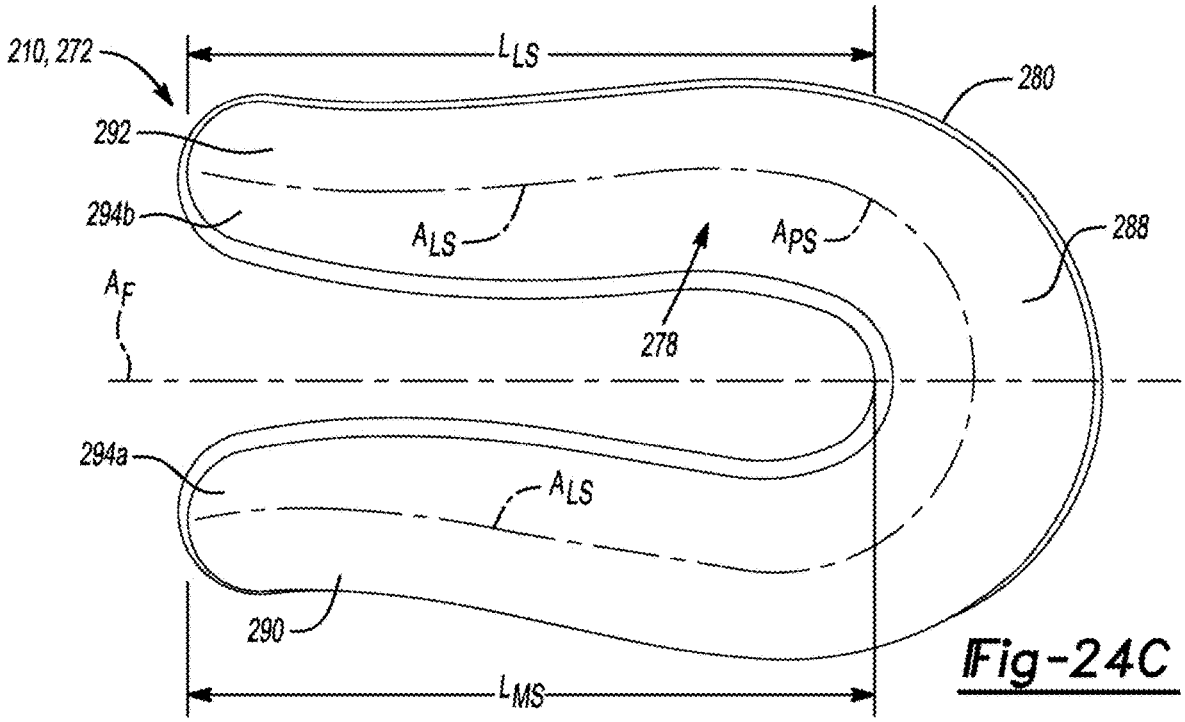
FIG. 24C is a top plan view of the bladder of FIGS. 8A and 8B.
Figure 24D:
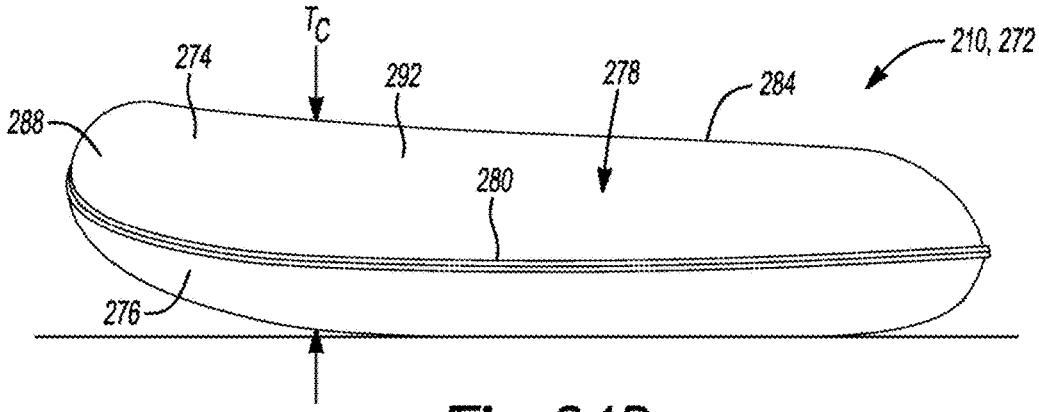
FIGS. 24D and 24E are medial and lateral side elevation views of the bladder of FIGS. 8A and 8B.
Figure 24E:
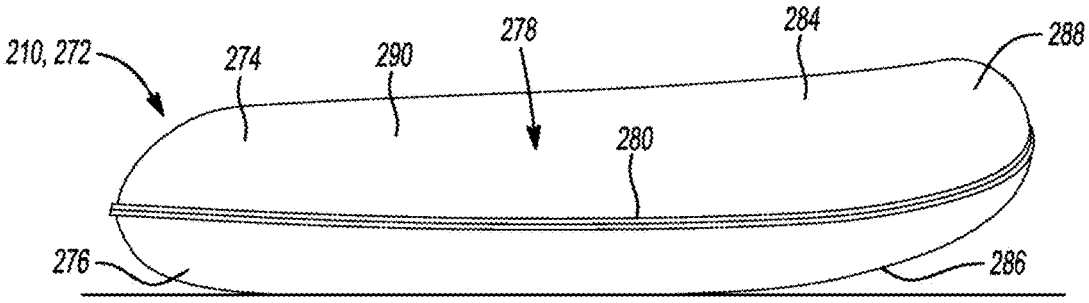
Figure 25:
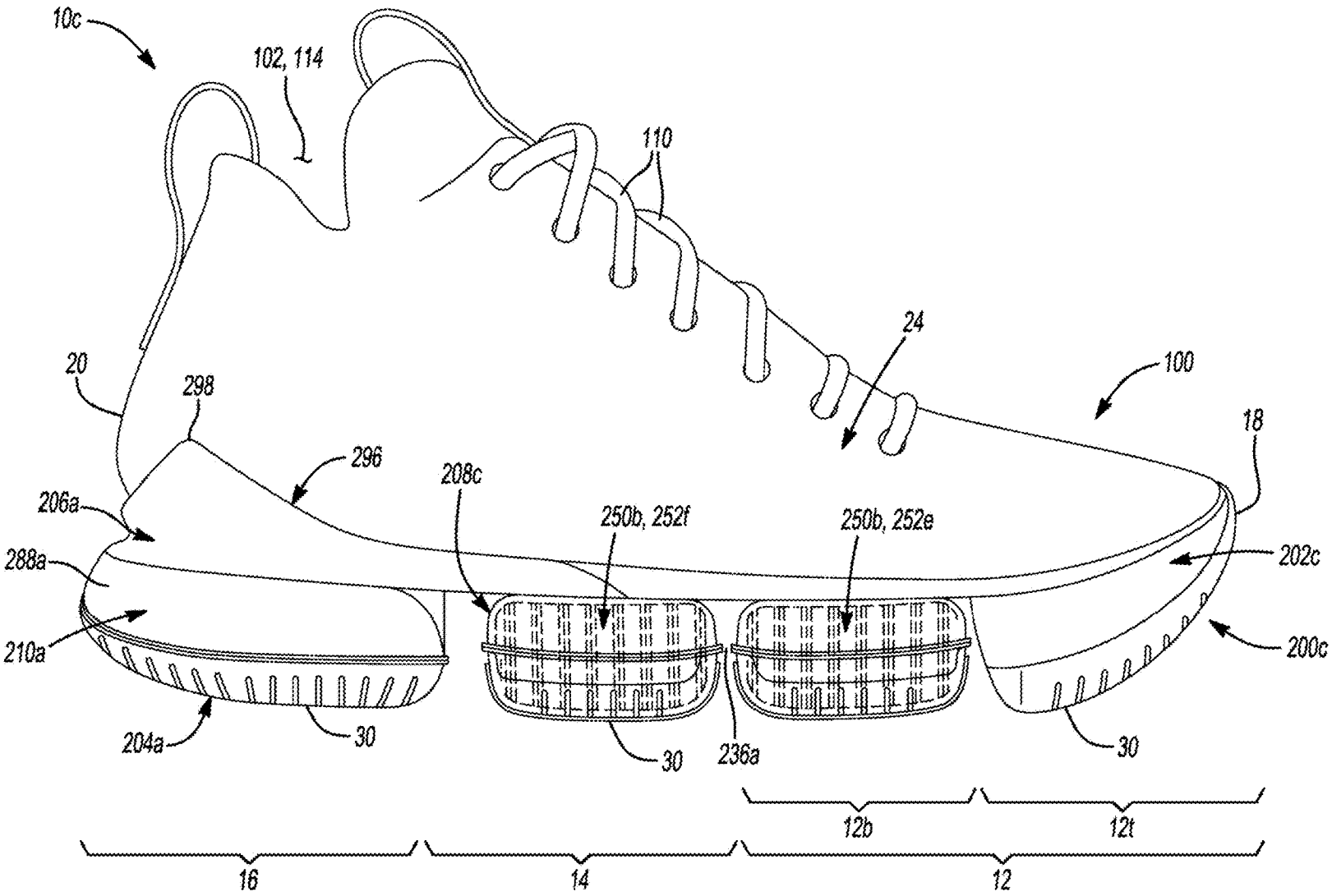
FIG. 25 is a side elevation view of an article of footwear in accordance with principles of the present disclosure.

Referring to the cross-sectional view of FIG. 20, when the sole structure 200*b* is assembled, each of the foam element 206, the anterior cushioning arrangement 208*b*, and the posterior cushioning arrangement 210 cooperate to define a profile of the ground-engaging surface 30. As used herein, the midsole 202*b* is referred to as defining the profile of the ground-engaging surface 30, while the outsole 204 actually forms the ground-engaging surface 30. For example, the shape of the ground-engaging surface 30 is determined by the midsole 202*b* and the outsole 204 is overmolded onto the midsole 202*b* to provide wear resistance and traction properties.

Referring now to FIGS. 25-32E, an article of footwear 10*c* is provided and includes an upper 100 and a sole structure 200*c* attached to the upper 100. In view of the substantial similarity in structure and function of the components associated with the article of footwear 10*b* with respect to the article of footwear 10*c*, like reference numerals are used hereinafter and in the drawings to identify like components while like reference numerals containing letter extensions are used to identify those components that have been modified.

Figure 26:
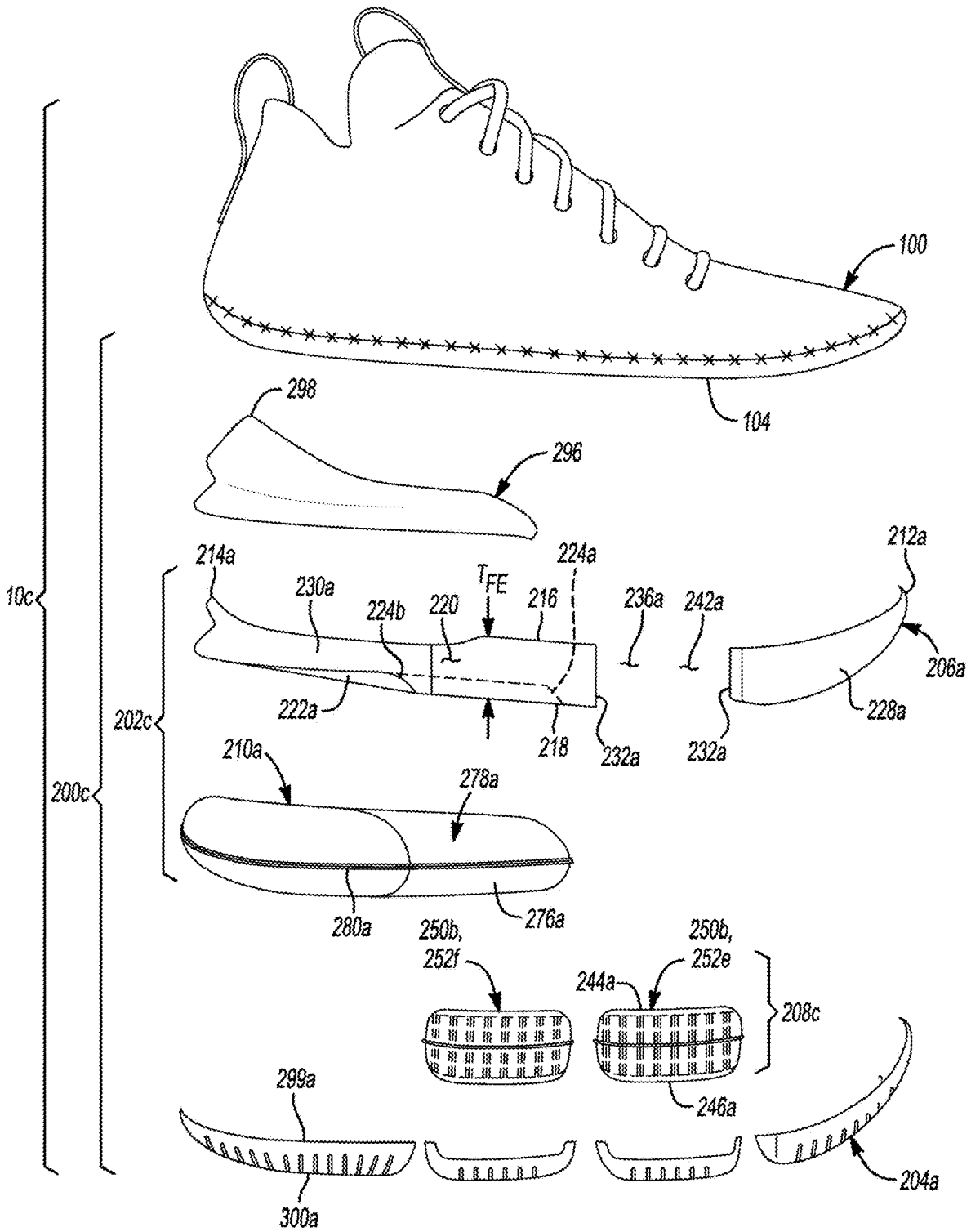
FIG. 26 is an exploded view of the article of footwear of FIG. 25, showing an article of footwear having an upper and a sole structure arranged in a layered configuration.

With reference to FIG. 26, the sole structure 200*c* includes a midsole 202*c* configured to provide cushioning characteristics to the sole structure 200*c*, and an outsole 204*a* configured to provide a ground-engaging surface 30 of the article of footwear 10*c*. The midsole 202*c* includes the foam element 206*a*, an anterior cushioning arrangement 208*c*, and a posterior cushioning arrangement 210*c*. The subcomponents 206*a*, 208*c*, 210*c* of the midsole 202*c* are assembled and secured to each other using various methods of bonding, including adhesively bonding and melding, for example.

Figure 28:
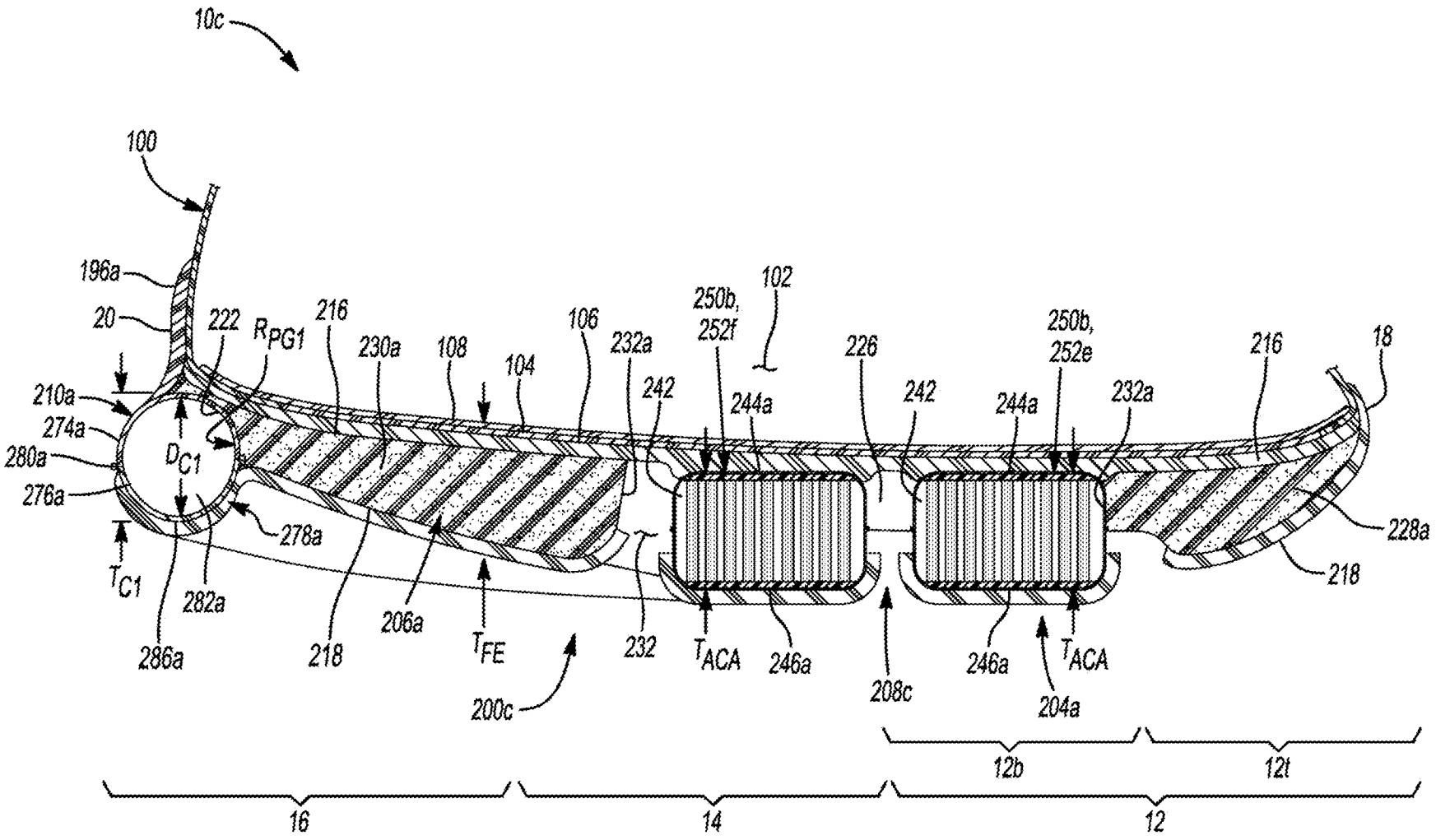
FIG. 28 is a cross-sectional view of the article of footwear of FIG. 25, taken along line 28-28 of FIG. 27 and corresponding to a longitudinal axis of the article of footwear.
Figure 29:
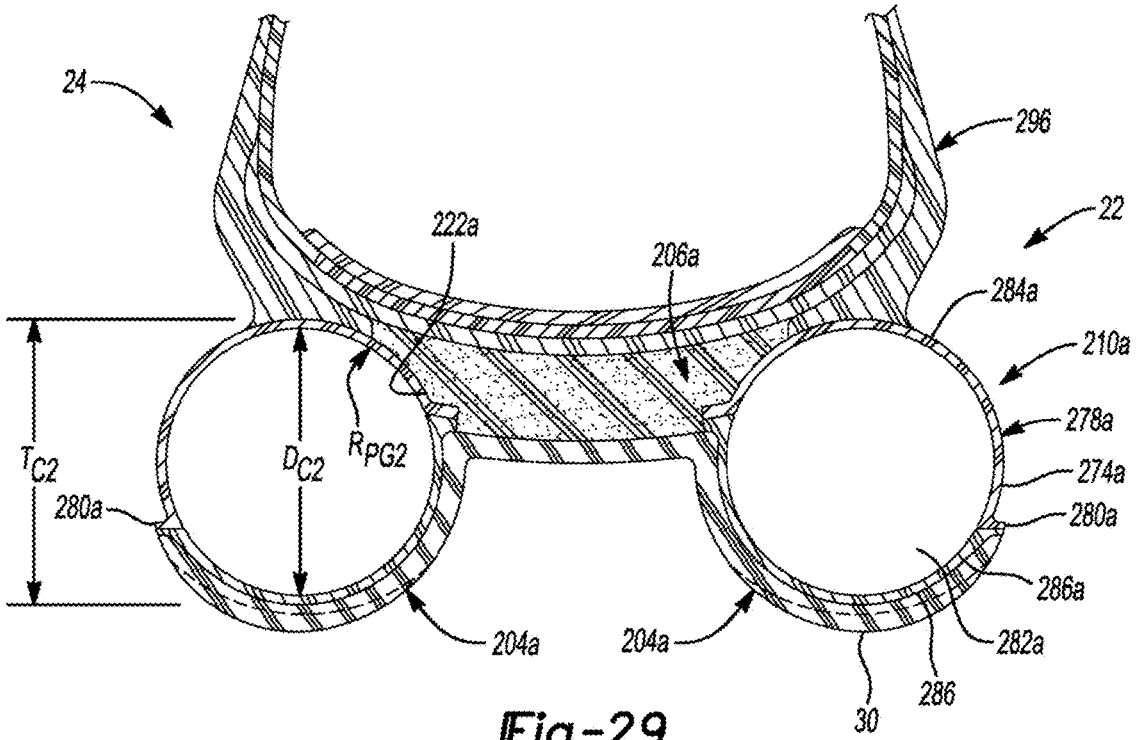
FIG. 29 is a cross-sectional view of the article of footwear of FIG. 25, taken along line 29-29 of FIG. 27.
Figure 30:
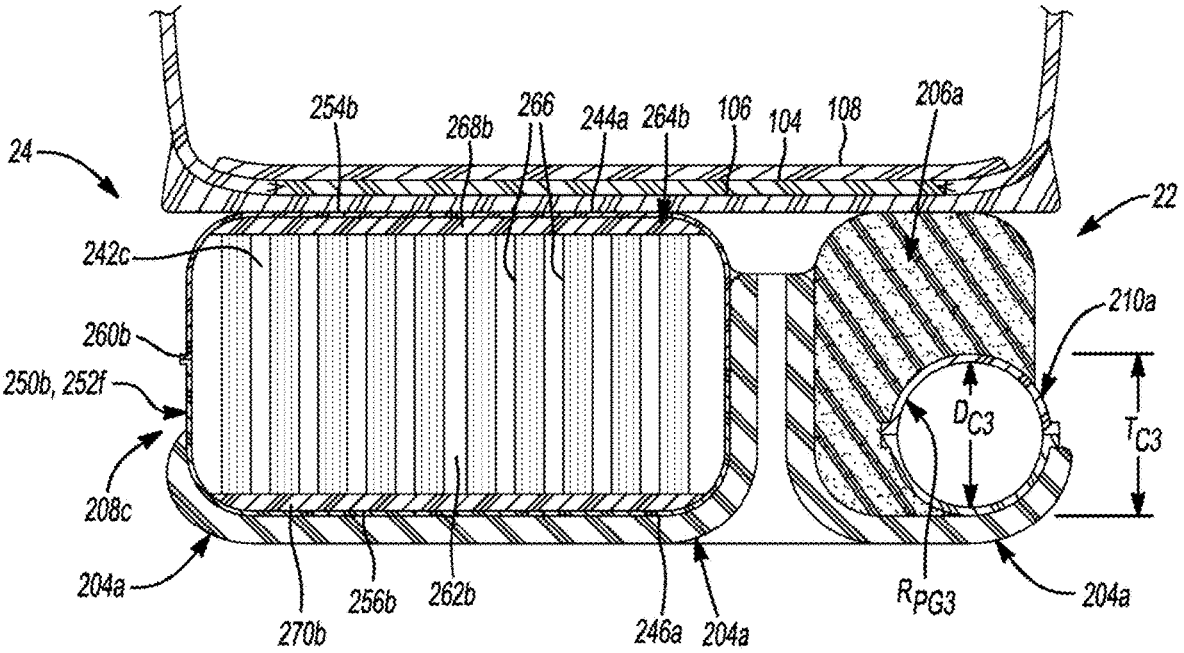
FIG. 30 is a cross-sectional view of the article of footwear of FIG. 25, taken along line 30-30 of FIG. 27.
Figure 31:
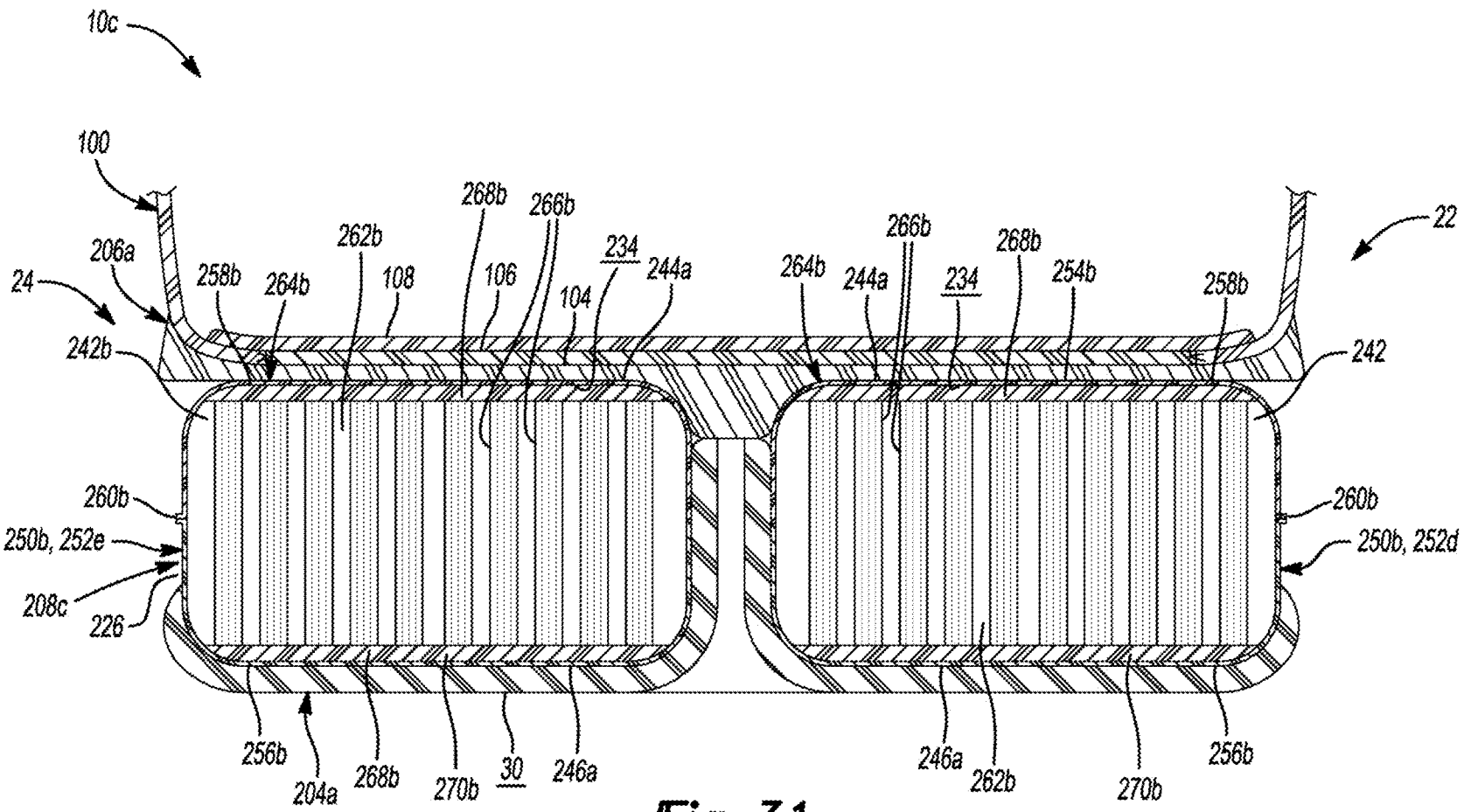
FIG. 31 is a cross-sectional view of the article of footwear of FIG. 25, taken along line 31-31 of FIG. 27.
Figure 32A:
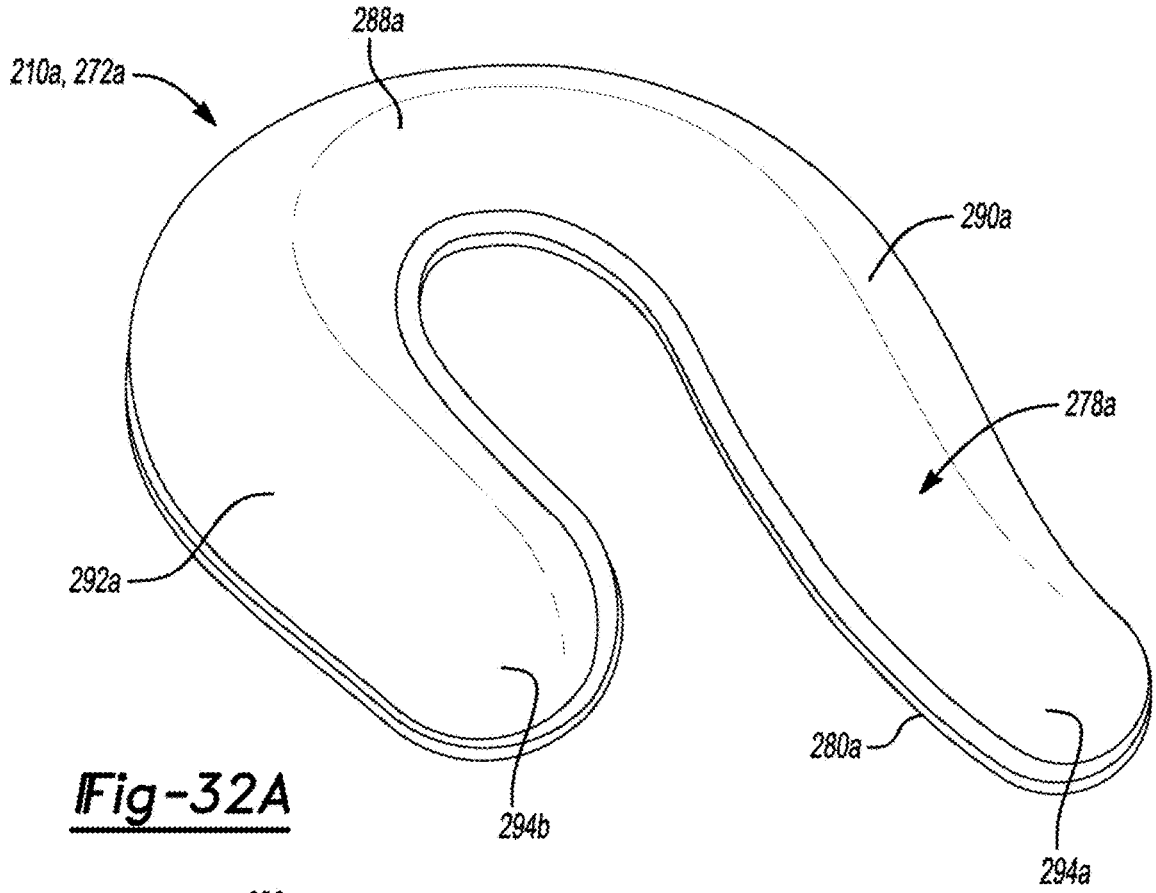
FIGS. 32A and 32B are top and bottom perspective views of a bladder of the article of footwear of FIG. 25.
Figure 32B:
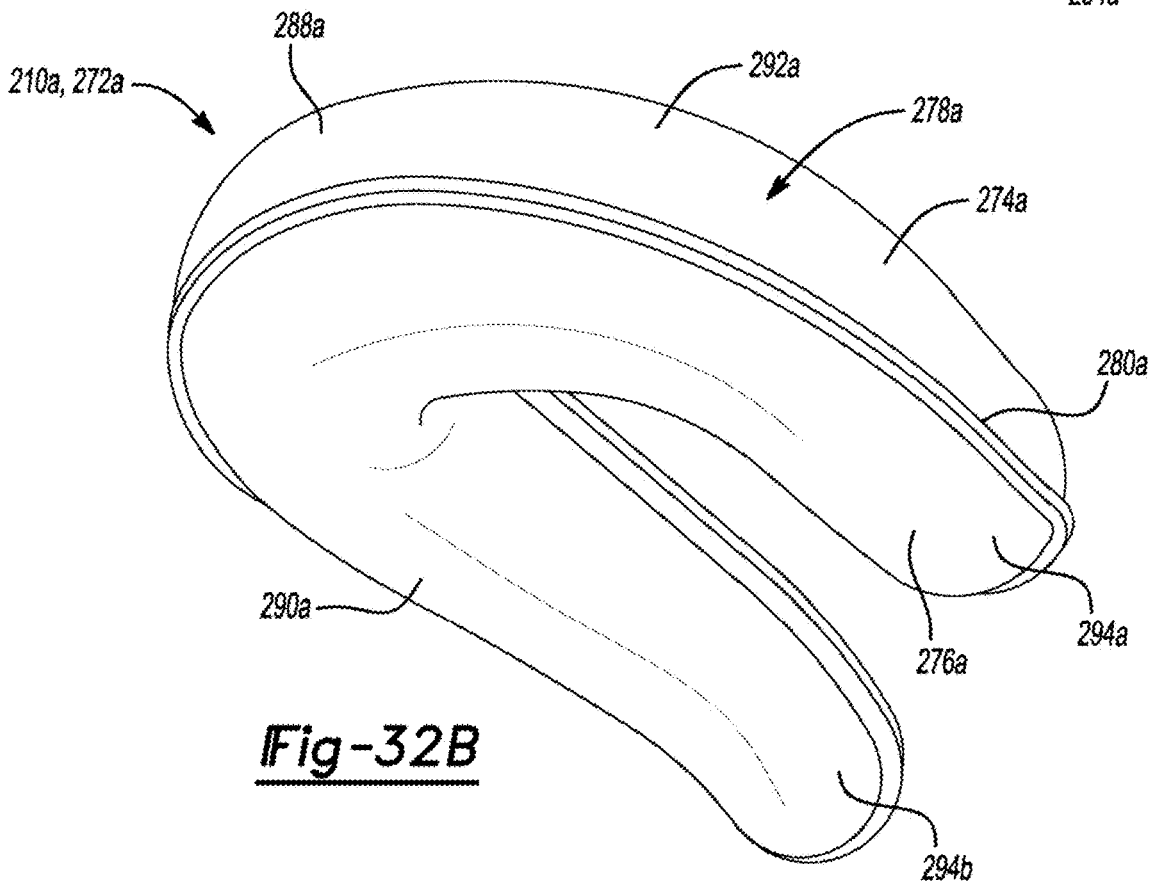
Figure 32C:
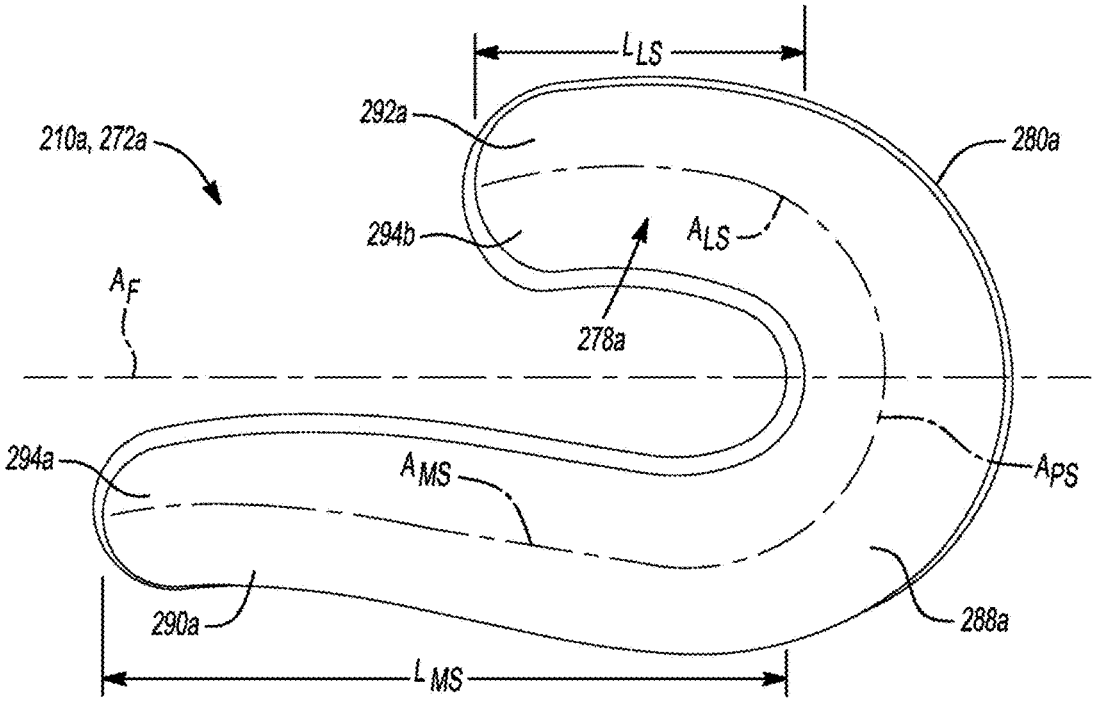
FIG. 32C is a top plan view of the bladder of FIGS. 32A and 32B.
Figure 32D:
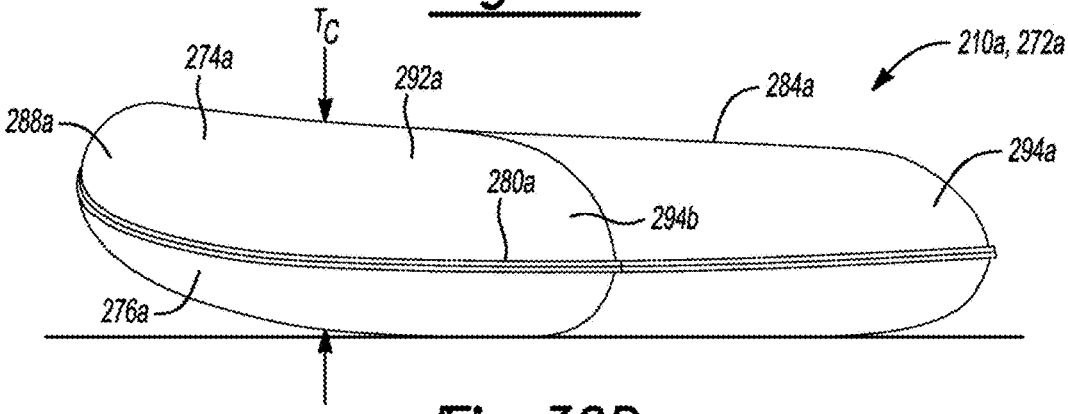
FIGS. 32D and 32E are medial and lateral side elevation views of the bladder of FIGS. 32A and 32B.
Figure 32E:
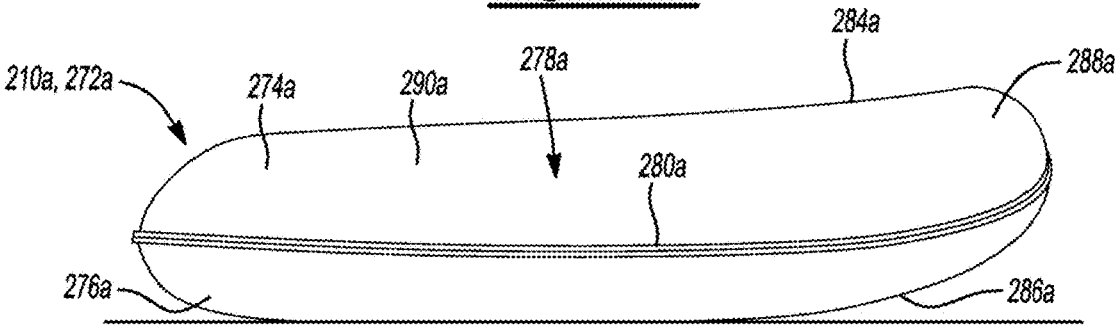

Referring to FIG. 26, the anterior cushioning arrangement 208*c* is configured to be disposed within the recess 226*a* of the foam element 206*a*, in the forefoot region 12 and the mid-foot region 14 of the sole structure 200*c*. The anterior cushioning arrangement 208*c* includes a top surface 244*a* and a bottom surface 246*a* formed on an opposite side of the anterior cushioning arrangement 208*c* from the top surface 244*a*, whereby a distance between the top surface 244*a* and the bottom surface 246*a* defines a thickness $T_{ACA}$ of the anterior cushioning arrangement 208*c*, as shown in FIG. 28. When assembled within the sole structure 200*c*, the top surface 244*a* faces the upper 100 while the bottom surface 246*a* faces away from the upper 100. Accordingly, the top surface 244*a* may be referred to as a proximal end of the anterior cushioning arrangement 208*c*, while the bottom surface 246*a* may be referred to as a distal end of the anterior cushioning arrangement 208*c*. An outer peripheral surface 248*a* extends between the top surface 244*a* and the bottom surface 246*a* and defines an outer peripheral profile of the anterior cushioning arrangement 208*c*.

In the illustrated example, the anterior cushioning arrangement 208*c* is formed as a fragmentary structure and includes a plurality of the bladders 250*b* arranged to provide cushioning in the forefoot region 12 of the sole structure 200*b*. However, unlike the examples above where the cushioning arrangements 208, 208*a* include columns 252*d*-252*e* of vertically-stacked pairs of the bladders 250, the columns 252*d*-252*e* of the cushioning arrangement 208*b* each include a single one of the bladders 250*b* that extends continuously from the top surface 244*a* to the bottom surface 246*a* of the anterior cushioning arrangement 208*c*. Here, the bladders 250*b* of the anterior cushioning arrangement 208*c* are constructed in a similar manner to the bladders 250*b* described above with respect to the example of FIGS. 17-24E.

Figure 27:
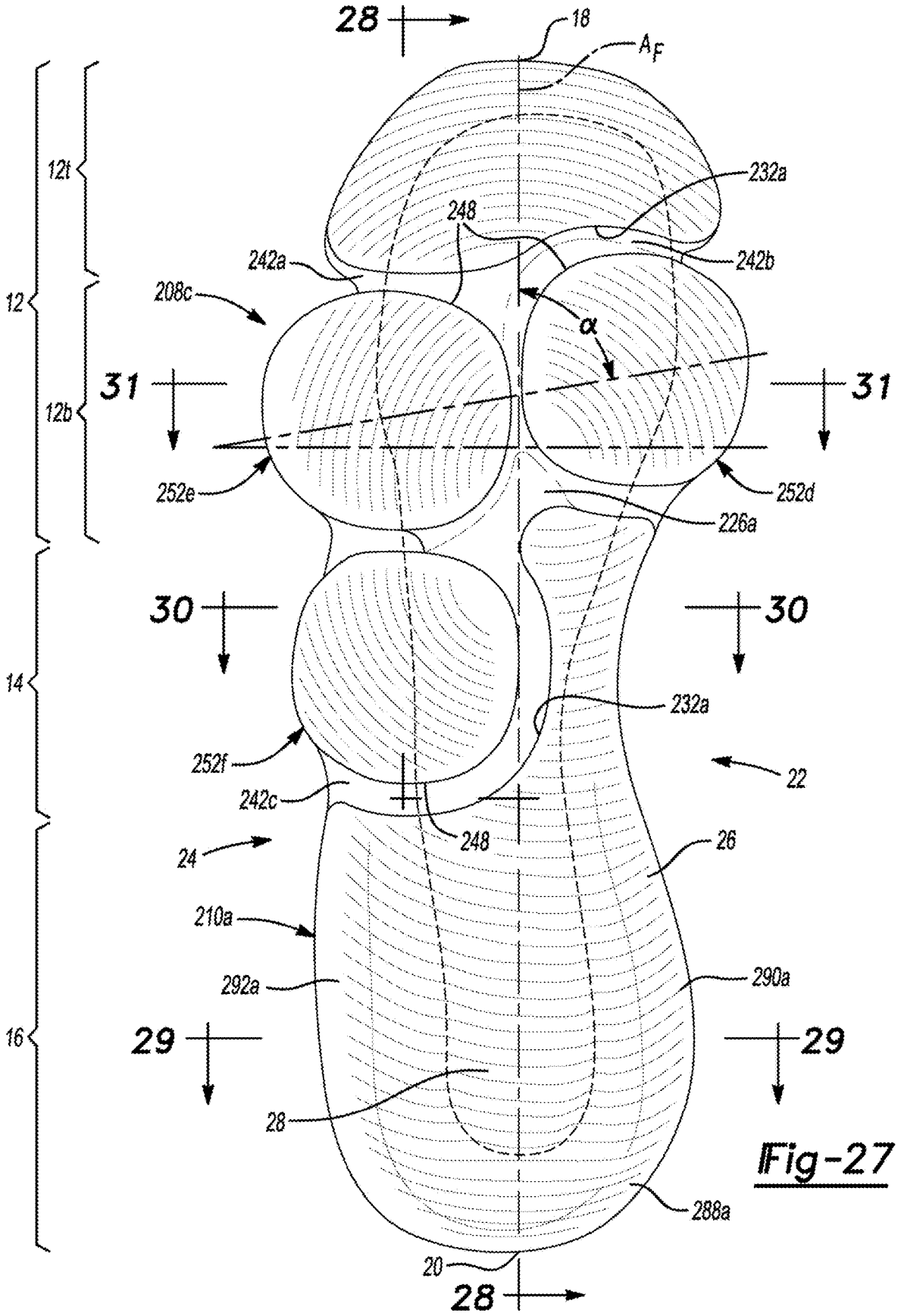
FIG. 27 is bottom perspective view of the article of footwear of FIG. 25.

As shown in FIG. 27, the anterior cushioning arrangement 208*c* includes the medial-forefoot column 252*d* and lateral-forefoot column 252*e*, which may be collectively referred to as the forefoot columns 252*d*, 252*e*. The medial-forefoot column 252*d* is disposed within the medial-forefoot receptacle 242*a*, proximate to the peripheral side surface 220 of the foam element 206*a* on the medial side 22 of the sole structure 200*c* in the forefoot region 12. The lateral-forefoot column 252*e* is disposed within the lateral-forefoot receptacle 242*b* proximate to the peripheral side surface 220 of the foam element 206*a* on the lateral side 24 of the sole structure 200*c* in the forefoot region 12.

The medial-forefoot column 252*d* and the lateral-forefoot column 252*e* are generally aligned with each other along a direction from the medial side 22 to the lateral side 24 of the sole structure 200*c*. Further, the forefoot columns 252*d*, 252*e* are adjacent to each other and cooperate to form a portion of the midsole 202*c* extending from the medial side 22 to the lateral side 24 in the ball portion $\mathbf{12}_B$ of the of the forefoot region 12. As shown in FIG. 27, a longitudinal position of the forefoot columns 252*d*, 252*e* corresponds to the location of the metatarsophalangeal (MTP) joints of the foot. Accordingly, the forefoot columns 252*d*, 252*e* may not be aligned with each other along the lateral direction of the sole structure 200*c*, but are instead aligned at an oblique angle relative to the longitudinal axis $A_F$ of the sole structure 200*c*, where the medial-forefoot column 252*d* is offset closer to the anterior end 18 of the sole structure than the lateral-forefoot column 252*e*.

The anterior cushioning arrangement 208*c* may further include a lateral-midfoot column 252*f* disposed proximate to the peripheral side surface 220 of the foam element 206*a* on the lateral side of the sole structure 200*c* in the mid-foot region 14. Particularly, the lateral-midfoot column 252*f* is disposed within the lateral-midfoot receptacle 242*c* adjacent to the lateral-forefoot column 252*e* along the peripheral side surface 220 of the sole structure 200*c*. As shown in FIG. 27, the lateral-forefoot column 252*e* and the lateral-midfoot column 252*f* are substantially aligned with each other along the peripheral region 26 and cooperate to define a portion of the sole structure 200*c* along the lateral side 24 in the forefoot region 12 and the mid-foot region 14.

Referring to the cross-sectional view of FIG. 28, when the sole structure 200*c* is assembled, each of the foam element 206*a*, the anterior cushioning arrangement 208*c*, and the posterior cushioning arrangement 210*c* cooperate to define a profile of the ground-engaging surface 30. As used herein, the midsole is referred to as defining the profile of the ground-engaging surface 30, while the outsole 204*a* actually forms the ground-engaging surface 30. For example, the shape of the ground-engaging surface 30 is determined by the midsole 202*c* and the outsole 204*a* is overmolded onto the midsole 202*c* to provide wear resistance and traction properties.

The following Clauses provide an exemplary configuration for a bladder for an article of footwear described above.

Clause 1: A sole structure for an article of footwear having a heel region, a mid-foot region, a forefoot region, an interior region, and a peripheral region, the sole structure comprising, a foam element extending from the forefoot region to the heel region and having an upper surface and a lower surface formed on an opposite side of the foam element from the upper surface, the foam element including a recess formed in the lower surface in the forefoot region. The sole structure further includes a cushioning arrangement disposed in the recess of the foam element and having a proximal end adjacent to the lower surface of the foam element and a distal end formed on an opposite side of the anterior cushioning arrangement than the proximal end, the anterior cushioning arrangement including at least one medial bladder proximate to a medial side of the sole structure and at least one lateral bladder proximate to a lateral side of the sole structure.

Clause 2: The sole structure of Clause 1, wherein the at least one medial bladder is offset from the at least one lateral bladder along a longitudinal direction of the sole structure.

Clause 3: The sole structure of Clause 1, wherein the cushioning arrangement includes at least one chamber having a tensile member disposed therein.

Clause 4: The sole structure of Clause 1, wherein the recess includes a top surface opposing the at least one medial bladder and the at least one lateral bladder.

Clause 5: The sole structure of any Clause 4, wherein the at least one medial bladder and the at least one lateral bladder each include a first barrier layer and a second barrier layer joined to each other to define a chamber, wherein the second barrier layer is planar and the top surface of the recess is planar.

Clause 6: The sole structure of Clause 1, wherein the foam element has a heel thickness extending between the upper surface and the lower surface of the heel region of the foam element, the heel thickness being greater than a thickness of the cushioning arrangement.

Clause 7: The sole structure of Clause 2, further including a lateral support, wherein the foam element includes a lateral recess disposed on the lateral side of the sole structure and extending from the forefoot region to the mid-foot region.

Clause 8: The sole structure of Clause 7, wherein the lateral support includes a base support and lateral wall, the base support attached to the lower surface of the foam element, wherein the lateral wall includes an elongated portion extending from the lateral wall to a posterior end of the sole structure.

Clause 9: The sole structure of Clause 1, further comprising an outsole having an inner surface facing the and an outer surface formed on an opposite side of the outsole than the inner surface, the outer surface defining a ground-engaging surface of the sole structure.

Clause 10: The sole structure of Clause 9, wherein the outsole includes an anterior outsole and a posterior outsole spaced apart from the anterior outsole.

Clause 11: The sole structure of Clause 10, wherein the anterior outsole includes a pair of wings spaced apart from each other and extending from a lateral side and a medial side of the anterior outsole, each of the pair of wings tapering to a point.

Clause 12: The sole structure of Clause 11, wherein the posterior outsole includes a heel portion and a finger portion, the finger portion tapering away from the heel portion.

Clause 13: The sole structure of Clause 12, wherein the heel portion of the posterior outsole includes a slit.

Clause 14: The sole structure of Clause 13, wherein the slit is open at a distal end of the heel portion and generally bisects the heel portion along a width of the heel portion.

Clause 15: The sole structure of Clause 14, wherein the outsole is overmolded and encompasses each of the foam element, and anterior cushioning arrangement.

Clause 16: A sole structure for an article of footwear having a heel region, a mid-foot region, a forefoot region, an interior region, and a peripheral region, the sole structure comprising, a foam element, a medial bladder, a lateral bladder and an outsole, the foam element extending from the forefoot region to the heel region and having an upper surface and a lower surface formed on an opposite side of the foam element from the upper surface, the foam element including a recess formed in the lower surface in the forefoot region, the medial bladder proximate to a medial side of the sole structure and the lateral bladder proximate to a lateral side of the sole structure, the medial bladder and the lateral bladder disposed within the recess; and an outsole having an inner surface facing the and an outer surface formed on an opposite side of the outsole than the inner surface, the outer surface defining a ground-engaging surface of the sole structure, wherein the outsole includes an anterior outsole and a posterior outsole spaced apart from the anterior outsole.

Clause 17: The sole structure of Clause 16, wherein the anterior outsole includes a pair of wings spaced apart from each other and extending from a lateral side and a medial side of the anterior outsole, each of the pair of wings tapering to a point.

Clause 18: The sole structure of Clause 17, wherein the posterior outsole includes a heel portion and a finger portion, the finger portion tapering away from the heel portion, the heel portion of the posterior outsole includes a slit.

Clause 19: The sole structure Clause 18, wherein the slit is open at a distal end of the heel portion and generally bisects the heel portion along a width of the heel portion.

Clause 20: The sole structure of Clause 19, wherein the outsole is overmolded and encompasses each of the foam element, and anterior cushioning arrangement.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. A sole structure for an article of footwear, the sole structure comprising:

an anterior cushioning arrangement including a proximal end and a distal end formed on an opposite side of the anterior cushioning arrangement than the proximal end, the anterior cushioning arrangement including a medial bladder disposed proximate to a medial side of the sole structure and a lateral bladder disposed proximate to a lateral side of the sole structure and spaced apart from the medial bladder by a gap;

a posterior bladder fluidly isolated from the anterior cushioning arrangement and including a posterior segment fluidly coupled to an elongate medial segment and an elongate lateral segment;

an outsole extending over a distal end of the medial bladder, over a distal end of the lateral bladder, and including a first portion extending over a sidewall of the medial bladder and a second portion extending over a sidewall of the lateral bladder, the first portion opposing the second portion within the gap; and a foam element having (i) a first portion attached to the anterior cushioning arrangement and (ii) a second portion attached to the outsole between the medial segment and the lateral segment of the posterior bladder.

2. The sole structure of claim 1, wherein the medial bladder includes a first bladder and a second bladder in a stacked arrangement, the first bladder being disposed between the foam element and the second bladder.

3. The sole structure of claim 2, wherein the lateral bladder includes a third bladder and a fourth bladder in a stacked arrangement, the third bladder being disposed between the foam element and the fourth bladder.

4. The sole structure of claim 1, wherein the medial bladder is offset from the lateral bladder along a longitudinal direction of the sole structure.

5. The sole structure of claim 1, wherein the medial bladder is disposed closer to an anterior end of the sole structure than the lateral bladder.

6. The sole structure of claim 1, wherein the posterior bladder extends along a peripheral region of the sole structure from a heel region to a mid-foot region located between a forefoot region and the heel region.

7. The sole structure of claim 1, wherein at least one of the first portion and the second portion of the outsole contacts a lower surface of the foam element.

8. The sole structure of claim 7, wherein the at least one of the first portion and the second portion of the outsole contacts the lower surface of the foam element within the gap.

9. The sole structure of claim 1, wherein the first portion of the outsole is substantially parallel to the second portion of the outsole within the gap.

10. An article of footwear incorporating the sole structure of claim 1.

11. A sole structure for an article of footwear, the sole structure comprising:

an anterior cushioning arrangement including a proximal end and a distal end formed on an opposite side of the anterior cushioning arrangement than the proximal end, the anterior cushioning arrangement including a medial bladder disposed proximate to a medial side of the sole structure and a lateral bladder disposed proximate to a lateral side of the sole structure and spaced apart from the medial bladder by a gap;

a posterior bladder fluidly isolated from the anterior cushioning arrangement, the posterior bladder including a posterior segment fluidly coupled to an elongate medial segment and an elongate lateral segment;

an outsole extending over a distal end of the medial bladder, over a distal end of the lateral bladder, and including a first portion extending over a sidewall of the medial bladder and a second portion extending over a sidewall of the lateral bladder; and a foam element having (i) a first portion attached to the anterior cushioning arrangement and (ii) a second portion attached to the outsole between the medial segment and the lateral segment of the posterior bladder, and (iii) a third portion attached to the outsole within the gap of the anterior cushioning arrangement.

12. The sole structure of claim 11, wherein the medial bladder includes a first bladder and a second bladder in a stacked arrangement, the first bladder being disposed between the foam element and the second bladder.

13. The sole structure of claim 12, wherein the lateral bladder includes a third bladder and a fourth bladder in a stacked arrangement, the third bladder being disposed between the foam element and the fourth bladder.

14. The sole structure of claim 11, wherein the medial bladder is offset from the lateral bladder along a longitudinal direction of the sole structure.

15. The sole structure of claim 11, wherein the medial bladder is disposed closer to an anterior end of the sole structure than the lateral bladder.

16. The sole structure of claim 11, wherein the posterior bladder extends along a peripheral region of the sole structure from a heel region to a mid-foot region located between a forefoot region and the heel region.

17. The sole structure of claim 11, wherein a lower surface of the foam element includes a first recess receiving the medial bladder and a second recess receiving the lateral bladder, the at least one of the first portion and the second portion of the outsole contacting the lower surface of the foam element between the first recess and the second recess.

18. The sole structure of claim 11, wherein the lower surface of the foam element includes a projection extending into the gap, the at least one of the first portion and the second portion of the outsole contacting the lower surface of the foam element at the projection.

19. The sole structure of claim 11, wherein the first portion of the outsole is substantially parallel to the second portion of the outsole within the gap.

20. An article of footwear incorporating the sole structure of claim 11.

* * * * *